US010646751B2

(12) United States Patent
Bennett

(10) Patent No.: US 10,646,751 B2
(45) Date of Patent: May 12, 2020

(54) DEVICES AND METHODS FOR SIMULATING TRADITIONAL ROCK CLIMBING ENVIRONMENTS

(71) Applicant: Native Heights Climbing Solutions, LLC, Richmond, VA (US)

(72) Inventor: Hilton A. Bennett, Richmond, VA (US)

(73) Assignee: Native Heights Climbing Solutions, LLC, Richmond, VA (US)

( * ) Notice: Subject to any disclaimer, the term of this patent is extended or adjusted under 35 U.S.C. 154(b) by 308 days.

(21) Appl. No.: 15/485,489

(22) Filed: Apr. 12, 2017

(65) Prior Publication Data

US 2017/0296877 A1 Oct. 19, 2017

Related U.S. Application Data

(60) Provisional application No. 62/322,211, filed on Apr. 13, 2016.

(51) Int. Cl.
*A63B 29/02* (2006.01)
*A63B 69/00* (2006.01)

(52) U.S. Cl.
CPC ..... *A63B 29/024* (2013.01); *A63B 69/0048* (2013.01); *A63B 29/02* (2013.01); *A63B 2210/50* (2013.01)

(58) Field of Classification Search
CPC ..... A63B 29/024
USPC ..... 248/231.9, 903, 314, 925; 249/55; 482/37, 35, 57; 24/115 R
See application file for complete search history.

(56) References Cited

U.S. PATENT DOCUMENTS 3,903,785 A * 9/1975 Pepper, Jr. ..... A63B 29/024 248/694
4,044,976 A * 8/1977 Campbell ..... A63B 29/024 248/694
4,082,241 A * 4/1978 Burkey ..... A63B 29/024 24/115 R
4,491,291 A * 1/1985 Ching ..... A63B 29/024 248/231.9

(Continued)

FOREIGN PATENT DOCUMENTS

AU 2011202799 A1 1/2012
EP 1808201 A1 7/2007

(Continued)

*Primary Examiner* — Terrell L McKinnon
*Assistant Examiner* — Michael McDuffie
(74) *Attorney, Agent, or Firm* — ReavesColey PLLC

(57) ABSTRACT

An apparatus includes a frame and an access member. The frame is configured to be mounted to a structural support, and defines a first volume configured to receive at least a portion of a first insert, and a second volume configured to receive at least a portion of a second insert. The frame is configured such that when the first insert is within the first volume and the second insert is within the second volume a first engagement surface of the first insert is facing a second engagement surface of the second insert. The frame includes a first tapered surface that engages a tapered surface of the first insert to limit movement of the first insert along a lateral axis nonparallel to the longitudinal axis. The access member is configured to be coupled to the frame covering a portion of the first volume to limit movement of the first insert.

18 Claims, 27 Drawing Sheets

(56) References Cited

U.S. PATENT DOCUMENTS

| | | | | |
|---|---|---|---|---|
| 4,586,686 | A * | 5/1986 | Cason | A63B 29/024 248/231.9 |
| 4,832,289 | A | 5/1989 | Waggoner | |
| 4,923,160 | A * | 5/1990 | Waggoner | A63B 29/024 248/200 |
| 6,070,842 | A * | 6/2000 | Sandahl | A63B 29/024 248/231.9 |
| 6,092,773 | A | 7/2000 | Kieliszewski | |
| 6,109,578 | A | 8/2000 | Guthrie et al. | |
| 6,273,379 | B1 * | 8/2001 | Phillips | A63B 29/024 248/231.9 |
| 6,283,426 | B1 * | 9/2001 | Guthrie | A63B 29/024 248/231.21 |
| 6,510,599 | B2 * | 1/2003 | AmRhein | F16B 45/025 248/925 |
| 6,736,359 | B2 | 5/2004 | Murray | |
| 7,250,020 | B2 | 7/2007 | Barbafieri et al. | |
| 7,500,290 | B2 | 3/2009 | Klingier | |
| 7,524,269 | B2 | 4/2009 | Postma et al. | |
| 7,594,874 | B2 | 9/2009 | Meissner | |
| 7,762,928 | B2 | 7/2010 | Meissner | |
| 7,871,049 | B2 | 1/2011 | Fontana et al. | |
| 8,302,265 | B1 * | 11/2012 | Gretz | E04B 9/006 24/115 H |
| 9,656,111 | B1 | 5/2017 | Biddle | |
| 10,058,757 | B2 | 8/2018 | McGowan | |
| 10,252,130 | B2 | 4/2019 | Matys | |
| 2005/0145765 | A1 * | 7/2005 | Petzl | A63B 29/024 248/231.9 |
| 2005/0161566 | A1 * | 7/2005 | Tusting | A63B 29/024 248/231.9 |
| 2006/0192066 | A1 * | 8/2006 | Mills | A63B 69/0048 248/314 |
| 2007/0164182 | A1 | 7/2007 | MacKay | |
| 2007/0191188 | A1 | 8/2007 | Collins | |
| 2007/0194193 | A1 * | 8/2007 | Klingler | A63B 29/024 248/231.9 |
| 2009/0134294 | A1 * | 5/2009 | Hemsley | A63B 29/024 248/231.9 |
| 2009/0230268 | A1 | 9/2009 | Maltsev | |
| 2010/0016126 | A1 | 1/2010 | Wu | |
| 2014/0117187 | A1 * | 5/2014 | Crellin | A63B 29/024 248/317 |
| 2015/0056590 | A1 * | 2/2015 | Brost | A63B 29/02 434/247 |
| 2015/0329061 | A1 * | 11/2015 | Ziaylek | B60R 11/00 248/205.1 |
| 2016/0354667 | A1 | 12/2016 | Lyon | |

FOREIGN PATENT DOCUMENTS

| | | | |
|---|---|---|---|
| GB | 2343124 | A | 5/2000 |
| KR | 200403932 | | 12/2005 |
| KR | 101839114 | B1 | 3/2018 |
| WO | WO2010132865 | A1 | 11/2010 |

* cited by examiner

DEVICES AND METHODS FOR SIMULATING TRADITIONAL ROCK CLIMBING ENVIRONMENTS

CROSS-REFERENCE TO RELATED APPLICATIONS

This application benefit of priority to U.S. Provisional Application Ser. No. 62/322,211, entitled "Indoor Traditional Rock Climbing Device," filed Apr. 13, 2016, which is incorporated herein by reference in its entirety.

BACKGROUND

The embodiments described herein relate to devices and methods for physical training. More particularly, the embodiments described herein relate to devices and methods used to simulate traditional rock climbing in a training facility or indoor setting.

There are many different methods (or types) of rock climbing. Some known techniques, such as bouldering, are performed without a rope or safety line (i.e., they are unassisted). Other techniques, however, employ a safety line and one or more anchor point, which can be used to break the climber's fall if they slip from their position. For example, lead climbing generally refers to climbing techniques that employ a safety line and one or more anchor points that are along the climbing route, but that are not affixed at the very top of the climb. During lead climbing, the climber will carry the line (or rope) along the route, and fix the line (or rope) to anchor points along the route. In this manner, the anchor points will limit the climber's fall, but do not aid in the ascension process.

"Sport climbing" is a form of lead climbing that employs permanent anchors fixed to the rock along the routes. Because the need to place protection during the climb is virtually eliminated, sport climbing emphasizes gymnastic-like ability, strength, and endurance. Because the anchor points are pre-positioned, sport climbing is also commonly simulated in a training environment. For example, many training facilities or gyms include an artificial climbing wall to which climbing bolts with a tether (e.g., to couple to a carabiner or other safety clip) are attached. Artificial (or simulated) rock structures can also be mounted to the artificial climbing wall. In this manner, beginners can train on the basics of sport climbing while maintaining the desired level of safety and control.

In contrast to sport climbing, "traditional climbing" (also referred to as "trad climbing") is a form of lead climbing in which the climber places and later removes the anchors and/or protective structures to protect against falls. In particular, traditional climbing involves locating a crevice or feature within a rock formation that can support an anchor, placing the anchor, and then later removing the anchor (e.g., after the next anchor has been placed). Similarly stated, in traditional climbing, the rock is typically devoid of fixed anchors and bolts, and climbers must place removable protection as they climb. Traditional climbing, therefore, emphasizes adventure, risk and self-sufficiency.

Traditional climbing enthusiasts are increasingly seeking training facilities at which to learn and expand their traditional climbing techniques. Currently, most training occurs through trial and error on "real" rock. Known training facilities and artificial rock walls are not well suited for simulating traditional climbing. Specifically, because known training facilities include prepositioned anchors they do not accurately represent the environment found during traditional climbing. Moreover, to the extent that known rock climbing facilities include simulated rock structures (e.g., for foot holds, crevices or the like), such simulated rock structures must be individually arranged, and often do not represent a realistic traditional climbing environment. Furthermore, known rock climbing facilities and devices do not allow for easy replacement of the simulated rock structures.

Thus, a need exists for improved devices and methods used to simulate traditional rock climbing in a gym or suitable indoor setting.

SUMMARY

In some embodiments, an apparatus includes a frame and an access member. The frame is configured to be mounted to a structural support, and defines a first volume, a second volume, and a longitudinal axis separating the first volume and the second volume. The first volume is configured to receive at least a portion of a first insert, and the second volume is configured to receive at least a portion of a second insert. The frame is configured such that when the first insert is within the first volume and the second insert is within the second volume a first engagement surface of the first insert is facing a second engagement surface of the second insert. The frame includes a first tapered surface that engages a tapered surface of the first insert to limit movement of the first insert along a lateral axis nonparallel to the longitudinal axis. The frame also includes a second tapered surface configured to engage a tapered surface of the second insert to limit movement of the second insert along the lateral axis. The access member is configured to be coupled to the frame covering a portion of the first volume to limit movement of the first insert.

In some embodiments, a method includes coupling a frame to a structural support. The frame defines a first volume, a second volume, and a longitudinal axis separating the first volume and the second volume. After the coupling, a first insert is placed into the first volume and a second insert is placed into the second volume. The first insert includes a first engagement surface. The second insert includes a second engagement surface. The first insert and the second insert are placed such that the first engagement surface is facing the second engagement surface to define a crevice volume configured to receive a protective member such that the protective member engages the first engagement surface and the second engagement surface to limit movement of the protective member along the longitudinal axis. At least a portion of the first volume is covered with an access member that limits movement of the movement of the first insert.

DETAILED DESCRIPTION

Figure 1:
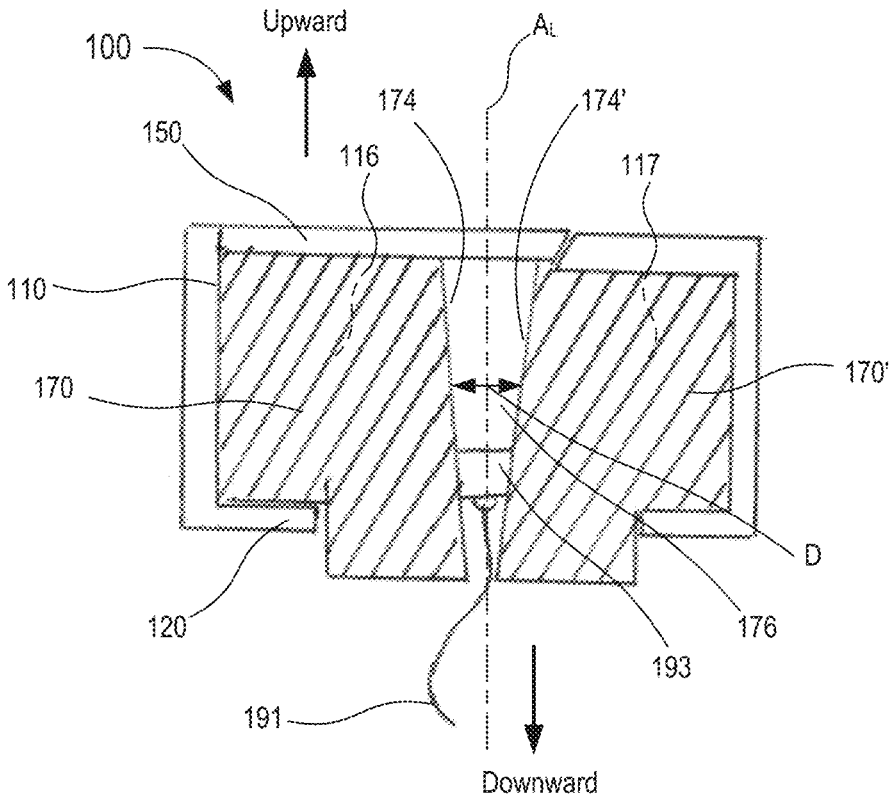
FIGS. 1 and 2 are schematic illustrations of a simulated traditional climbing device, according to an embodiment, in a first configuration and a second configuration, respectively.

The embodiments described herein can advantageously be used in a wide variety of simulation, training, and practice associated with traditional climbing. In particular, the simulated traditional climbing devices described herein can be installed in an indoor setting to simulate a traditional climbing environment. Any of the simulated traditional climbing devices described herein can define a simulated rock surface for the placement of a variety of different traditional gear, and can also optionally include a safety anchor to allow a climber to attach sport gear to provide safety until the traditional gear is placed. Moreover, components of the traditional climbing devices described herein can be easily replaced without removing the device from the support structure. Any of the devices (or components) described herein can be added to existing support structures (e.g., climbing walls) without requiring any changes to the existing structure or wall.

In some embodiments, an apparatus includes a frame and an access member. The frame is configured to be mounted to a structural support, and defines a first volume, a second volume, and a longitudinal axis separating the first volume and the second volume. The first volume is configured to receive at least a portion of a first insert, and the second volume is configured to receive at least a portion of a second insert. The frame is configured such that when the first insert is within the first volume and the second insert is within the second volume a first engagement surface of the first insert is facing a second engagement surface of the second insert. The frame includes a first tapered surface that engages a tapered surface of the first insert to limit movement of the first insert along a lateral axis nonparallel to the longitudinal axis. The frame also includes a second tapered surface configured to engage a tapered surface of the second insert to limit movement of the second insert along the lateral axis. The access member is configured to be coupled to the frame covering a portion of the first volume to limit movement of the first insert.

In some embodiments, an apparatus includes a frame and access member. The frame is configured to be mounted to a structural support, and defines a first volume, a second volume, and a longitudinal axis separating the first volume and the second volume. The first volume can receive at least a portion of a first insert, and the second volume can receive at least a portion of a second insert. The frame is configured such that when the first insert is within the first volume and the second insert is within the second volume a first engagement surface of the first insert is facing a second engagement surface of the second insert to define a crevice volume. The crevice volume is a region within which a protective member can be placed such that the protective member engages the first engagement surface and the second engagement surface to limit movement of the protective member along the longitudinal axis. The frame includes a shelf configured to support the first insert and the second insert. The access member is configured to be removably coupled to the frame covering at least a portion of the first volume. The access member limits movement of the first insert when the access member is coupled to the frame. The first insert can be removed from within the first volume when the access member is removed from the frame and the frame is mounted to the structural support.

In some embodiments, an apparatus includes a first insert including a first engagement surface and a first tapered surface. At least a portion of the first insert can be removably disposed within a first volume of frame that is configured to be mounted to a structural support. The frame defines the first volume, a second volume, and a longitudinal axis separating the first volume and the second volume. The second volume is configured to receive at least a portion of a second insert such that when the first insert is within the first volume and the second insert is within the second volume the first engagement surface of the first insert is facing a second engagement surface of the second insert to define a crevice volume within which a protective member can be placed. The first tapered surface is configured to engage a first tapered surface of the frame to limit movement of the first insert along a lateral axis nonparallel to the longitudinal axis.

Methods of installing a simulated traditional climbing device are also described herein. In some embodiments, a method includes coupling a frame to a structural support. The frame defines a first volume, a second volume, and a longitudinal axis separating the first volume and the second volume. After the coupling, a first insert is placed into the first volume and a second insert is placed into the second volume. The first insert includes a first engagement surface. The second insert includes a second engagement surface. The first insert and the second insert are placed such that the first engagement surface is facing the second engagement surface to define a crevice volume within which a protective member can be placed such that the protective member engages the first engagement surface and the second engagement surface to limit movement of the protective member along the longitudinal axis. At least a portion of the first volume is covered with an access member that limits movement of the movement of the first insert.

In some embodiments, a method includes decoupling an access member from about at least a first volume of a frame when the frame is coupled to a structural support. The frame defines the first volume, a second volume, and a longitudinal axis separating the first volume and the second volume. The first volume contains at least a portion of a first insert, and the second volume containing at least a portion of a second insert such that a first engagement surface of the first insert is facing a second engagement surface of the second insert to define a crevice volume within which a protective member can be placed. After the decoupling, the portion of the first insert is removed from within the first volume. After the first insert is removed, at least a portion of a replacement first insert is placed into the first volume. At least the first volume is covered with the access member, which limits movement of the replacement first insert.

As used herein, the term "about" when used in connection with a referenced numeric indication means the referenced numeric indication plus or minus up to 10% of that referenced numeric indication. For example, the language "about 50" covers the range of 45 to 55. Similarly, the language "about 5" covers the range of 4.5 to 5.5.

As used in this specification and the appended claims, the words "upward" and "downward" refer to a direction opposite the force of gravity and in the same direction as the force of gravity, respectively. Thus, for example, the end of a simulated traditional climbing device that facing opposite the direction of gravity would be the upward (or upper) end of the device, while the end opposite the upward end would be the downward (or lower) end of the device.

Further, specific words chosen to describe one or more embodiments and optional elements or features are not intended to limit the invention. For example, spatially relative terms—such as "upward", "downward", "beneath", "below", "lower", "above", "upper", "proximal", "distal", and the like—may be used to describe the relationship of one element or feature to another element or feature as illustrated in the figures. These spatially relative terms are intended to encompass different positions (i.e., translational placements) and orientations (i.e., rotational placements) of a device in use or operation in addition to the position and orientation shown in the figures. For example, if a device in the figures is turned over, elements described as "below" or "beneath" other elements or features would then be "above" or "over" the other elements or features. Thus, the term "below" can encompass both positions and orientations of above and below. A device may be otherwise oriented (e.g., rotated 90 degrees or at other orientations) and the spatially relative descriptors used herein interpreted accordingly. Likewise, descriptions of movement along (translation) and around (rotation) various axes includes various spatial device positions and orientations. The combination of a body's position and orientation define the body's pose.

Similarly, geometric terms, such as "parallel", "perpendicular", "round", or "square", are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

In addition, the singular forms "a", "an", and "the" are intended to include the plural forms as well, unless the context indicates otherwise. The terms "comprises", "includes", "has", and the like specify the presence of stated features, steps, operations, elements, components, etc. but do not preclude the presence or addition of one or more other features, steps, operations, elements, components, or groups.

Figure 2:
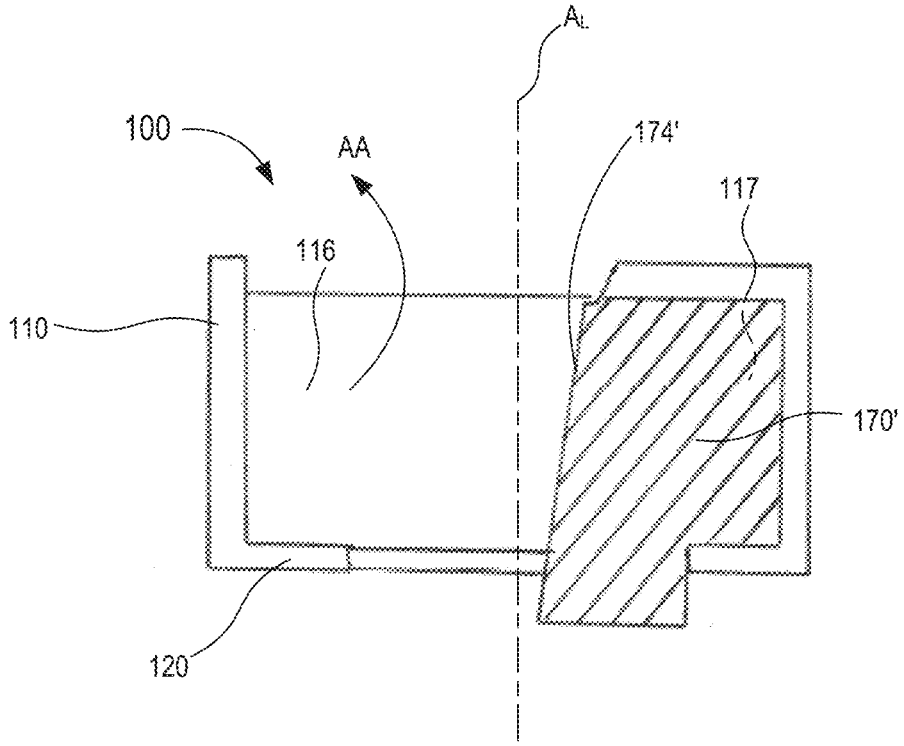
Figure 3:
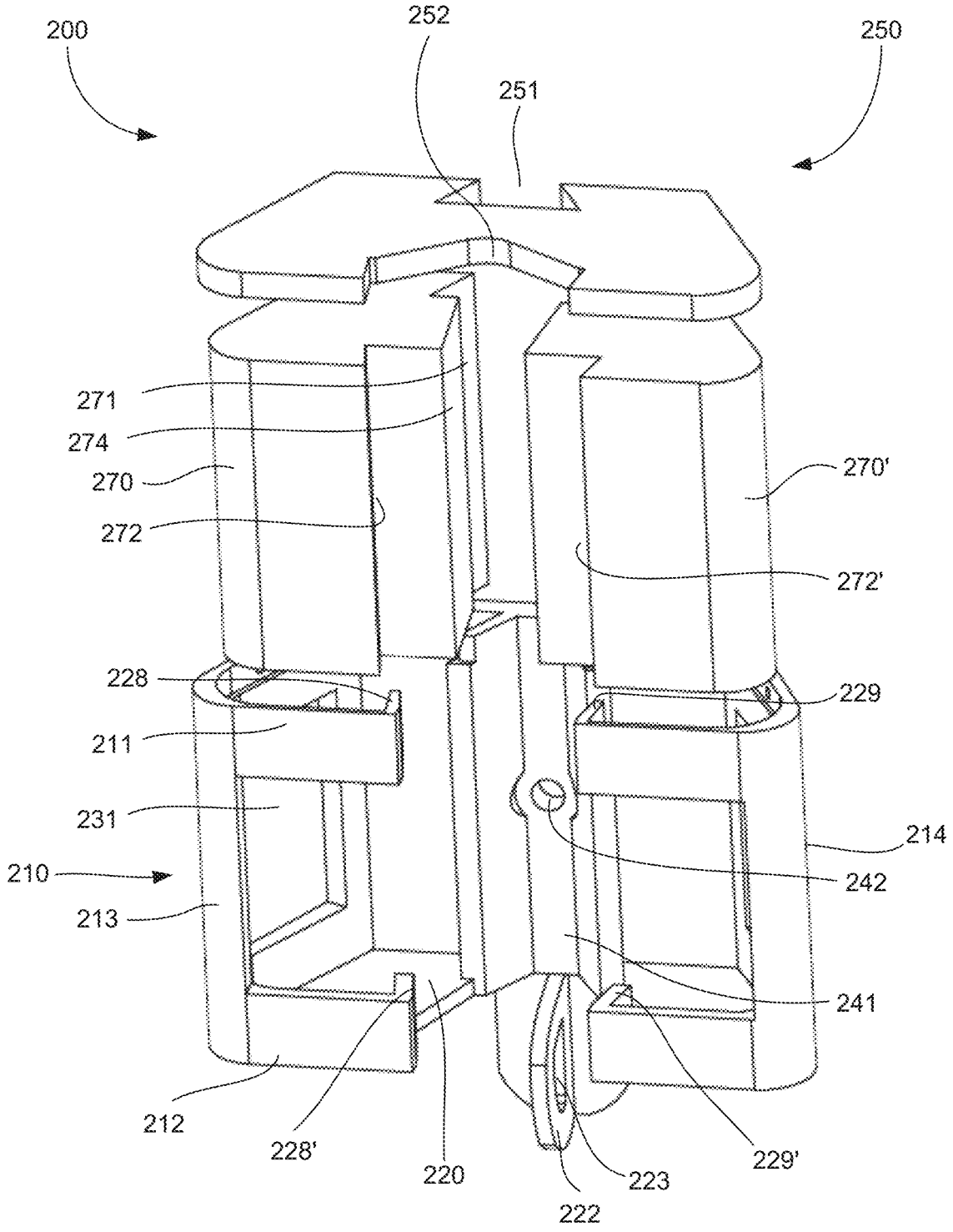
FIG. 3 is a perspective exploded view of a simulated traditional climbing device, according to an embodiment.

FIGS. 1 and 2 are schematic illustrations of a simulated traditional climbing device 100, according to an embodiment. The simulated traditional climbing device 100 includes a frame 110 (also referred to as a cage), an access member 150, a first insert 170, and a second insert 170' (also referred to as stones, rocks, or bulk insert material). The simulated traditional climbing device 100, and any of the simulated traditional climbing devices or components therein that are described herein can be used in any suitable application. Such applications include, for example, training on traditional climbing procedures (either in an indoor facility or an outdoor facility), testing of equipment (e.g., testing the support capability of safety equipment), or the like. Specifically, as shown in FIG. 1, the simulated traditional climbing device 100 can simulate a rock face or crevice within which a protective member 193 (also referred to as protective gear or simply "gear") can be placed. The protective gear 193 can be attached to any suitable line 191 (e.g., rope, cable, or the like). In this manner, the simulated traditional climbing device 100 (and any of the devices described herein) can be used to evaluate placement of the protective gear 193, to practice placing the protective gear 193, or the like. As described herein, the simulated traditional climbing device 100 and any of the devices described herein can be used in conjunction with any suitable type of protective gear, such as active gear (e.g., spring-loaded cams, triggerable/expandable devices, or the like) or passive gear (e.g., wedges, cams, or the like). Moreover, the simulated traditional climbing device 100 and any of the simulated traditional climbing devices or components therein that are described herein can be coupled or mounted to any suitable support structure (not shown in FIGS. 1 and 2). Such structures include, for example, an artificial rock wall, a steel structure, a test fixture, or the like. Accordingly, the frame 110 (and any of the frames described herein) can include any suitable mounting features, including flanges with bolt holes, roughened surfaces to grip wall board, or the like.

The frame 110 defines a first volume 116, a second volume 117, and a longitudinal axis $A_L$. The longitudinal axis $A_L$ separates the first volume and the second volume, and in some embodiments, can be coincident with an axis of symmetry (or center line) of the frame. The first volume 116 can receive at least a portion of the first insert 170, and the second volume 117 can receive at least a portion of a second insert 170'. As shown in FIG. 1, the frame 110 is configured such that when the first insert 170 is within the first volume 116 and the second insert 170' is within the second volume 117, a first engagement surface 174 of the first insert 170 is facing a second engagement surface 174' of the second insert 170'. In this manner, when the device 100 is in the first configuration (i.e., the installed configuration, as shown in FIG. 1), the position of the first insert 170 and the second insert 170' within the frame 110 defines a crevice volume 176 within which the protective member 193 can be placed.

Although the first volume 116 and the second volume 117 are shown as being symmetrical about the longitudinal axis $A_L$, in other embodiments, the first volume 116 and the second volume 117 need not be symmetrical about each other. Moreover, in some embodiments, the first volume 116 and the second volume 117 (and any of the volumes defined by any of the frames described herein) can have different sizes and/or orientations relative to each other. The first volume 116 and the second volume 117 can also be bounded by different structure. For example, as shown in FIG. 1, the second volume 117 is bounded at the top (or upward facing end, as shown by the arrow in FIG. 1) by a portion of the frame 110. In contrast, the first volume 116 is bounded at the top (or upward facing end) by the access member 150, as described below.

The frame 110 includes a shelf 120 configured to support and/or engage at least the first insert 170. The shelf 120 can be any shoulder, ledge, protrusion or similar structure that limits the downward (as shown by the arrow in FIG. 1) movement of the first insert 170 and/or the second insert 170'. More particularly, the shelf 120 can be any shoulder, ledge, protrusion or similar structure that limits the movement of the first insert 170 and/or the second insert 170' along the longitudinal axis $A_L$ in the downward direction. Moreover, the shelf 120 can be any structure that supports at least a portion of the downward force exerted by the first insert 170 and/or the second insert 170' onto the frame 110. Such downward forces can result from, for example, the weight of the first insert 170 and/or the second insert 170', downward forces applied by the protective gear 193 and/or safety line 191 against the first insert 170 and/or the second insert 170', or the like.

Although the frame 110 is shown and described as including the shelf 120 that limits the downward movement of the first insert 170 and/or the second insert 170', in other embodiments, the frame 110 and any of the frames shown and described herein can include any suitable ledge, shoulder, shelf, or tapered surface that engages the first insert 170 and/or the second insert 170' to limit movement of the first insert 170 and/or the second insert 170' along an axis that is nonparallel to the longitudinal axis $A_L$. For example, in some embodiments, the frame 110 can include a tapered surface that limits horizontal movement (i.e., movement along an axis normal to the longitudinal axis $A_L$) of the first insert 170 and/or the second insert 170'. In this manner, for example, the distance D between the first engagement surface 174 and the second engagement surface 174' at a location along the longitudinal axis $A_L$ can be maintained at a constant value when the device 100 is in use. Similarly stated, by limiting horizontal movement of the engagement surface 174 relative to the second engagement surface 174' the "crevice distance" D can be fixed. In other embodiments, however, the frame 110 (and any of the frames described herein) can be configured to allow for a controlled amount of horizontal movement of the first insert 170 and/or the second insert 170' to simulate movement of rocks in an actual traditional climbing environment.

The frame 110 can be constructed in any suitable manner and from any suitable materials. For example, in some embodiments, the frame 110 (and any of the frames disclosed herein) can be monolithically constructed. In other embodiments, the frame 110 (and any of the frames disclosed herein) can be constructed from multiple components (e.g. the shelf, the main body, etc.) that are later joined together (e.g., via welding, mechanical fasteners or the like). In some embodiments, the frame 110 (and any of the frames disclosed herein) can be constructed from a high strength alloy, such as stainless steel, structural steel, titanium alloys, and aluminum alloys (e.g., T6061, Al 2024, 7075-T6 SN), or any other suitable allow that can maintain the desired shape under the loads described herein. In other embodiments, the frame 110 (and any of the frames disclosed herein) can be constructed from a composite material, such as, for example, a carbon fiber-based material. Such composite materials can also include wood, a resin, graphine, meal matrix, fiberglass, fiber reinforced plastics, or the like. In yet other embodiments, the frame 110 (and any of the frames described herein) can be constructed from a polymer (either constructed solely from a polymer, or constructed from a composite material including polymeric constituents). Such polymers include high grade plastics (Ultem 9085) or other thermoplastics.

The access member 150 is removably coupled to the frame 110 such that the access member 150 covers at least a portion of the first volume 116. In this manner, the access member 150 can limit movement of the first insert 170 when the access member 150 is coupled to the frame 110, as shown in FIG. 1. The access member 150 can be any cover, plate, or similar structure that maintains at least the first insert 170 within the first volume 116, and/or that limits the upward (as shown by the arrow in FIG. 1) movement of the first insert 170. More particularly, the access member 150 can limit the movement of the first insert 170 along the longitudinal axis $A_L$ in the upward direction. Although shown as covering only the first volume 116, in other embodiments, the access member 150 (and any of the access members described herein) can also cover at least a portion of the second volume 117. Thus, in such embodiments, the access member 150 can limit the movement of the first insert 170 and/or the second insert 170' along the longitudinal axis $A_L$ in the upward direction. In yet other embodiments, the access member 150 (and any of the access members described herein) can be spaced apart from (i.e., not cover) the first volume 116, and can cover only a portion of the second volume 117.

The access member 150 can be coupled to the frame 110 in any suitable manner that allows the access member 150 to be removed from about the first volume 116 and/or the second volume 117. For example, in some embodiments, the access member 150 can be coupled to the frame 110 via mechanical fasteners (e.g., bolts, capscrews, or the like). In other embodiments, the access member 150 can be coupled to the access member 150 using hinges, straps, or other fasteners. In this manner, the simulated traditional climbing device 100 can be moved from the first configuration (FIG. 1) to the second configuration (FIG. 2). When the simulated traditional climbing device 100 is in the second configuration, the first insert 170 can be removed from the first volume 116, as shown by the arrow AA in FIG. 2. Moreover, the first insert 170 can be removed from the first volume 116 when the frame 110 is remains mounted to the structural support (not shown in FIG. 2). In this manner, the first insert 170 can be removed and/or replaced within the frame 110 without disrupting the coupling between the frame 110 and the structural support. This modular arrangement allows for different types of inserts to be used in conjunction with the frame 110 to simulate different crevice distances D (e.g., wider or narrower crevices), different crevice geometry (degrees of taper, etc.), different types of rock (e.g., different smoothness or surface features), or the like. This modular arrangement also allows the insert 170 to be replaced if defective, worn, or otherwise at the end of its service life.

Although the access member 150 is shown and described as providing access to the first insert 170, in some embodiments, the second insert 170' can also be removed and/or replaced when the access member 150 is removed from about the first volume 116 and/or the second volume 117.

Either the first insert 170, the second insert 170', or both inserts can include any suitable features to facilitate removal and replacement, as described above, as well to define the crevice volume 176, as described above. For example, in some embodiments, the first insert 170, the second insert 170', and/or any of the inserts described herein can include an engagement surface configured to engage the shelf 120 or any other structure of the frame. For example, in some embodiments, the first insert 170, the second insert 170', and/or any of the inserts described herein can include a tapered surface that corresponds to a tapered surface of the frame 110 to limit movement of the first insert 170 and/or the second insert 170' along an axis that is nonparallel to the longitudinal axis $A_L$. For example, in some embodiments, the first insert 170, the second insert 170', and/or any of the inserts described herein can include a tapered surface that limits horizontal movement (i.e., movement along an axis normal to the longitudinal axis $A_L$) of the first insert 170 and/or the second insert 170'. In other embodiments, the first insert 170, the second insert 170', and/or any of the inserts described herein can include an engagement surface that corresponds to a surface of the access member 150 to limit movement of the first insert 170 and/or the second insert 170' within the frame 100 (when the access member 150 is coupled to the frame 110).

Either the first insert 170, the second insert 170', or both inserts can be constructed from any suitable material. For example, in some embodiments, the first insert 170, the second insert 170', and/or any of the inserts described herein can be constructed from a rock-like material. Such materials can include, for example, resins (polyester, polyethylene, wood, concrete, pre-fab-concrete, reinforced concrete) or stone (including granite, sandstone, quartizite, or the like). The first insert 170, the second insert 170', and/or any of the inserts described herein can be constructed by any suitable process, including molding, CNC machining, laser cutting, stone cutting, 3D printing, or the like. Moreover, in some embodiments, the first engagement surface 174 or the second engagement surface 174' (or any of the engagement surfaces described herein) can have any suitable surface finish characteristics to simulate actual rocks. In yet other embodiments, the first engagement surface 174 or the second engagement surface 174' (or any of the engagement surfaces described herein) can include a textured portion to increase the friction between the engagement surface and the protective gear 193. In some embodiments, the first engagement surface 174 or the second engagement surface 174' (or any of the engagement surfaces described herein) can include barbs, contours or other geometric features to increase contact (or friction) between the engagement surface and the protective gear 193.

In use, the simulated traditional climbing device 100 can be used in conjunction with any suitable type of protective gear 193 and/or safety line 191 to simulate a traditional climbing environment. As shown, the protective gear 193 can be wedged and/or secured within the crevice volume 176. Specifically, the protective gear 193 can be placed such it is in contact with the first engagement surface 174 and the second engagement surface 174'. In this manner, downward forces exerted on the safety line 191 and/or the protective gear 193 can be transferred via the first insert 170 and the second insert 170' to the frame 110. Moreover, the first engagement surface 174 and the second engagement surface 174' collectively limit movement of the protective gear 193 in the downward direction.

In addition to producing a simulated rock crevice, in some embodiments, the frame 110 (and any of the frames described herein) can include an anchor (not shown) to allow a climber to attach sport gear (not shown) to provide safety until the traditional gear 193 is placed within the crevice volume 176. The anchor can be, for example, a ring, a loop, an eyelet or any other structure to which a safety link (e.g., a carabiner) can be removably coupled.

FIGS. 3-11 show various views of a simulated traditional climbing device 200, according to an embodiment. The simulated traditional climbing device 200 includes a frame 210 (also referred to as a cage), an access member 250, a first insert 270, and a second insert 270' (also referred to as stones, rocks, or bulk insert material). The simulated traditional climbing device 200, and any of the simulated traditional climbing devices or components therein that are described herein can be used in any suitable application. Such applications include, for example, training on traditional climbing procedures (either in an indoor facility or an outdoor facility), testing of equipment (e.g., testing the support capability of safety equipment), or the like. Specifically, the simulated traditional climbing device 200 can simulate a rock face or crevice within which a protective member (not shown, but similar to any protective member described herein) can be placed. The simulated traditional climbing device 200 and any of the simulated traditional climbing devices or components therein that are described herein can be coupled or mounted to any suitable support structure (not shown), such as, for example, an artificial rock wall, a steel structure, a test fixture, or the like.

Figure 4:
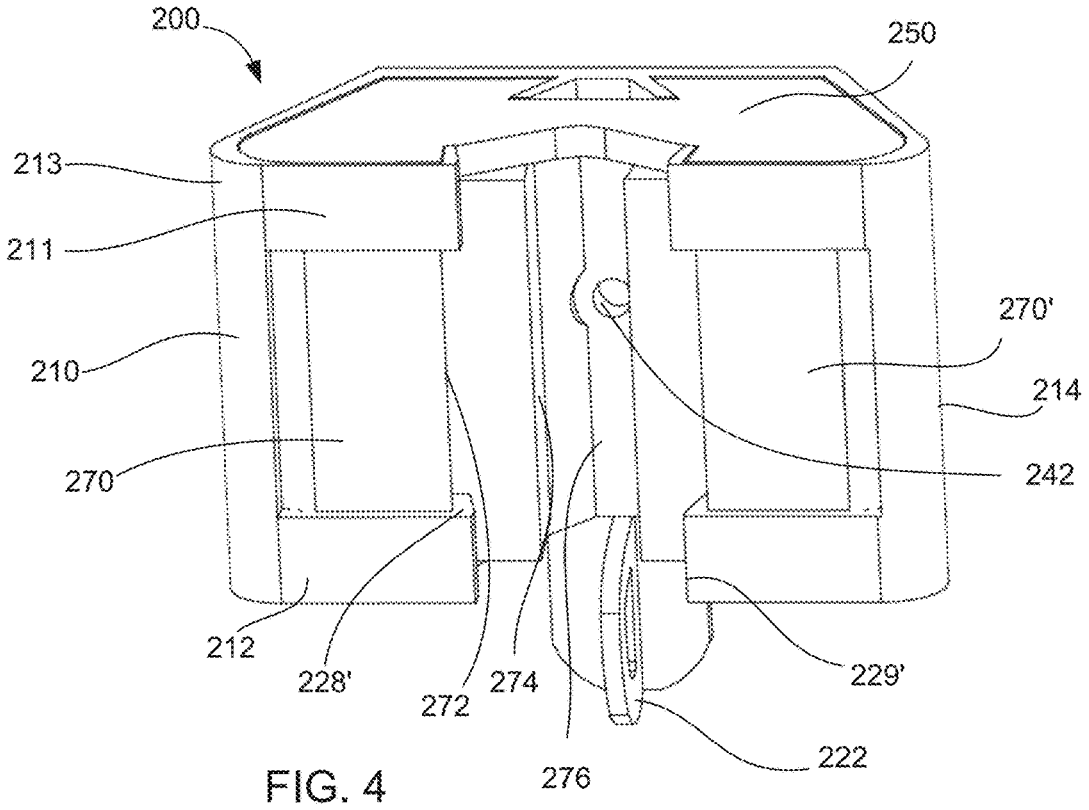
FIG. 4 is a perspective view of the simulated traditional climbing device shown in FIG. 3.
Figure 5:
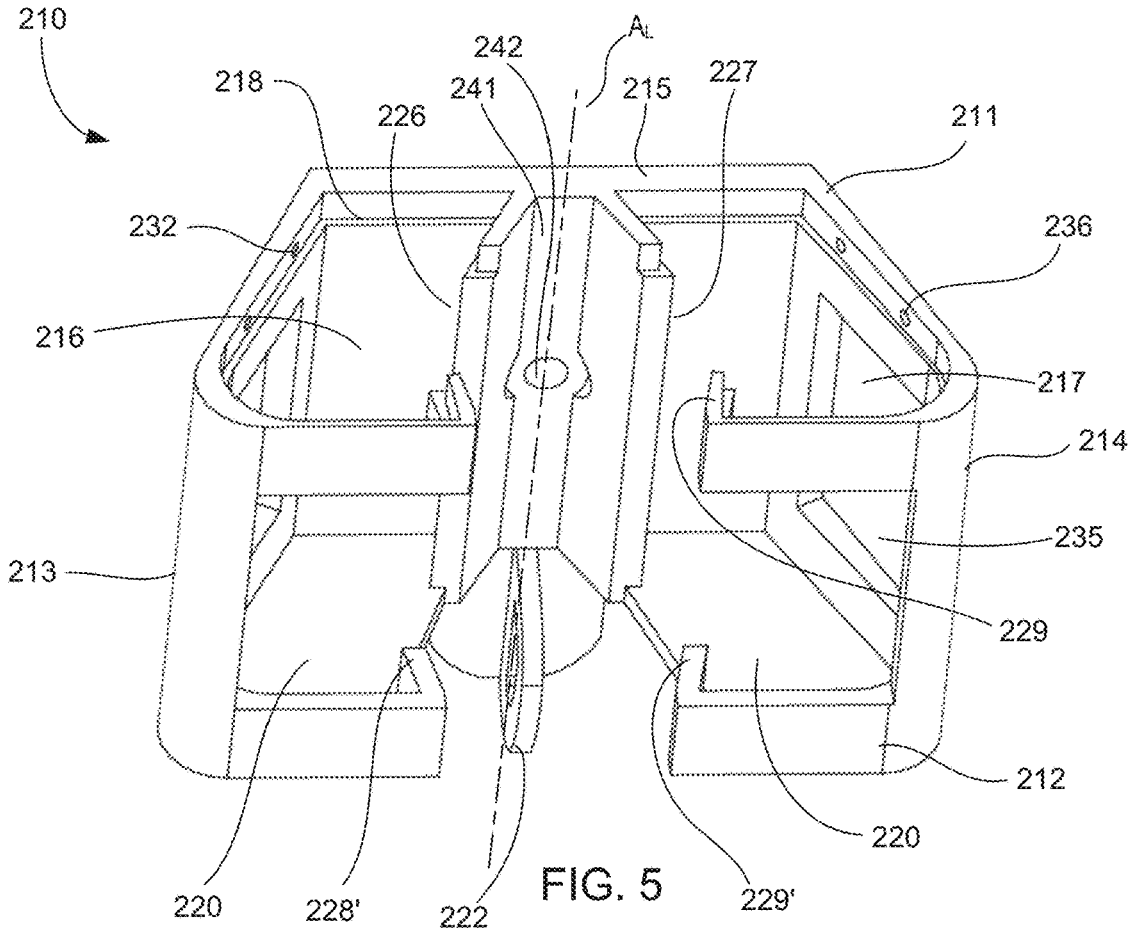
FIGS. 5-7 are a front perspective view, a top view, and a side perspective view, respectively, of a frame of the simulated traditional climbing device shown in FIGS. 3 and 4.
Figure 6:
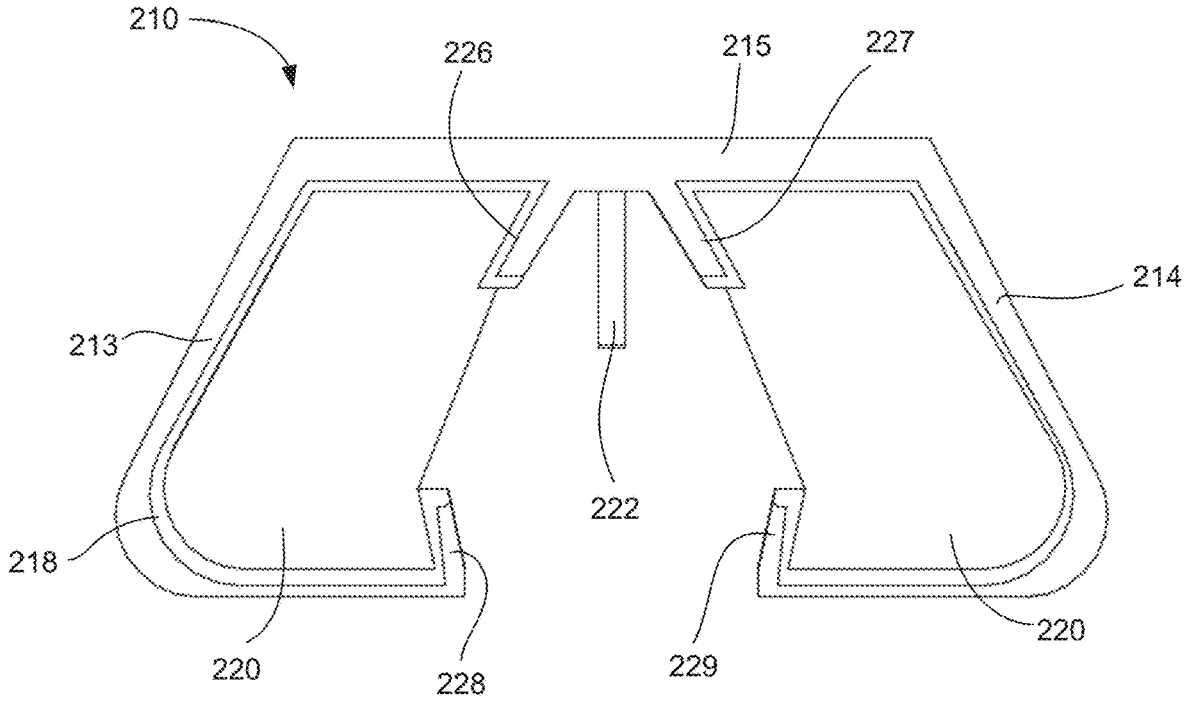
Figure 7:
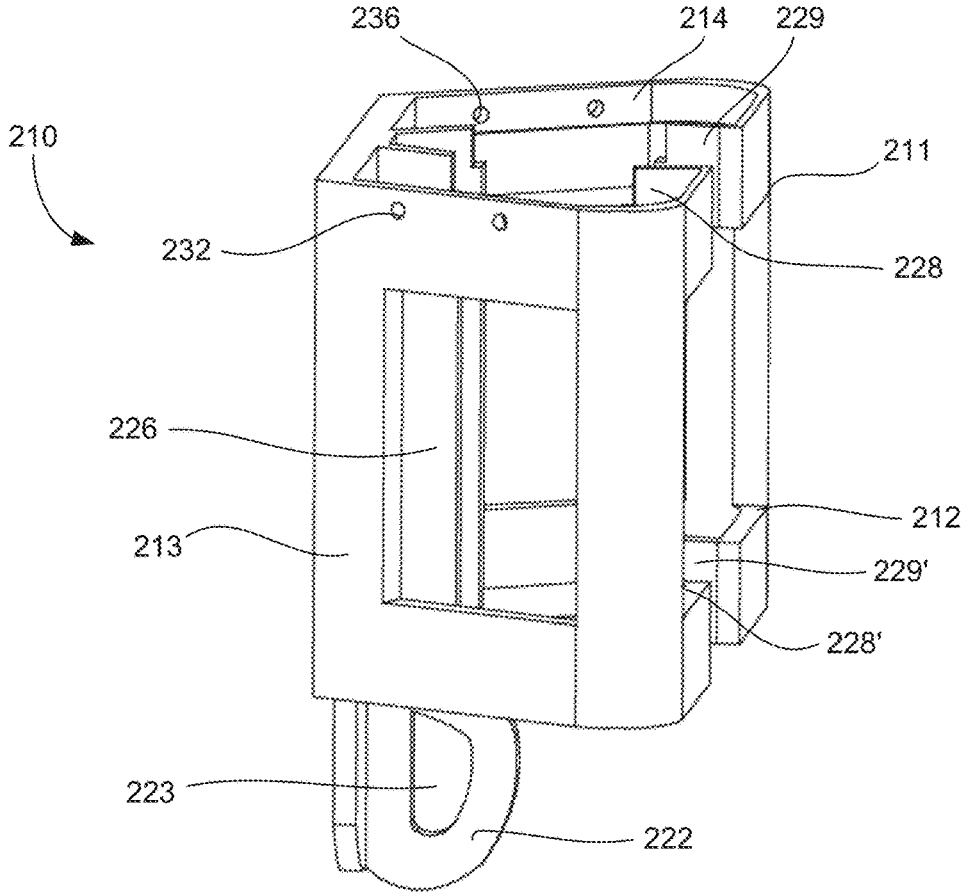

The frame 210 includes a top (or upper) portion 211, a bottom (or lower) portion 212, a first side 213, a second side 214, and a back portion 215. As described herein, the back portion 215 is the portion of the frame 210 that is coupled to the support structure, and extends between the first side 213 and the second side 214. Referring to FIG. 5, the frame 210 defines a first volume 216, a second volume 217, and a longitudinal axis $A_L$. The longitudinal axis $A_L$ separates the first volume and the second volume, and in some embodiments, can be coincident with an axis of symmetry (or center line) of the frame. The first volume 216 can receive at least a portion of the first insert 270, and the second volume 217 can receive at least a portion of a second insert 270'. As shown in FIG. 4, the frame 210 is configured such that when the first insert 270 is within the first volume 216 and the second insert 270' is within the second volume 217, a first engagement surface 274 of the first insert 270 is facing a second engagement surface 274' of the second insert 270'. In this manner, when the device 200 is in the first configuration (i.e., the installed configuration, as shown in FIG. 4), the position of the first insert 270 and the second insert 270' within the frame 210 defines a crevice volume 276 within which a protective member can be placed.

Although the first volume 216 and the second volume 217 are shown as being symmetrical about the longitudinal axis $A_L$, in other embodiments, the first volume 216 and the second volume 217 need not be symmetrical about each other. Moreover, in some embodiments, the first volume 216 and the second volume 217 (and any of the volumes defined by any of the frames described herein) can have different sizes and/or orientations relative to each other.

The back portion 215 of the frame includes a first tapered surface 226 and a second tapered surface 227, and defines a channel 241 between the first tapered surface 226 and the second tapered surface 227. The back portion 215 also defines a mounting hole 242 within the channel 241 that is located along the longitudinal axis $A_L$. The mounting hole 242 can receive a fastener (e.g., a bolt or capscrew; not shown) to secure the frame 210 to the support structure (not shown). Moreover, the region of the back portion 215 surrounding the mounting hole can be shaped and/or contoured (e.g., via a countersink) to receive a washer, grommet or any other suitable structure to distribute the load from the fastener that is applied to the frame 210.

The first tapered surface 226 is configured to engage a tapered surface 271 of the first insert 270 to limit movement of the first insert 270 along a lateral axis that is nonparallel to the longitudinal axis $A_L$. For example, in some embodiments, the first tapered surface 226 and the corresponding tapered surface 271 of the first insert 270 can limit horizontal movement (i.e., movement along an axis normal to the longitudinal axis $A_L$) of the first insert 270 within the frame 210. In this manner, the distance between a first engagement surface 274 and a second engagement surface 274' can be maintained at a constant value when the device 200 is in use. Similarly stated, by limiting horizontal movement of the engagement surface 274 relative to the second engagement surface 274' the "crevice distance" can be fixed. As shown, the first tapered surface 226 extends substantially the length of the frame 210 along the longitudinal axis $A_L$. Similarly stated, the first tapered surface 226 is included on a protrusion that extends from the top portion 211 to the bottom portion 212. In this manner, the first tapered surface 226 continuously engages the tapered surface 271 of the first insert 270 along the longitudinal axis $A_L$.

The second tapered surface 227 is configured to engage a tapered surface 271' of the second insert 270' to limit movement of the second insert 270' along a lateral axis that is nonparallel to the longitudinal axis $A_L$. For example, in some embodiments, the second tapered surface 227 and the corresponding tapered surface 271' of the second insert 270' can limit horizontal movement (i.e., movement along an axis normal to the longitudinal axis $A_L$) of the second insert 270' within the frame 210. In this manner, the distance between the first engagement surface 274 and the second engagement surface 274' can be maintained at a constant value when the device 200 is in use. Similarly stated, by limiting horizontal movement of the engagement surface 274 relative to the second engagement surface 274' the "crevice distance" can be fixed. The second tapered surface 227 extends substantially the length of the frame 210 along the longitudinal axis $A_L$. Similarly stated, the second tapered surface 227 is included on a protrusion that extends from the top portion 211 to the bottom portion 212. In this manner, the second tapered surface 227 continuously engages the tapered surface 271' of the second insert 270' along the longitudinal axis $A_L$.

The first tapered surface 226 and the second tapered surface 227 can have any suitable taper angle. For example, although the first tapered surface 226 and the second tapered surface 227 are each shown as defining an acute angle with respect to the back surface of the frame 210 that defines the first volume 216, in other embodiments, the first tapered surface 226 and the second tapered surface 227 can form any suitable angle. Moreover, although the first tapered surface 226 and the second tapered surface 227 are shown as being tapered only in a plane normal to the longitudinal axis $A_L$ (see the top view in FIG. 6), in other embodiments, either (or both) of the first tapered surface 226 and the second tapered surface 227 can be tapered in any number of planes. For example, in some embodiments, the protrusion or first tapered surface 226 can taper inwardly within the first volume 216. In other words, the protrusion or first tapered surface 226 can be tapered in a plane parallel to the longitudinal axis $A_L$. Similarly, in some embodiments, the protrusion or second tapered surface 227 can taper inwardly within the second volume 217. In other words, the protrusion or second tapered surface 227 can be tapered in a plane parallel to the longitudinal axis $A_L$.

The frame 210 includes two retention protrusions 228, 228' that engage and/or contact the first insert 270. Specifically, the two retention protrusions 228, 228' engage the retention surface 272 of the first insert 270 (see FIGS. 8 and 9). In this manner, the two retention protrusions 228, 228' can also guide the first insert 270 during installation and/or removal from the frame 210, and can also limit movement of the first insert 270 within the first volume 216. The frame 210 also includes two retention protrusions 229, 229' that engage and/or contact the second insert 270'. Specifically, the two retention protrusions 229, 229' engage the retention surface 272' of the second insert 270' (see FIGS. 8 and 9). In this manner, the two retention protrusions 229, 229' can also guide the second insert 270' during installation and/or removal from the frame 210, and can also limit movement of the second insert 270' within the second volume 217.

The bottom portion 212 of the frame 210 includes a shelf 220 and an anchor 222. The shelf 220 is configured to support and/or engage the first insert 270 and the second insert 270'. The shelf 220 can be any shoulder, ledge, protrusion or similar structure that limits the downward movement of the first insert 270 and/or the second insert 270'. More particularly, the shelf 220 can be any shoulder, ledge, protrusion or similar structure that limits the movement of the first insert 270 and/or the second insert 270' along the longitudinal axis $A_L$ in the downward direction. Moreover, the shelf 220 can be any structure that supports at least a portion of the downward force exerted by the first insert 270 and/or the second insert 270' onto the frame 210. Such downward forces can result from, for example, the weight of the first insert 270 and/or the second insert 270', downward forces applied by the protective gear against the first insert 270 and/or the second insert 270', or the like.

Although the shelf 220 is shown as being substantially normal to the longitudinal axis $A_L$. In other embodiments, the shelf 220 can be angled with respect to the longitudinal axis $A_L$ (i.e., at an angle greater than zero degrees and less than 180 degrees). Similarly stated, in other embodiments, the shelf 220 can be tapered with respect to the longitudinal axis $A_L$.

The anchor 222 extends below the shelf 220 and defines an opening 223 and a loop to which a safety link (e.g., a carabiner, not shown) can be removably coupled. In this manner, the frame 210 can also provide an anchor point to allow a climber to attach sport gear (not shown) to provide safety until the traditional gear is placed within the crevice volume 276. The anchor 222 is aligned with the longitudinal axis $A_L$ and/or the mounting hole 242. In this manner, any downward force applied to the anchor 222 will not produce a moment about the mounting bolt (not shown). In other embodiments, however, the anchor 222 can be offset from longitudinal axis $A_L$. In yet other embodiments, the frame 210 (and any of the frames described herein) can be devoid of a fixed anchor.

The top portion 211 of the frame includes a shoulder 218 upon which the access member 250 is mounted. The shoulder 218 is recessed from the upper-most surface of the frame 210 and allows the access member 250 to be matingly received within the top portion 211 of the frame 210. The top portion 211 also defines an opening into the first volume 216 and the second volume 217. Thus, when the access member 250 is removed from the frame 210 the first insert 270 and the second insert 270' can be removed from the first volume 216 and the second volume 217, respectively, via the opening.

The first side 213 of the frame 210 defines an opening 231 that provides access to the first insert 270. Although the first insert 270 is not inserted into and/or removed from the first volume 216 via the opening 231, in other embodiments, the first insert 270 can be removed via a side opening. Similarly, the second side 214 of the frame 210 defines an opening 235 that provides access to the second insert 270'. Although the second insert 270' is not inserted into and/or removed from the second volume 217 via the opening 235, in other embodiments, the second insert 270' can be removed via a side opening. The side openings 231, 235 can provide access to the first insert 270 and the second insert 270', respectively, to allow viewing of identification marks (e.g., indications of the surface features, type of rock, service date, or the like). The first side 213 and the second side 214 each define a series of bolt holes 232, 236, respectively, that are used to couple the access member 250 to the frame 210.

Figure 10:
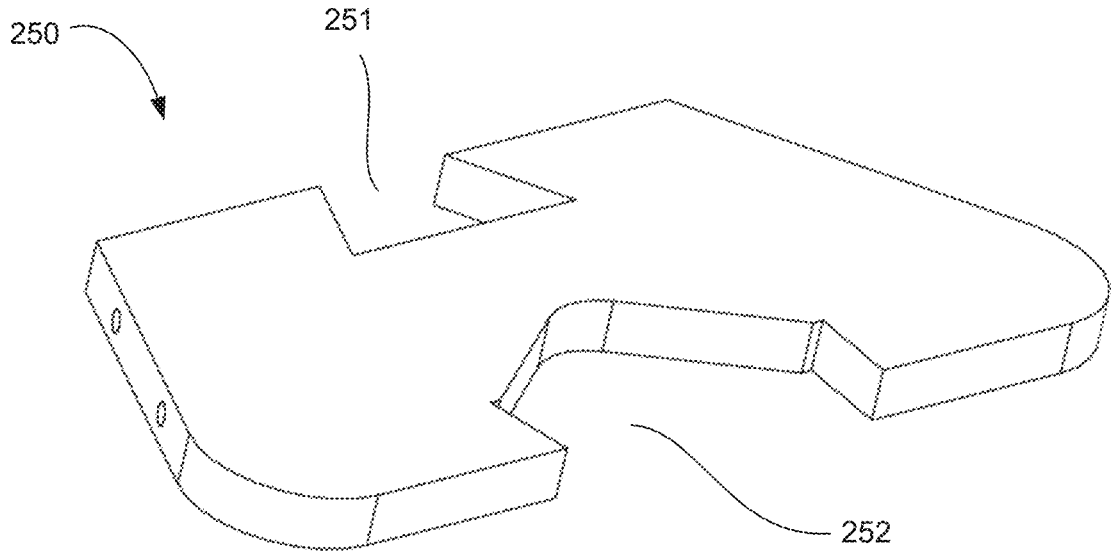
FIGS. 10 and 11 are a front perspective view and a top view, respectively, of an access member of the simulated traditional climbing device shown in FIGS. 3 and 4.
Figure 11:
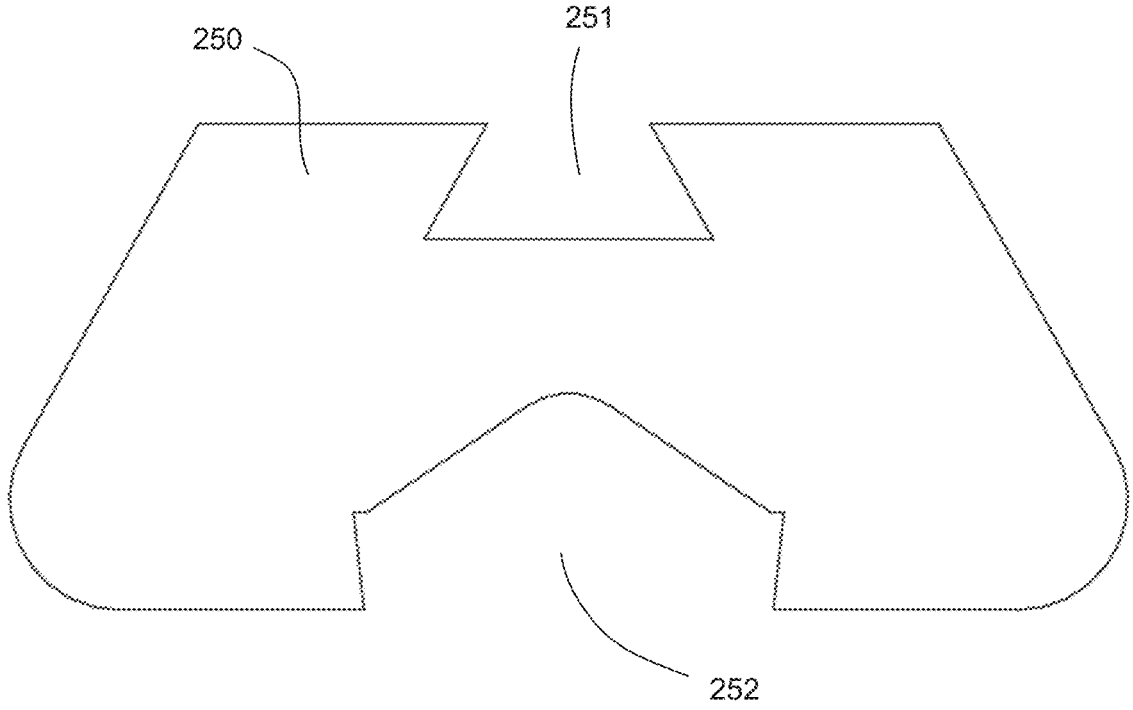

The access member 250 is removably coupled to the frame 210 such that the access member 250 covers at least a portion of the first volume 216 and the second volume 217. In this manner, the access member 250 can limit movement of the first insert 270 and the second insert 270' when the access member 250 is coupled to the frame 210. The access member 250 can be any cover, plate, or similar structure that maintains at least the first insert 270 within the first volume 216 and the second insert 270' within the second volume 217. The access member 250 can limit the movement of the first insert 270 and the second insert 270' along the longitudinal axis $A_L$ in the upward direction. As shown in FIGS. 10 and 11, the access member 250 defines a notch 251 and a front opening 252. The notch is sized and shaped to correspond to and/or be matingly engaged with the first tapered surface 226 and the second tapered surface 227. The opening 252 provides access to the first engagement surface 274 and the second engagement surface 274'. Thus, the opening 252 is sized and positioned to allow a user to place protective gear into the crevice volume 276 in a downward direction (i.e., from a position above the frame 210).

The access member 250 can be coupled to the frame 210 by a series of mechanical fasteners (e.g., bolts, capscrews, or the like, not shown). In other embodiments, however, the access member 250 can be coupled to the access member 250 using hinges, straps, or other fasteners. In this manner, the first insert 270 can be removed from the first volume 216, and the second insert 270' can be removed from the second volume 217. Moreover, the first insert 270 and/or the second insert 270' can be removed from the frame 210 when the frame 210 is remains mounted to the structural support (not shown). In this manner, the first insert 270 and/or the second insert 270' can be removed and/or replaced within the frame 210 without disrupting the coupling between the frame 210 and the structural support. This modular arrangement allows for different types of inserts to be used in conjunction with the frame 210 to simulate different crevice distances (e.g., wider or narrower crevices), different crevice geometry (degrees of taper, etc.), different types of rock (e.g., different smoothness or surface features), or the like. This modular arrangement also allows the first insert 270 and/or the second insert 270' to be replaced if defective, worn, or otherwise at the end of its service life.

Figure 8:
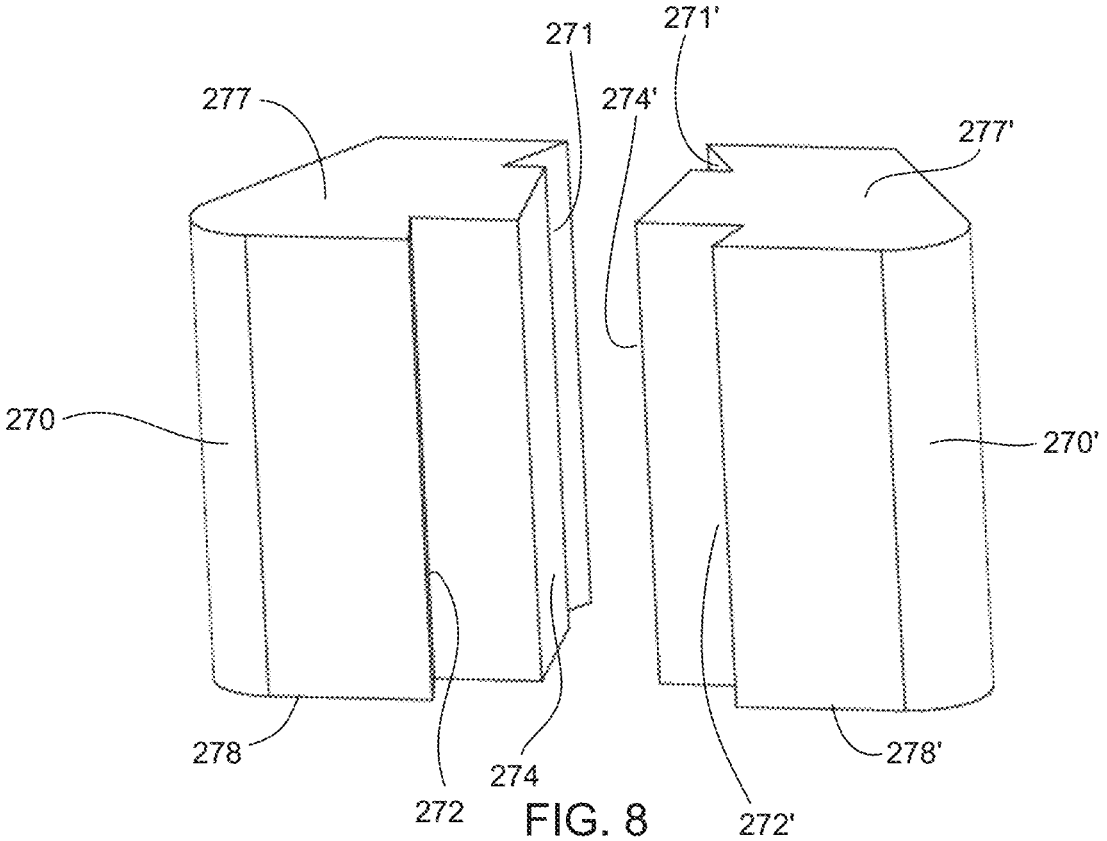
FIGS. 8 and 9 are a front perspective view and a top view, respectively, of the inserts of the simulated traditional climbing device shown in FIGS. 3 and 4.
Figure 9:
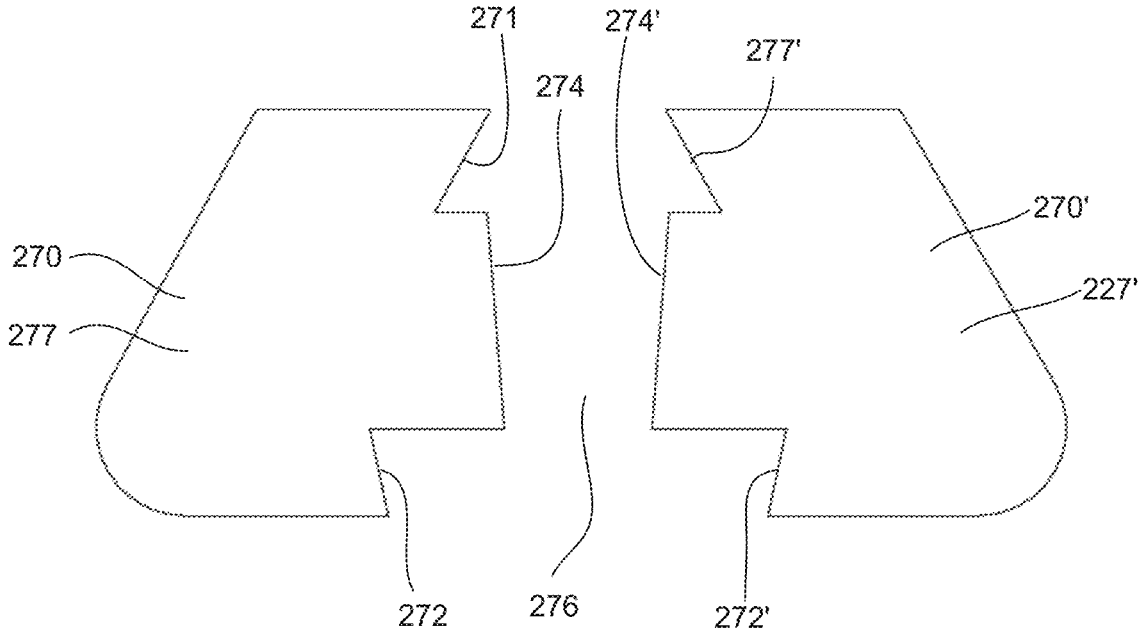

Referring to FIGS. 8 and 9, the first insert 270 includes a top surface 277, a bottom surface 278, a retention surface 272, a rear tapered surface 271, and an engagement surface 274. The top surface 277 is configured to be covered (and/or engage) the access member 250. In this manner, the access member 250 can limit upward movement of the first insert 270, for example, when a piece of protective gear is being pulled upward during removal. The bottom surface 278 engages and/or is supported by the shelf 220. In some embodiments, the bottom surface 278 can be shaped to correspond to the shelf 220. In this manner, the bottom surface 278 can mate with the shelf 220. As described above, the retention surface 272 engages the two retention protrusions 228, 228'. In this manner, retention surface 272 and the two retention protrusions 228, 228' can guide the first insert 270 during installation and/or removal from the frame 210, and can also limit movement of the first insert 270 within the first volume 216. The rear tapered surface 271 engages the first tapered surface 226 of the frame 210 to limit movement of the first insert 270 along a lateral axis that is nonparallel to the longitudinal axis $A_L$, as described above.

The second insert 270' is symmetrical to the first insert 270. The second insert 270' includes a top surface 277', a bottom surface 278', a retention surface 272', a rear tapered surface 271', and an engagement surface 274'. The top surface 277' is configured to be covered (and/or engage) the access member 250. In this manner, the access member 250 can limit upward movement of the second insert 270', for example, when a piece of protective gear is being pulled upward during removal. The bottom surface 278' engages and/or is supported by the shelf 220. In some embodiments, the bottom surface 278' can be shaped to correspond to the shelf 220. In this manner, the bottom surface 278' can mate with the shelf 220. As described above, the retention surface 272' engages the two retention protrusions 229, 229'. In this manner, retention surface 272' and the two retention protrusions 22', 22" can guide the second insert 270' during installation and/or removal from the frame 210, and can also limit movement of the second insert 270' within the second volume 217. The rear tapered surface 271' engages the second tapered surface 227 of the frame 210 to limit movement of the second insert 270' along a lateral axis that is nonparallel to the longitudinal axis $A_L$, as described above.

The first engagement surface 274 and/or the second engagement surface 274' can have any shape and/or surface characteristics to simulate an actual rock crevice. For example, although the first engagement surface 274 and the second engagement surface 274' are shown as being linear, in other embodiments, the first engagement surface 274 and/or the second engagement surface 274' can be curved, can have multiple discontinuous surfaces, or any other suitable shape. Moreover, the first engagement surface 274 and/or the second engagement surface 274' can have any surface roughness and/or texture.

In use, the simulated traditional climbing device 200 can be used in conjunction with any suitable type of protective gear to simulate a traditional climbing environment. The protective gear can be wedged and/or secured within the crevice volume 276. Specifically, the protective gear can be placed such it is in contact with the first engagement surface 274 and the second engagement surface 274'. In this manner, downward forces exerted on the protective gear can be transferred via the first insert 270 and the second insert 270' to the frame 210. Moreover, the device 200 can also accommodate sport climbing gear (e.g., quick draws, carabiners or other safety links) in the anchor 222.

In some embodiments, any of the simulated traditional climbing devices described herein can include additional features and/or structure to facilitate safety during use. For example, in some embodiments, any of the simulated traditional climbing devices described herein can include a protective cover or cap that can minimize trauma if a climber falls onto the top of the frame. For example, FIGS. 12-15 show various views of a simulated traditional climbing device 300, according to an embodiment. The simulated traditional climbing device 300 includes a frame 310 (also referred to as a cage), an access member 350, a first insert 370, a second insert 370' (also referred to as stones, rocks, or bulk insert material), and a safety cover 360. The simulated traditional climbing device 300, and any of the simulated traditional climbing devices or components therein that are described herein can be used in any suitable application. Such applications include, for example, training on traditional climbing procedures (either in an indoor facility or an outdoor facility), testing of equipment (e.g., testing the support capability of safety equipment), or the like. Specifically, the simulated traditional climbing device 300 can simulate a rock face or crevice within which a protective member (not shown, but similar to any protective member described herein) can be placed. The simulated traditional climbing device 300 and any of the simulated traditional climbing devices or components therein that are described herein can be coupled or mounted to a support structure 303. Although the support structure 303 is shown as being a board (e.g., a 2×4), the device 300 can be mounted to any other support structure, such as, for example, an artificial rock wall, a steel structure, a test fixture, or the like.

Figure 12:
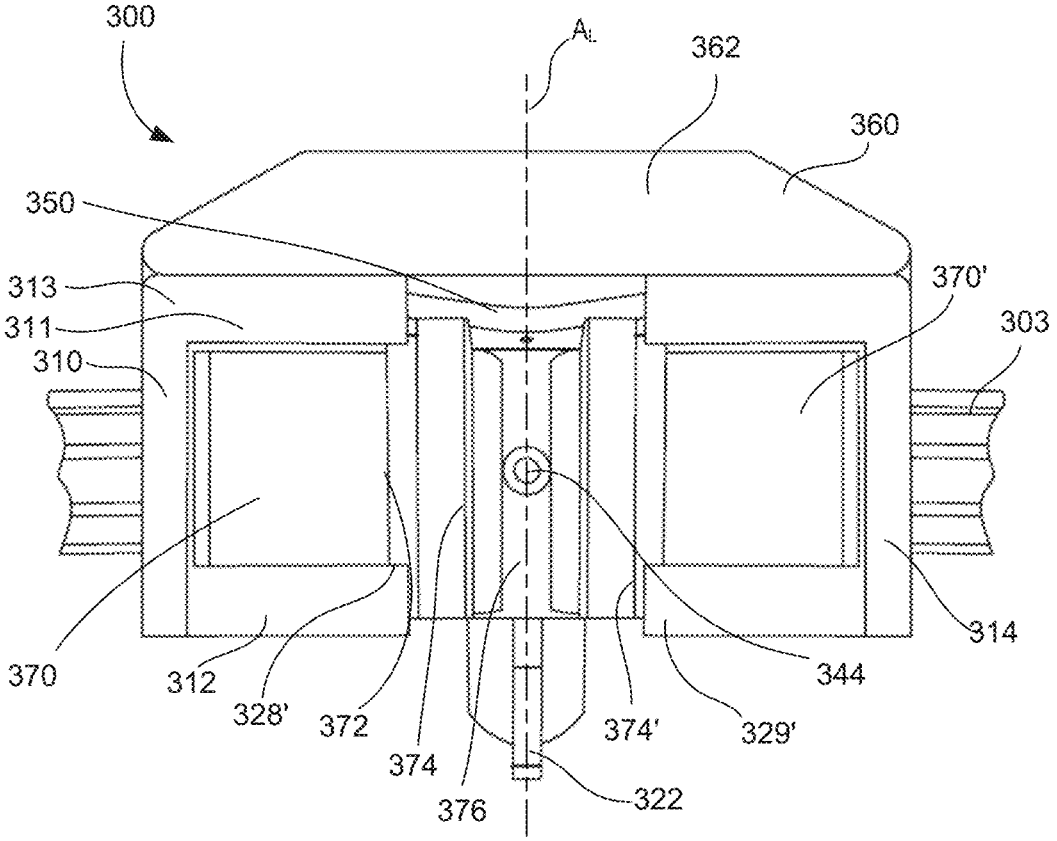
FIG. 12 is a front perspective view of a simulated traditional climbing device, according to an embodiment.
Figure 15:
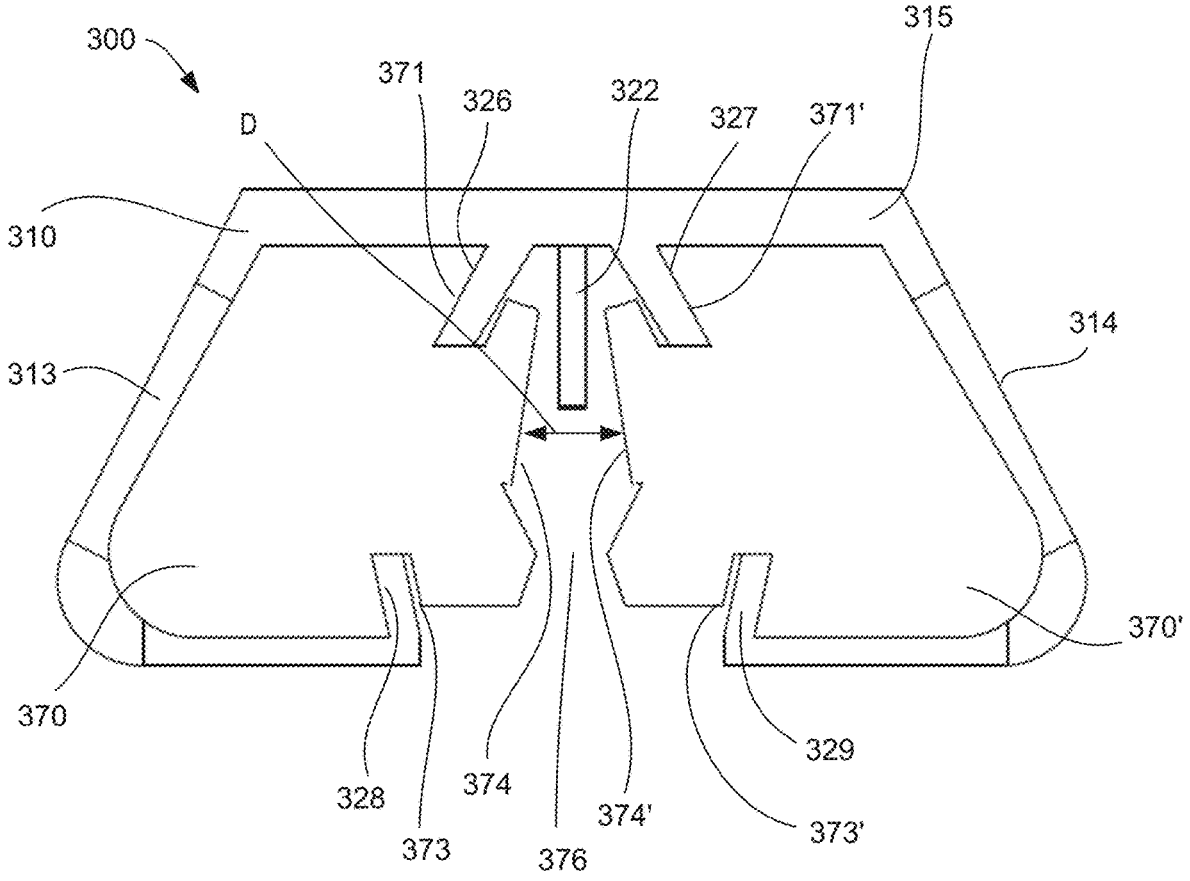
FIG. 15 is a cross-sectional view of the simulated traditional climbing device shown in FIG. 12, taken along line X-X in FIG. 12.

The frame 310 is similar to the frame 210 described above, and therefore certain portions of the frame 310 are not described in detail below. The frame 310 includes a top (or upper) portion 311, a bottom (or lower) portion 312, a first side 313, a second side 314, and a back portion. The back portion of the frame 310 is coupled to the support structure 303 by the mounting bolt 344, and extends between the first side 313 and the second side 314. The frame 310 defines a first volume, a second volume, and a longitudinal axis $A_L$. The first volume 316 can receive at least a portion of the first insert 370, and the second volume 317 can receive at least a portion of a second insert 370'. As shown in FIGS. 12 and 15, the frame 310 is configured such that when the first insert 370 is within the first volume and the second insert 370' is within the second volume, a first engagement surface 374 of the first insert 370 is facing a second engagement surface 374' of the second insert 370'. In this manner, the position of the first insert 370 and the second insert 370' within the frame 310 defines a crevice volume 376 within which a protective member can be placed.

Referring to FIG. 15, the back portion of the frame includes a first tapered surface 326 and a second tapered surface 327. The back portion also defines a mounting hole that is located along the longitudinal axis $A_L$. The mounting hole can receive the mounting bolt 344 to secure the frame 310 to the support structure 303. Moreover, the region of the back portion 315 surrounding the mounting hole can be shaped and/or contoured (e.g., via a countersink) to receive a washer, grommet or any other suitable structure to distribute the load from the fastener that is applied to the frame 310.

The first tapered surface 326 is configured to engage a tapered surface 371 of the first insert 370 to limit movement of the first insert 370 along a lateral axis that is nonparallel to the longitudinal axis $A_L$. For example, in some embodiments, the first tapered surface 326 and the corresponding tapered surface 371 of the first insert 370 can limit horizontal movement (i.e., movement along an axis normal to the longitudinal axis $A_L$) of the first insert 370 within the frame 310. The second tapered surface 327 is configured to engage a tapered surface 371' of the second insert 370' to limit movement of the second insert 370' along a lateral axis that is nonparallel to the longitudinal axis $A_L$. For example, in some embodiments, the second tapered surface 327 and the corresponding tapered surface 371' of the second insert 370' can limit horizontal movement (i.e., movement along an axis normal to the longitudinal axis $A_L$) of the second insert 370' within the frame 310. In this manner, the distance between a first engagement surface 374 and a second engagement surface 374' can be maintained at a constant value when the device 300 is in use. Similarly stated, by limiting horizontal movement of the engagement surface 374 relative to the second engagement surface 374' the "crevice distance" D can be fixed.

The frame 310 includes two retention protrusions 328, 328' that engage and/or contact the first insert 370. Specifically, the two retention protrusions 328, 328' engage a retention surface within the retention groove 373 of the first insert 370 (see FIG. 15). In this manner, the two retention protrusions 328, 328' can also guide the first insert 370 during installation and/or removal from the frame 310, and can also limit movement of the first insert 370 within the first volume. The frame 310 also includes two retention protrusions 329, 329' that engage and/or contact the second insert 370'. Specifically, the two retention protrusions 329, 329' engage a retention surface within the retention groove 373' of the second insert 370'. In this manner, the two retention protrusions 329, 329' can also guide the second insert 370' during installation and/or removal from the frame 310, and can also limit movement of the second insert 370' within the second volume.

The bottom portion 312 of the frame 310 includes a shelf and an anchor 322. The shelf is configured to support and/or engage the first insert 370 and the second insert 370' in a similar manner as described above for the frame 210. The anchor 322 extends below the shelf 320 and defines an opening and a loop to which a safety link (e.g., a carabiner, not shown) can be removably coupled. In this manner, the frame 310 can also provide an anchor point to allow a climber to attach sport gear (not shown) to provide safety until the traditional gear is placed within the crevice volume 376. The anchor 322 is aligned with the longitudinal axis $A_L$ and/or the mounting bolt 344. In this manner, any downward force applied to the anchor 322 will not produce a moment about the mounting bolt (not shown). In other embodiments, however, the anchor 322 can be offset from longitudinal axis $A_L$. In yet other embodiments, the frame 310 (and any of the frames described herein) can be devoid of a fixed anchor.

The top portion 311 of the frame is configured to be matingly coupled to the access member 350. The access member 350 can be similar to the access member 250, and can limit the movement of the first insert 370 and the second insert 370' when the access member 350 is coupled to the frame 310. The access member 350 (and the safety cover 360) can be removed from the frame 310 to access, remove, and/or replace the first insert 370, the second insert 370', or both the first insert 370 and the second insert 370'. In this manner, the first insert 370 and/or the second insert 370' can be removed and/or replaced within the frame 310 without disrupting the coupling between the frame 310 and the structural support 303. This modular arrangement allows for different types of inserts to be used in conjunction with the frame 310 to simulate different crevice distances (e.g., wider or narrower crevices), different crevice geometry (degrees of taper, etc.), different types of rock (e.g., different smoothness or surface features), or the like. This modular arrangement also allows the first insert 370 and/or the second insert 370' to be replaced if defective, worn, or otherwise at the end of its service life.

Figure 13:
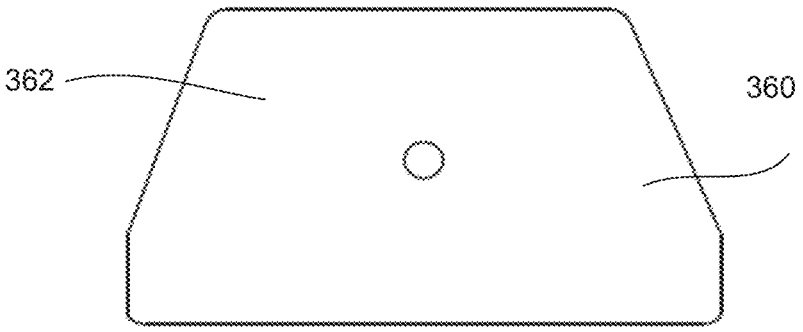
FIGS. 13 and 14 are a front perspective view and rear perspective view, respectively, of a cover member of the simulated traditional climbing device shown in FIG. 12.
Figure 14:
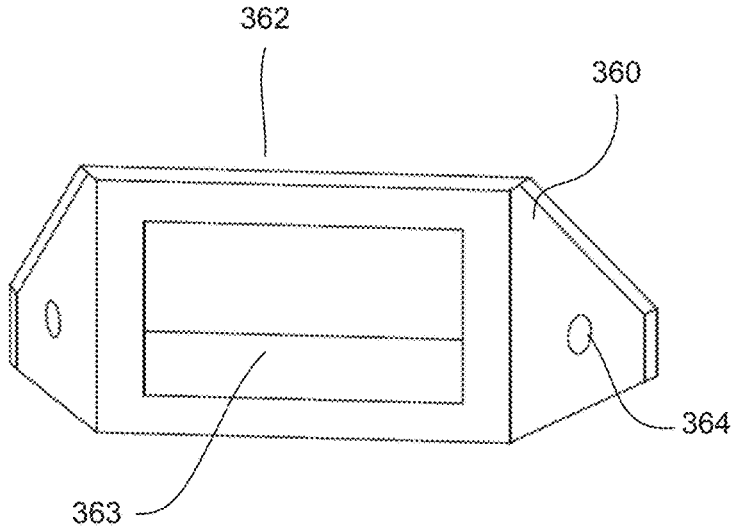

Referring to FIGS. 13 and 14, the safety cover 360 includes a tapered top surface 362. The top surface 362 also includes rounded edges. Thus, the top surface 362 provides a suitable surface upon which a climber can impact during a fall in a manner that minimizes injury (e.g., as compared to a surface with sharp edges). The safety cover 360 also defines a hollow interior 363 in which training items, documentation and other items can be stored. The safety cover defines a series of holes 364 within which T-nuts or other fasteners can be mounted to facilitate further anchors. Thus, the hollow interior 363 also provides an access point for repair and/or removal of such t-nuts.

Referring to FIG. 15, the first insert 370 includes the retention groove 373, the rear tapered surface 371, and the engagement surface 374. As described above, the surfaces defining the retention groove 373 engage the two retention protrusions 328, 328'. The rear tapered surface 371 engages the first tapered surface 326 of the frame 310 to limit movement of the first insert 370 along a lateral axis that is nonparallel to the longitudinal axis $A_L$, as described above. The second insert 370' is symmetrical to the first insert 370. The second insert 370' includes the retention groove 373', the rear tapered surface 371', and the engagement surface 374'. As described above, surfaces defining the retention groove 373' engage the two retention protrusions 329, 329'. The rear tapered surface 371' engages the second tapered surface 327 of the frame 310 to limit movement of the second insert 370' along a lateral axis that is nonparallel to the longitudinal axis $A_L$, as described above.

The first engagement surface 374 and/or the second engagement surface 374' can have any shape and/or surface characteristics to simulate an actual rock crevice. For example, although the first engagement surface 374 and the second engagement surface 374' are shown as being two linear segments, in other embodiments, the first engagement surface 374 and/or the second engagement surface 374' can be curved, can have multiple discontinuous surfaces, or any other suitable shape. Moreover, the first engagement surface 374 and/or the second engagement surface 374' can have any surface roughness and/or texture.

In use, the simulated traditional climbing device 300 can be used in conjunction with any suitable type of protective gear to simulate a traditional climbing environment. The protective gear can be wedged and/or secured within the crevice volume 376. Specifically, the protective gear can be placed such it is in contact with the first engagement surface 374 and the second engagement surface 374'. In this manner, downward forces exerted on the protective gear can be transferred via the first insert 370 and the second insert 370' to the frame 310. Moreover, the device 300 can also accommodate sport climbing gear (e.g., carabiners or other safety links) in the anchor 322.

Figure 16:
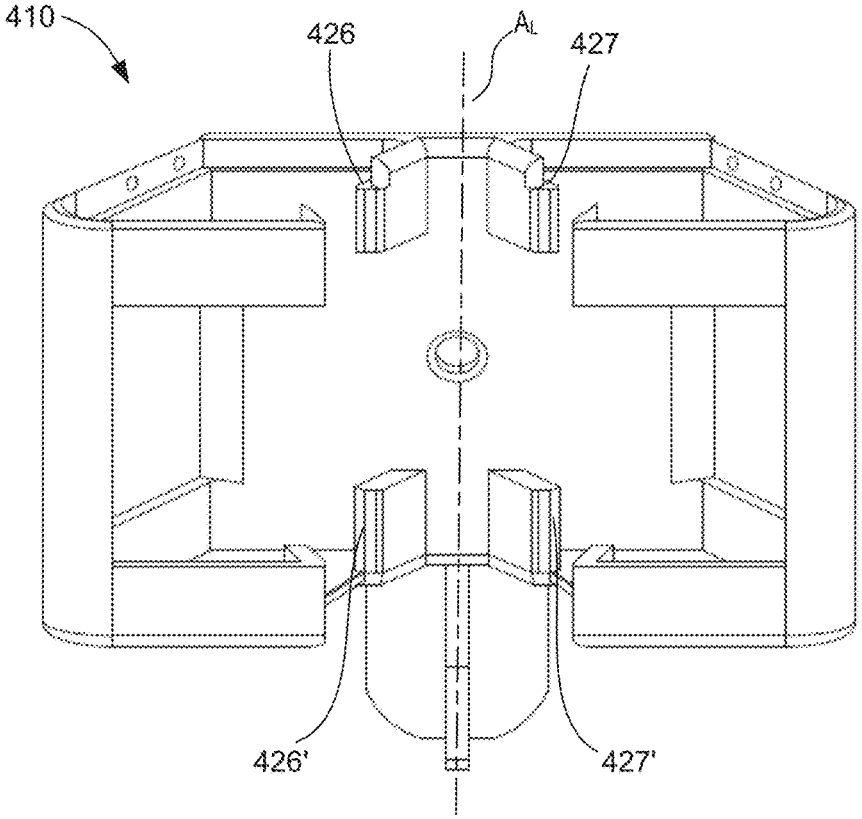
FIG. 16 is a front perspective view of a frame of a simulated traditional climbing device, according to an embodiment.
Figure 17:
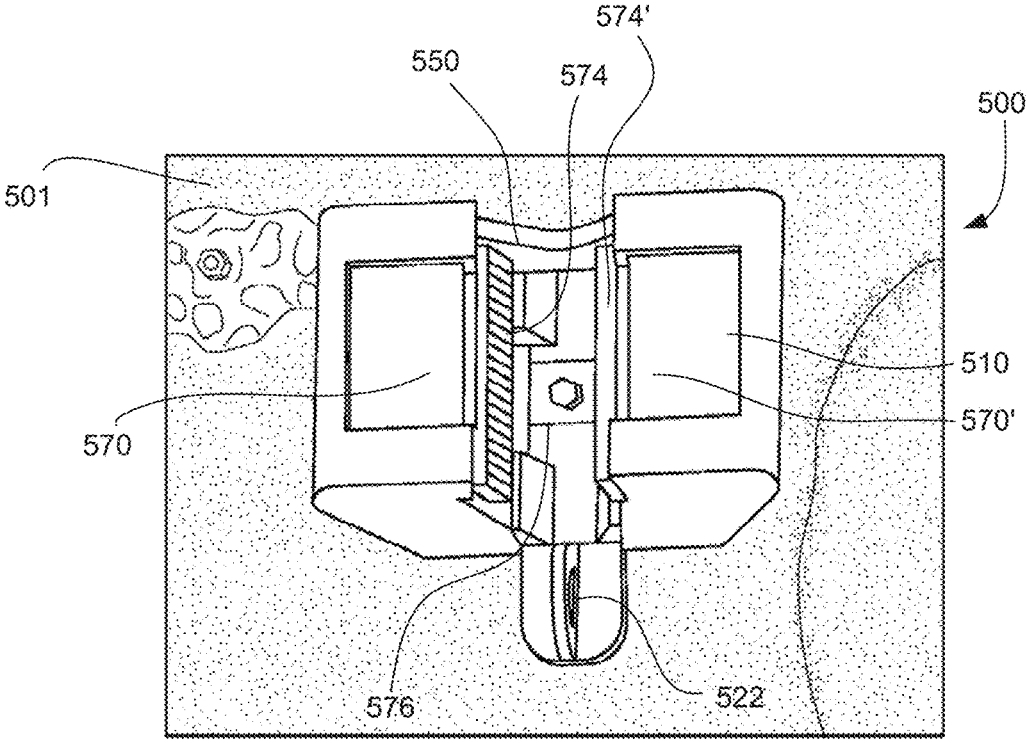
FIG. 17 is a front perspective view of a simulated traditional climbing device, according to an embodiment, mounted to a support structure.
Figure 19:
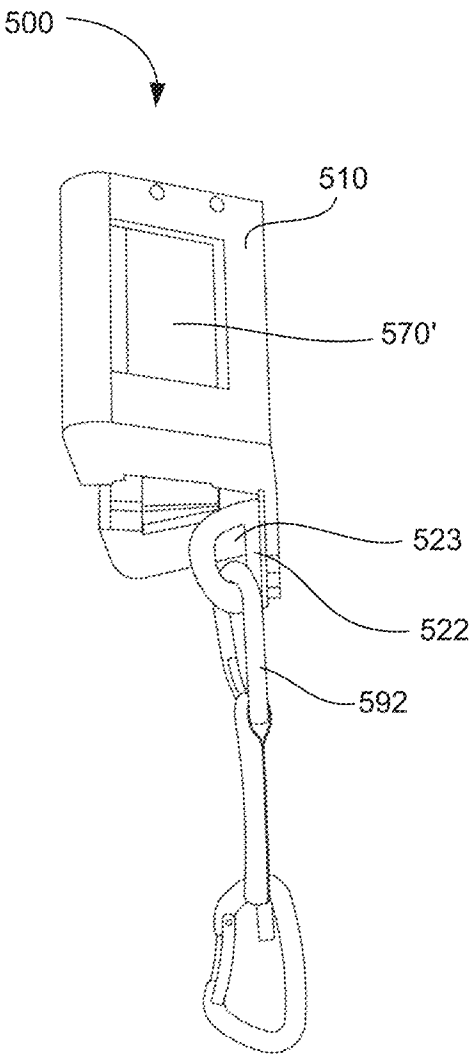
FIGS. 18-21 show a simulated traditional climbing device, according to an embodiment, in various stages of use with climbing anchors and safety gear.
Figure 18:
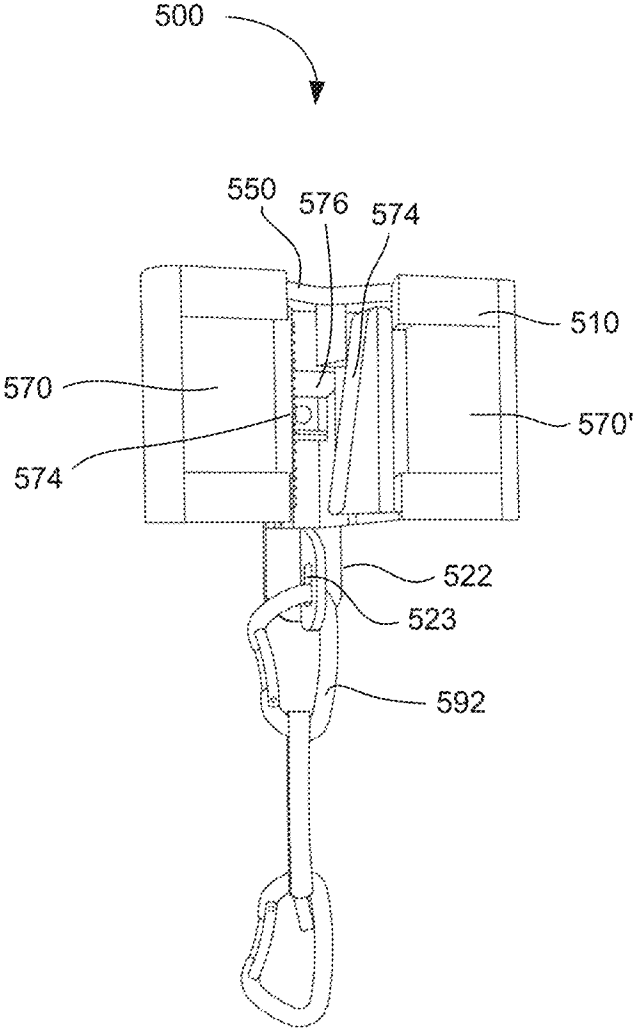
Figure 21:
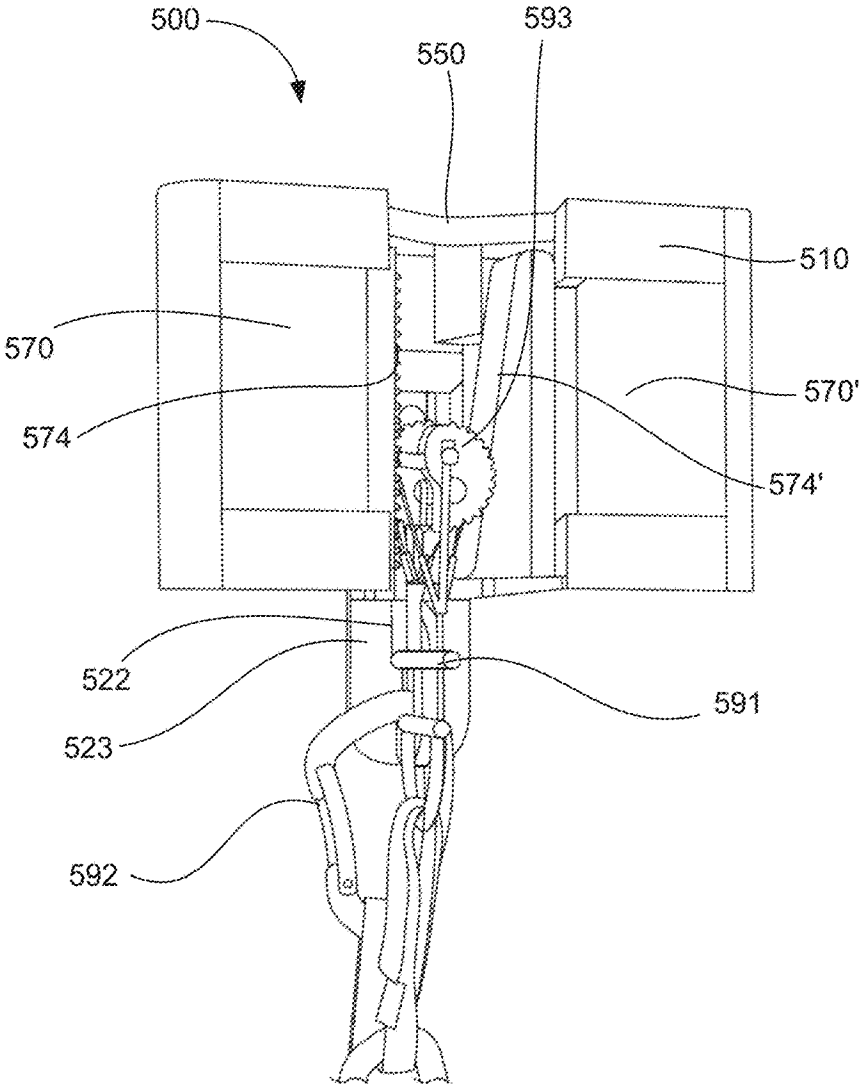
Figure 20:
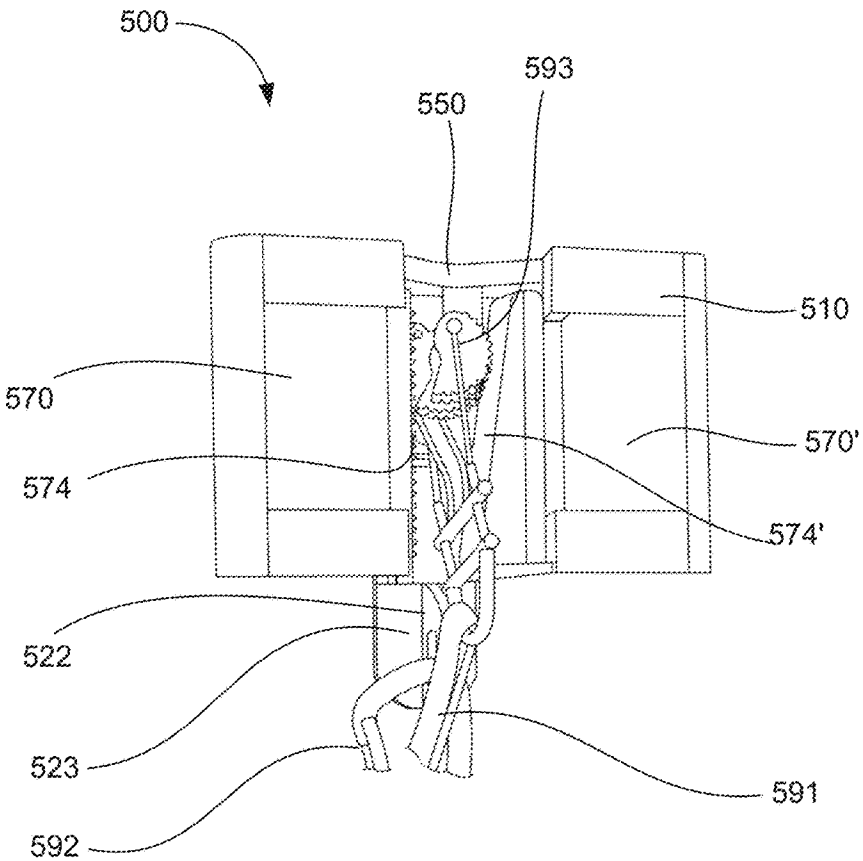
Figure 22:
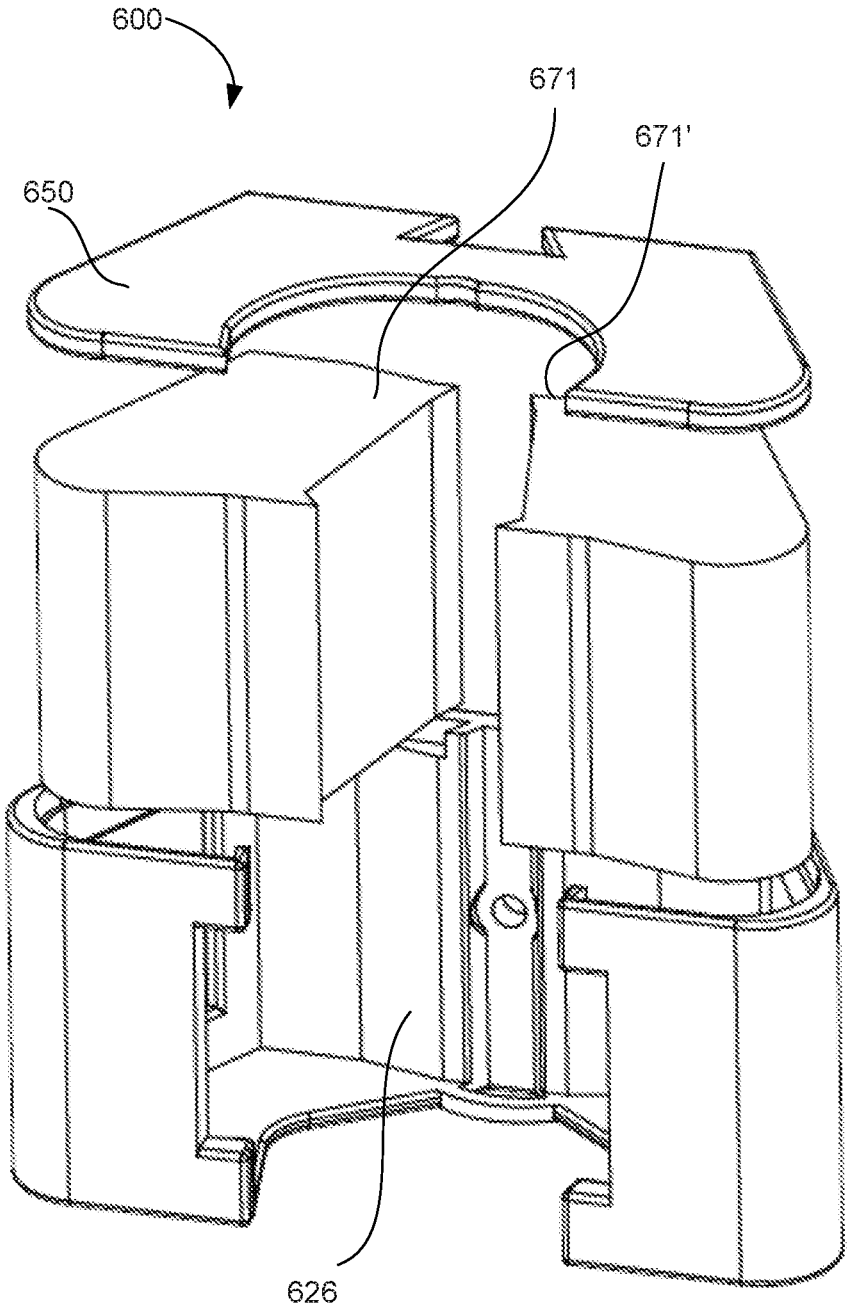
FIG. 22 is a perspective exploded view of a simulated traditional climbing device, according to an embodiment.

Although the frame 210 is shown as including a first tapered surface 226 and a second tapered surface 227 that each extend substantially the length of the frame 210, in other embodiments, a frame can include one or more tapered surfaces that extend for any suitable distance. Such tapered surfaces or protrusions can, as described above, limit horizontal movement (i.e., movement along an axis normal to a longitudinal axis $A_L$) of the insert(s) within the frame. For example, FIG. 16 shows a frame 410 that can be used in conjunction with any of the simulated traditional climbing devices shown herein. The frame 410 is similar in many respects (both in structure and function) to the frame 210 described above, and is therefore not described in detail. The frame 410 differs from the frame 210 in that the frame 410 includes a first pair of corresponding tapers 426, 426' and a second pair of corresponding tapers 427, 427'. Each of the first pair of corresponding tapers 426, 426' extends only partially along the length of the frame 410. Each of the first pair of corresponding tapers 426, 426' is aligned with the other, and is therefore configured to engage a tapered surface (similar to the surface 271 of the insert 270) to limit movement of an insert within the frame 410. Each of the second pair of corresponding tapers 427, 427' extends only partially along the length of the frame 410. Each of the second pair of corresponding tapers 427, 427' is aligned with the other, and is therefore configured to engage a tapered surface (similar to the surface 271' of the insert 270') to limit movement of an insert within the frame 410.

The simulated traditional climbing devices described herein can be used in conjunction with any suitable type of protective gear to simulate a traditional climbing environment. Moreover, some embodiments described herein can also accommodate sport climbing gear (e.g., carabiners or other safety links) within an anchor. For example, FIGS. 17-21 show a simulated traditional climbing device 500 in various stages of use. The simulated traditional climbing device 500 includes a frame 510 (also referred to as a cage), an access member 550, a first insert 570, and a second insert 570' (also referred to as stones, rocks, or bulk insert material). The simulated traditional climbing device 500 is similar in many respects (both in structure and function) to the simulated traditional climbing devices 200, 300 and 400 described above, and is therefore not described in detail.

The frame 510 includes a back portion that is coupled to the support structure 501 via a bolted joint. The support structure 501 can be any suitable support structure (indoors or outdoors), such as, for example, an artificial rock wall, a steel structure, a test fixture, or the like. The frame 510 defines a first volume that can removably receive a first insert 570, and a second volume that can removably receive a second insert 570'. The first insert 570 and the second insert 570' can be similar to any of the inserts described herein. For example, the first insert 570 includes a first engagement surface 574 and the second insert 570' includes a second engagement surface 574'. When the first insert 570 and the second insert 570' are within the frame 510, the first engagement surface 574 is facing a second engagement surface 574'. In this manner, the position of the first insert 570 and the second insert 570' within the frame 510 defines a crevice volume 576 within which a protective member (e.g., the cam 593) can be placed.

Although not shown in FIGS. 17-21, the frame includes one or more tapered surfaces that engage and/or contact each of the first insert 570 and the second insert 570' to limit movement of the inserts along a lateral axis that is nonparallel to the longitudinal axis of the frame. In this manner, the distance between a first engagement surface 574 and a second engagement surface 574' can be maintained at a constant value when the device 500 is in use. Similarly stated, by limiting horizontal movement of the engagement surface 574 relative to the second engagement surface 574', the "crevice distance" can be fixed.

The bottom portion of the frame 510 includes an anchor 522 that extends below the shelf. The anchor 522 defines an opening 523 and a loop to which a safety link (e.g., a carabiner 592) can be removably coupled. In this manner, the frame 510 can also provide an anchor point to allow a climber to attach sport gear (e.g., a carabiner 592) to provide safety until the traditional gear is placed within the crevice volume 576. The anchor 522 is aligned with the longitudinal axis $A_L$ and/or the mounting bolt. In this manner, any downward force applied to the anchor 522 will not produce a moment about the mounting bolt.

The access member 550 is removably coupled to the frame 510. When coupled to the frame 510, the access member 550 can limit movement of the first insert 570 and the second insert 570'. As shown, the access member 550 defines a front opening that provides access to the first engagement surface 574 and the second engagement surface 574' from a region above the frame. Thus, the opening 552 is sized and positioned to allow a user to place protective gear (e.g., the cam 593) into the crevice volume 576 in a downward direction (i.e., from a position above the frame 510). The access member 550 can be coupled to the frame 510 by a series of mechanical fasteners (e.g., bolts, capscrews, or the like, not shown). In this manner, the first insert 570 and the second insert 570' can be removed from the from the frame 510 when the frame 510 is remains mounted to the structural support 501. In this manner, the first insert 570 and/or the second insert 570' can be removed and/or replaced within the frame 510 without disrupting the coupling between the frame 510 and the structural support. This modular arrangement allows for different types of inserts to be used in conjunction with the frame 510 to simulate different crevice distances (e.g., wider or narrower crevices), different crevice geometry (degrees of taper, etc.), different types of rock (e.g., different smoothness or surface features), or the like. This modular arrangement also allows the first insert 570 and/or the second insert 570' to be replaced if defective, worn, or otherwise at the end of its service life.

In use, the simulated traditional climbing device 500 can be used in conjunction with any suitable type of protective gear (such as the cam 593) to simulate a traditional climbing environment, but with the safety features of a sport climbing environment. For example, during a training event, the climber can first clip the safety link 592 (e.g., the carabiner or quick draw link) to the anchor 522 through the opening 523. This coupling provides an initial safety mechanism for when the climber begins placing the traditional gear within the crevice volume 576. Specifically, the device 500 is configured to support the weight of the climber if the climber slips. Specifically, the device 500 (included the bolted joint) is configured to support a downward force of at least about 32 kN and an outward (i.e., along a direction normal to the longitudinal axis) force of at least about 18 kN. In some embodiments, the safety link 592 will already be coupled to the anchor 522, and the climber will simply couple a carabiner or other link to the safety link 592.

After the safety link 592 is placed, the climber can then experiment with the traditional gear. The traditional gear 593 can include any suitable gear and safety line 591, such as, for example, the cam shown in FIGS. 20 and 21. The user can insert or wedge the cam 593 into the crevice volume 576 from the upper side or outer side of the frame. The frame 510, the first insert 570 and the second insert 570' are collectively configured to withstand an outward force (i.e., against the first engagement surface 574 and the second engagement surface 574') of up to about 24 kN with a maximum deflection of 0.003 mm. In this manner, the device 500 can simulate the rigidity, structure, and feel of an actual traditional climbing environment.

Although the anchors (e.g., the anchor 222, 522) are shown and described as extending below the shelf or bottom portion of the frame, in other embodiments, a frame can include any suitable anchor to accommodate a safety link (e.g., quick draw, carabiner or the like). Moreover, although the tapered surfaces (e.g., the first tapered surface 226 and the second tapered surface 227) are shown as defining an acute angle with respect to the back surface of the frame, in other embodiments, the tapered surfaces can form any suitable angle. For example, FIGS. 22-26 show a simulated traditional climbing device 600. The simulated traditional climbing device 600 includes a frame 610 (also referred to as a cage), an access member 650, a first insert 670, and a second insert 670' (also referred to as stones, rocks, or bulk insert material). The simulated traditional climbing device 600 is similar in many respects (both in structure and function) to the simulated traditional climbing devices 200, 300 and 400 described above.

Figure 23:
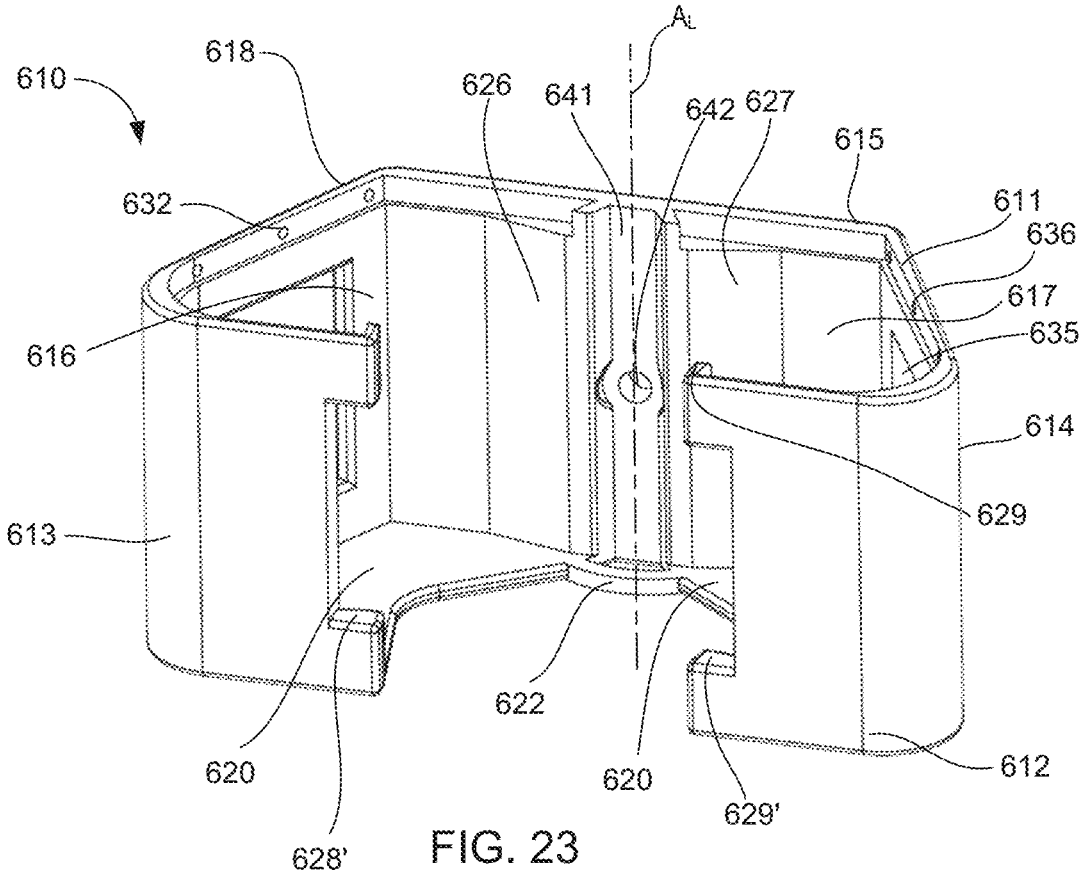
FIGS. 23 and 24 are a front perspective view and a top view, respectively, of a frame of the simulated traditional climbing device shown in FIG. 22.
Figure 24:
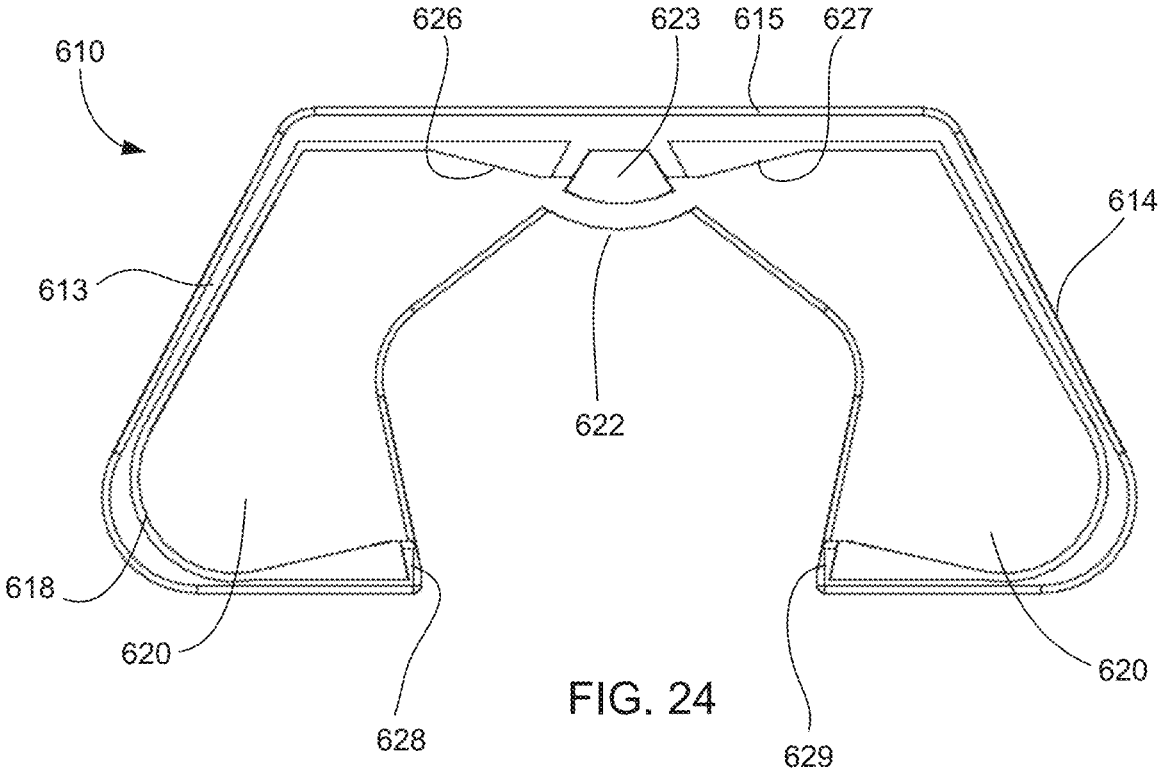

The frame 610 includes a top (or upper) portion 611, a bottom (or lower) portion 612, a first side 613, a second side 614, and a back portion 615. As described herein, the back portion 615 is the portion of the frame 610 that is coupled to the support structure, and extends between the first side 613 and the second side 614. Referring to FIG. 23, the frame 610 defines a first volume 616, a second volume 617, and a longitudinal axis $A_L$. The longitudinal axis $A_L$ separates the first volume and the second volume, and in some embodiments, can be coincident with an axis of symmetry (or center line) of the frame. The first volume 616 can receive at least a portion of the first insert 670, and the second volume 617 can receive at least a portion of a second insert 670'. The frame 610 is configured such that when the first insert 670 is within the first volume 616 and the second insert 670' is within the second volume 617, a first engagement surface 674 of the first insert 670 is facing a second engagement surface 674' of the second insert 670'. In this manner, the position of the first insert 670 and the second insert 670' within the frame 610 defines a crevice volume 676 within which a protective member can be placed.

The back portion 615 of the frame includes a first tapered surface 626 and a second tapered surface 627, and defines a channel 641 between the first tapered surface 626 and the second tapered surface 627. The back portion 615 also defines a mounting hole 642 within the channel 641 that is located along the longitudinal axis $A_L$. The mounting hole 642 can receive a fastener (e.g., a bolt or capscrew; not shown) to secure the frame 610 to the support structure (not shown). Moreover, the region of the back portion 615 surrounding the mounting hole can be shaped and/or contoured (e.g., via a countersink) to receive a washer, grommet or any other suitable structure to distribute the load from the fastener that is applied to the frame 610.

The first tapered surface 626 differs from the first tapered surface 226 of the frame 210 in that the first tapered surface 626 defines an obtuse angle with respect to the back surface. The first tapered surface 626 is configured to engage a tapered surface 671 of the first insert 670 to limit movement of the first insert 670 along a lateral axis that is nonparallel to the longitudinal axis $A_L$. For example, in some embodiments, the first tapered surface 626 and the corresponding tapered surface 671 of the first insert 670 can limit horizontal movement (i.e., movement along an axis normal to the longitudinal axis $A_L$) of the first insert 670 within the frame 610. The second tapered surface 627 also defines an obtuse angle with respect to the back surface. The second tapered surface 627 is configured to engage a tapered surface 671' of the second insert 670' to limit movement of the second insert 670' along a lateral axis that is nonparallel to the longitudinal axis $A_L$. For example, in some embodiments, the second tapered surface 627 and the corresponding tapered surface 671' of the second insert 670' can limit horizontal movement (i.e., movement along an axis normal to the longitudinal axis $A_L$) of the second insert 670' within the frame 610. In this manner, the distance between a first engagement surface 674 and a second engagement surface 674' can be maintained at a constant value when the device 600 is in use. Similarly stated, by limiting horizontal movement of the engagement surface 674 relative to the second engagement surface 674' the "crevice distance" can be fixed.

The frame 610 includes two retention protrusions 628, 628' that engage and/or contact the first insert 670. Specifically, the two retention protrusions 628, 628' engage the retention surface 672 of the first insert 670 (see FIGS. 8 and 9). In this manner, the two retention protrusions 628, 628' can also guide the first insert 670 during installation and/or removal from the frame 610, and can also limit movement of the first insert 670 within the first volume 616. The frame 610 also includes two retention protrusions 629, 629' that engage and/or contact the second insert 670'. Specifically, the two retention protrusions 629, 629' engage the retention surface 672' of the second insert 670' (see FIGS. 25 and 26). In this manner, the two retention protrusions 629, 629' can also guide the second insert 670' during installation and/or removal from the frame 610, and can also limit movement of the second insert 670' within the second volume 617.

The bottom portion 612 of the frame 610 includes a shelf 620 and an anchor 622. The shelf 620 is configured to support and/or engage the first insert 670 and the second insert 670'. The shelf 620 can be any shoulder, ledge, protrusion or similar structure that limits the downward movement of the first insert 670 and/or the second insert 670'. More particularly, the shelf 620 can be any shoulder, ledge, protrusion or similar structure that limits the movement of the first insert 670 and/or the second insert 670' along the longitudinal axis $A_L$ in the downward direction. Moreover, the shelf 620 can be any structure that supports at least a portion of the downward force exerted by the first insert 670 and/or the second insert 670' onto the frame 610. Such downward forces can result from, for example, the weight of the first insert 670 and/or the second insert 670', downward forces applied by the protective gear against the first insert 670 and/or the second insert 670', or the like.

The anchor 622 is coplanar with the shelf 620 and defines an opening 623 and a loop to which a safety link (e.g., a quick draw, a carabiner, or the like, not shown) can be removably coupled. In this manner, the frame 610 can also provide an anchor point to allow a climber to attach sport gear (not shown) to provide safety until the traditional gear is placed within the crevice volume 676. The opening of the anchor 622 is aligned with the longitudinal axis $A_L$ and/or the mounting hole 642. In this manner, any downward force applied to the anchor 622 will not produce a moment about the mounting bolt (not shown). In other embodiments, however, the anchor 622 can be offset from longitudinal axis $A_L$. In yet other embodiments, the frame 610 (and any of the frames described herein) can be devoid of a fixed anchor.

The top portion 611 of the frame includes a shoulder 618 upon which the access member 650 is mounted. The shoulder 618 is recessed from the upper-most surface of the frame 610 and allows the access member 650 to be matingly received within the top portion 611 of the frame 610. The top portion 611 also defines an opening into the first volume 616 and the second volume 617. Thus, when the access member 650 is removed from the frame 610 the first insert 670 and the second insert 670' can be removed from the first volume 616 and the second volume 617, respectively, via the opening.

The first side 613 of the frame 610 defines an opening that provides access to the first insert 670. Similarly, the second side 614 of the frame 610 defines an opening that provides access to the second insert 670'. Although the second insert 670' is not inserted into and/or removed from the second volume 617 via the opening, in other embodiments, the second insert 670' can be removed via a side opening. The first side 613 and the second side 614 each define a series of bolt holes 632, 636, respectively, that are used to couple the access member 650 to the frame 610.

The access member 650 is removably coupled to the frame 610 such that the access member 650 covers at least a portion of the first volume 616 and the second volume 617. In this manner, the access member 650 can limit movement of the first insert 670 and the second insert 670' when the access member 650 is coupled to the frame 610. The access member 650 can be any cover, plate, or similar structure that maintains at least the first insert 670 within the first volume 616 and the second insert 670' within the second volume 617. The access member 650 can limit the movement of the first insert 670 and the second insert 670' along the longitudinal axis $A_L$ in the upward direction. As shown, the access member 650 defines a notch 651 and a front opening 652.

Figure 25:
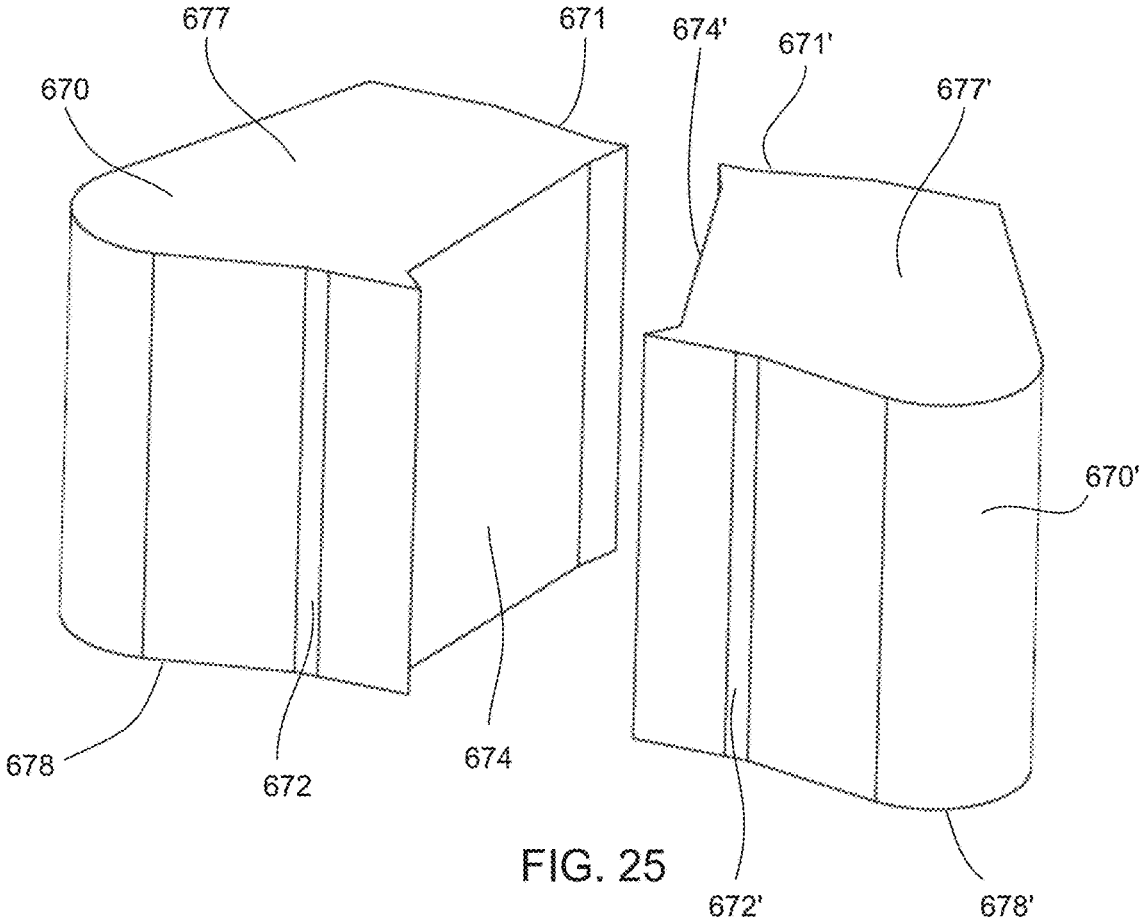
FIGS. 25 and 26 are a front perspective view and a top view, respectively, of the inserts of the simulated traditional climbing device shown in FIG. 22.
Figure 26:
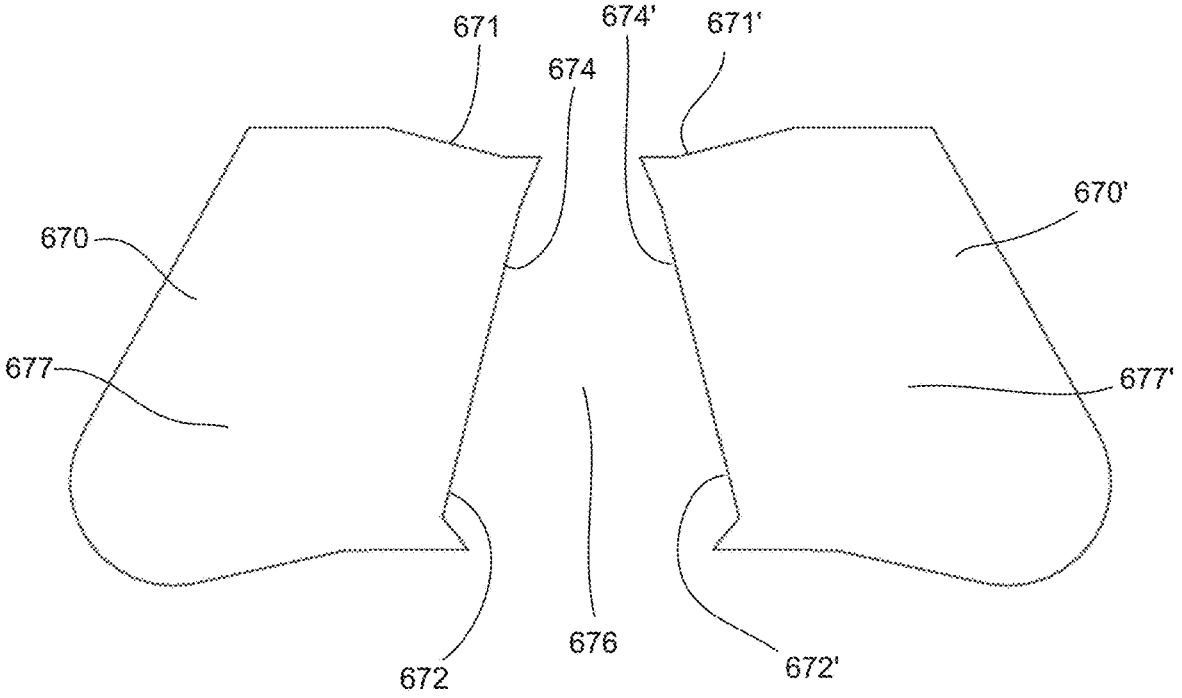

Referring to FIGS. 25 and 26, the first insert 670 includes a top surface 677, a bottom surface 678, a retention surface 672, a rear tapered surface 671, and an engagement surface 674. The top surface 677 is configured to be covered (and/or engage) the access member 650. In this manner, the access member 650 can limit upward movement of the first insert 670, for example, when a piece of protective gear is being pulled upward during removal. The bottom surface 678 engages and/or is supported by the shelf 620. In some embodiments, the bottom surface 678 can be shaped to correspond to the shelf 620. In this manner, the bottom surface 678 can mate with the shelf 620. As described above, the retention surface 672 engages the two retention protrusions 628, 628'. In this manner, retention surface 672 and the two retention protrusions 628, 628' can guide the first insert 670 during installation and/or removal from the frame 610, and can also limit movement of the first insert 670 within the first volume 616. The rear tapered surface 671 engages the first tapered surface 626 of the frame 610 to limit movement of the first insert 670 along a lateral axis that is nonparallel to the longitudinal axis $A_L$, as described above.

The second insert 670' is symmetrical to the first insert 670. The second insert 670' includes a top surface 677', a bottom surface 678', a retention surface 672', a rear tapered surface 671', and an engagement surface 674'. The top surface 677' is configured to be covered (and/or engage) the access member 650. In this manner, the access member 650 can limit upward movement of the second insert 670', for example, when a piece of protective gear is being pulled upward during removal. The bottom surface 678' engages and/or is supported by the shelf 620. In some embodiments, the bottom surface 678' can be shaped to correspond to the shelf 620. In this manner, the bottom surface 678' can mate with the shelf 620. As described above, the retention surface 672' engages the two retention protrusions 629, 629'. In this manner, retention surface 672' and the two retention protrusions 62', 62" can guide the second insert 670' during installation and/or removal from the frame 610, and can also limit movement of the second insert 670' within the second volume 617. The rear tapered surface 671' engages the second tapered surface 627 of the frame 610 to limit movement of the second insert 670' along a lateral axis that is nonparallel to the longitudinal axis $A_L$, as described above.

The first engagement surface 674 and/or the second engagement surface 674' can have any shape and/or surface characteristics to simulate an actual rock crevice. For example, although the first engagement surface 674 and the second engagement surface 674' are shown as being linear, in other embodiments, the first engagement surface 674 and/or the second engagement surface 674' can be curved, can have multiple discontinuous surfaces, or any other suitable shape. Moreover, the first engagement surface 674 and/or the second engagement surface 674' can have any surface roughness and/or texture.

In use, the simulated traditional climbing device 600 can be used in conjunction with any suitable type of protective gear to simulate a traditional climbing environment. The protective gear can be wedged and/or secured within the crevice volume 676. Specifically, the protective gear can be placed such it is in contact with the first engagement surface 674 and the second engagement surface 674'. In this manner, downward forces exerted on the protective gear can be transferred via the first insert 670 and the second insert 670' to the frame 610. Moreover, the device 600 can also accommodate sport climbing gear (e.g., carabiners or other safety links) in the anchor 622.

Figure 27:
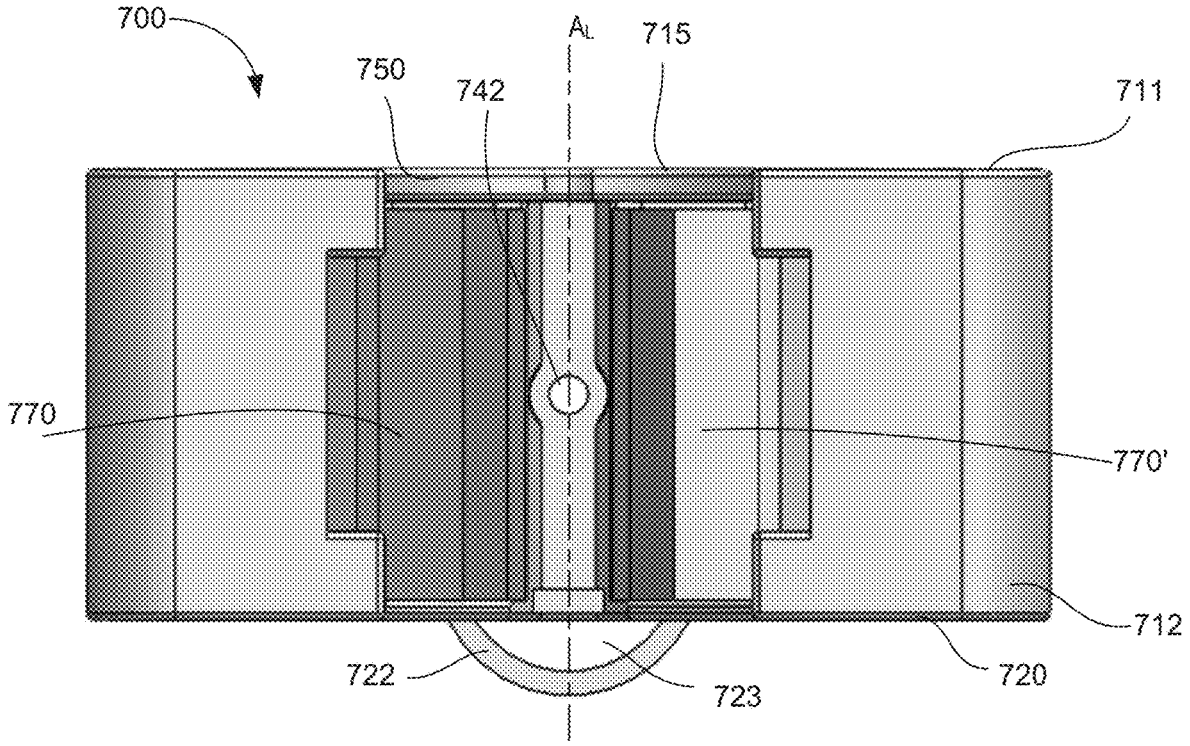
FIG. 27 is a front view of a simulated traditional climbing device, according to an embodiment.

FIG. 27 shows a front view of simulated traditional climbing device 700 having another style of safety anchor. The simulated traditional climbing device 700 includes a frame 710 (also referred to as a cage), an access member 750, a first insert 770, and a second insert 770' (also referred to as stones, rocks, or bulk insert material). The simulated traditional climbing device 700 is similar in many respects (both in structure and function) to the simulated traditional climbing devices 200, 300, 400, and 600 described above, and is therefore not discussed in detail below.

The frame 710 includes a top (or upper) portion 711, a bottom (or lower) portion 712, a first side, a second side, and a back portion 715. As described herein, the back portion 715 is the portion of the frame 710 that is coupled to the support structure, and extends between the first side and the second side. As shown, the back portion 715 defines a bolt hole 742 to facilitate such mounting. The frame 710 defines a first volume, a second volume, and a longitudinal axis $A_L$ that separates the first volume and the second volume. The first volume can receive at least a portion of the first insert 770, and the second volume can receive at least a portion of a second insert 770', as described above with respect to the devices 200, 300, 400, and 600.

The bottom portion 712 of the frame 710 includes a shelf 720 and an anchor 722. The shelf 720 is configured to support and/or engage the first insert 770 and the second insert 770'. The shelf 720 can be any shoulder, ledge, protrusion or similar structure that limits the downward movement of the first insert 770 and/or the second insert 770'. The anchor 722 is a loop that extends below the shelf 720 and defines an opening 723. The anchor 722 thus provides the structure to which a safety link (e.g., a quick draw, a carabiner, or the like, not shown) can be removably coupled. In this manner, the frame 710 can also provide an anchor point to allow a climber to attach sport gear (not shown) to provide safety until the traditional gear is placed within the crevice volume. The opening 723 of the anchor 722 is aligned with the longitudinal axis $A_L$ and/or the mounting hole 742. In this manner, any downward force applied to the anchor 722 will not produce a moment about the mounting bolt (not shown). In other embodiments, however, the anchor 722 can be offset from longitudinal axis $A_L$.

Figure 28:
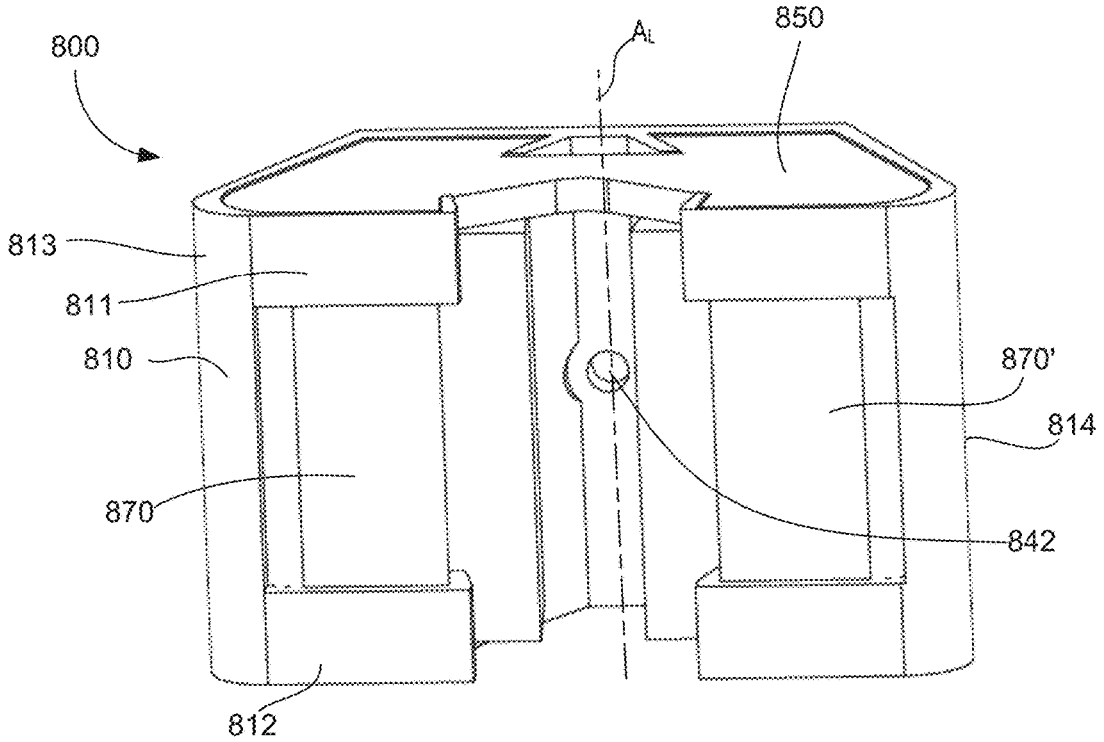
FIG. 28 is a perspective view of a simulated traditional climbing device, according to an embodiment.
Figure 29:
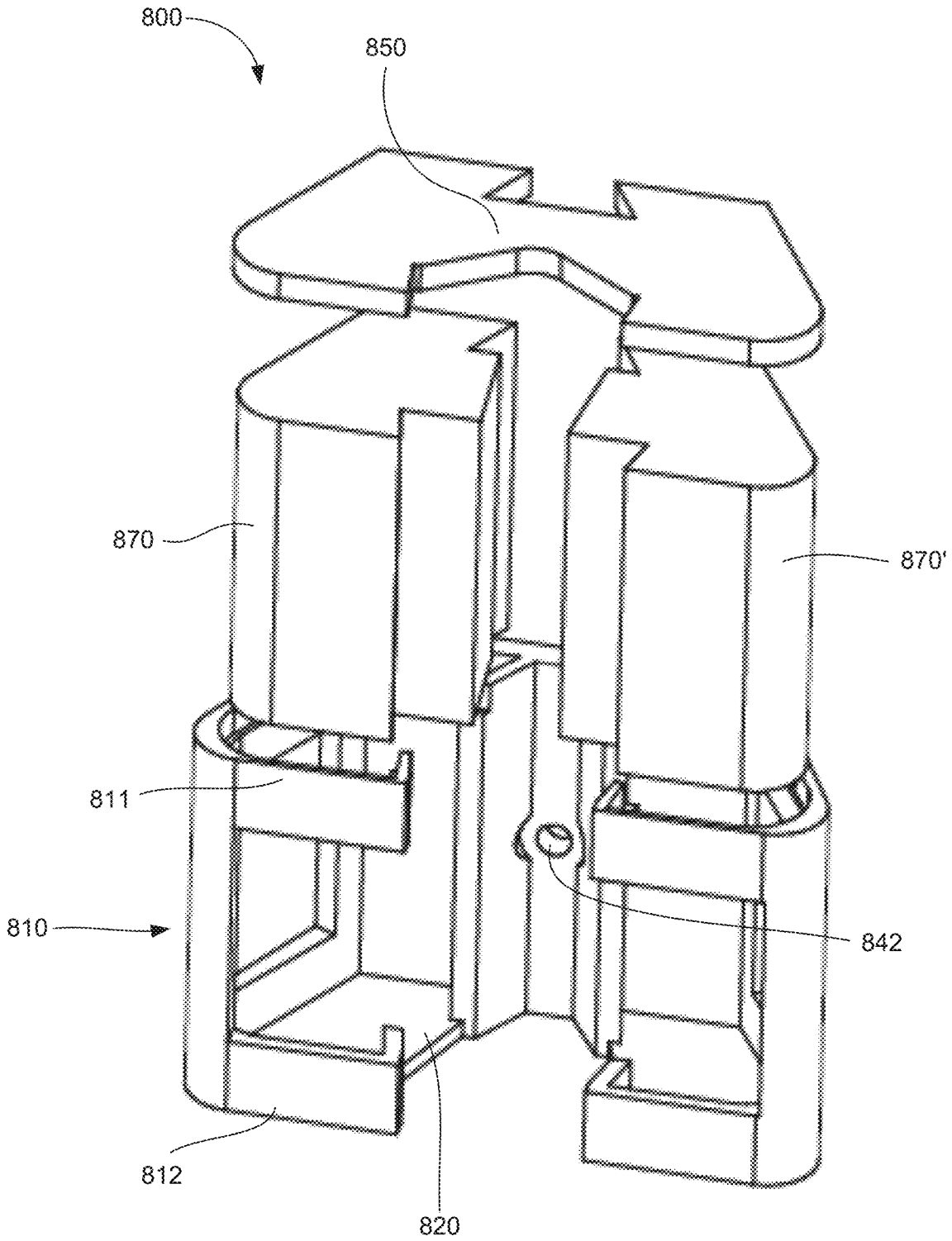
FIG. 29 is a perspective exploded view of the simulated traditional climbing device shown in FIG. 28.
Figure 30:
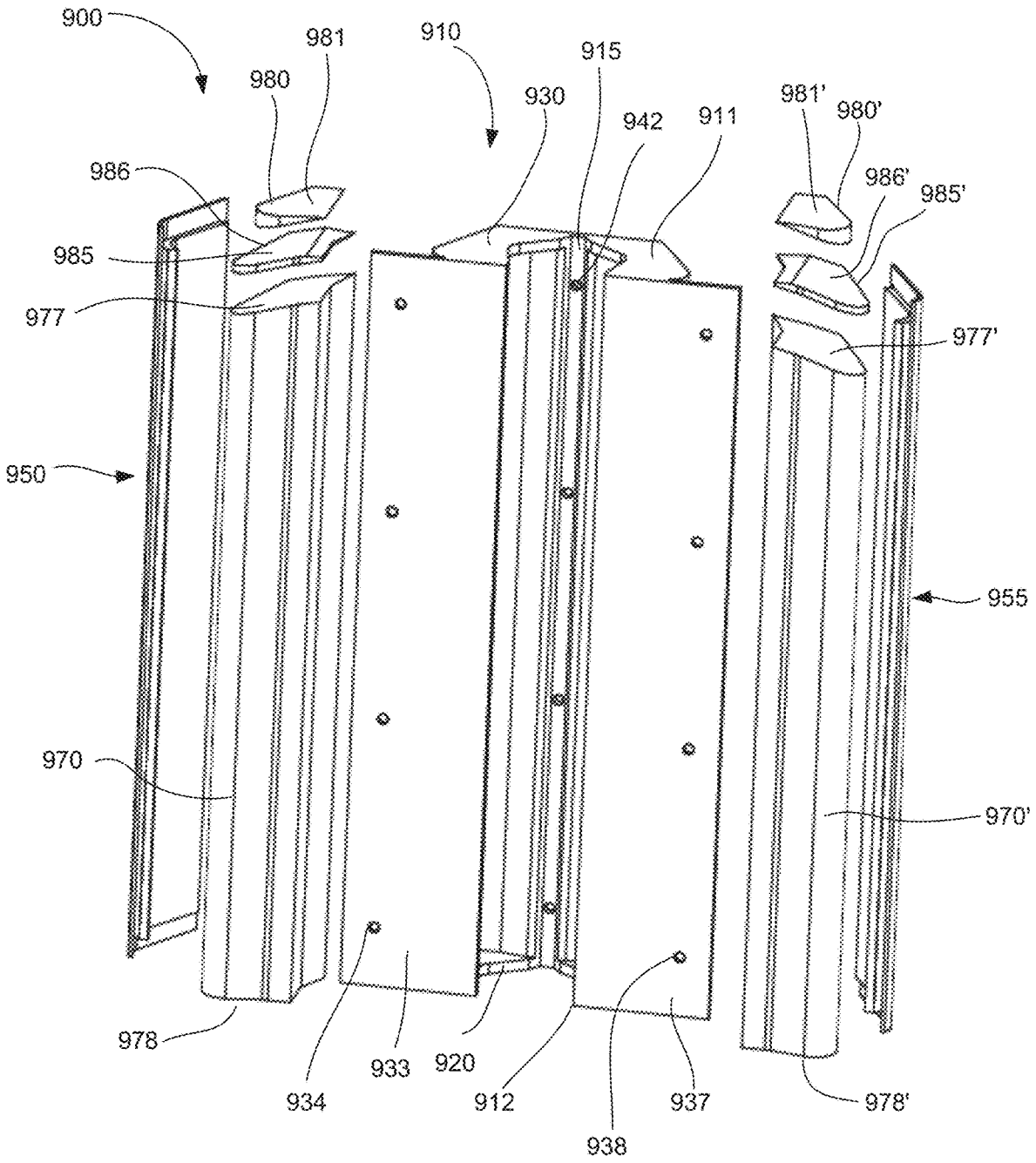
FIG. 30 is a perspective exploded view of a simulated traditional climbing device, according to an embodiment.

In yet other embodiments, the frame 710 (and any of the frames described herein) can be devoid of a fixed anchor. For example, FIGS. 28 and 29 show various views of simulated traditional climbing device 800 that is devoid of a safety anchor. The simulated traditional climbing device 800 includes a frame 810 (also referred to as a cage), an access member 850, a first insert 870, and a second insert 870' (also referred to as stones, rocks, or bulk insert material). The simulated traditional climbing device 800 is similar in many respects (both in structure and function) to the simulated traditional climbing devices 200, 300, 400, 600, and 700 described above, and is therefore not discussed in detail below.

The frame 810 includes a top (or upper) portion 811, a bottom (or lower) portion 812, a first side, a second side, and a back portion. As described herein, the back portion 815 is the portion of the frame 810 that is coupled to the support structure, and extends between the first side and the second side. As shown, the back portion defines a bolt hole 842 to facilitate such mounting. The frame 810 defines a first volume, a second volume, and a longitudinal axis $A_L$ that separates the first volume and the second volume. The first volume can receive at least a portion of the first insert 870, and the second volume can receive at least a portion of a second insert 870', as described above with respect to the devices 200, 300, 400, and 600.

The bottom portion 812 of the frame 810 includes a shelf 820 that is configured to support and/or engage the first insert 870 and the second insert 870'. The shelf 820 can be any shoulder, ledge, protrusion or similar structure that limits the downward movement of the first insert 870 and/or the second insert 870'. In contrast to the frame 710 described above, however, the frame 810 is devoid of an anchor or loop to which a safety link (e.g., a quick draw, a carabiner, or the like, not shown) can be removably coupled.

Although the simulated traditional climbing devices described above, such as the device 200, are shown has having a single mounting surface on the back portion (e.g., the back portion 215) that is coupled to an outer surface of an existing wall or support structure, in other embodiments, a simulated traditional climbing device can be coupled to a support structure in any suitable manner. For example, any of the frames described herein can include a contoured back surface that mates with a corresponding contoured surface of a support structure. In other embodiments, a frame can be configured to be mounted within a support structure in a recessed fashion. Similarly stated, in some embodiments, a device can include a back portion that is mounted within a support structure or wall such that a front surface or face is substantially flush with the wall board surface. In this manner, the frame will not protrude from the wall surface, and will therefore not present a risk of injury when a climber falls onto the frame. Such recessed versions can be easily installed during the initial construction of the training facility, and can therefore be referred to as "new construction" embodiments. Moreover, because portions of the frame in such embodiments are recessed, the inserts can be removed via any suitable opening in the frame (e.g., one or more side openings).

Figure 34:
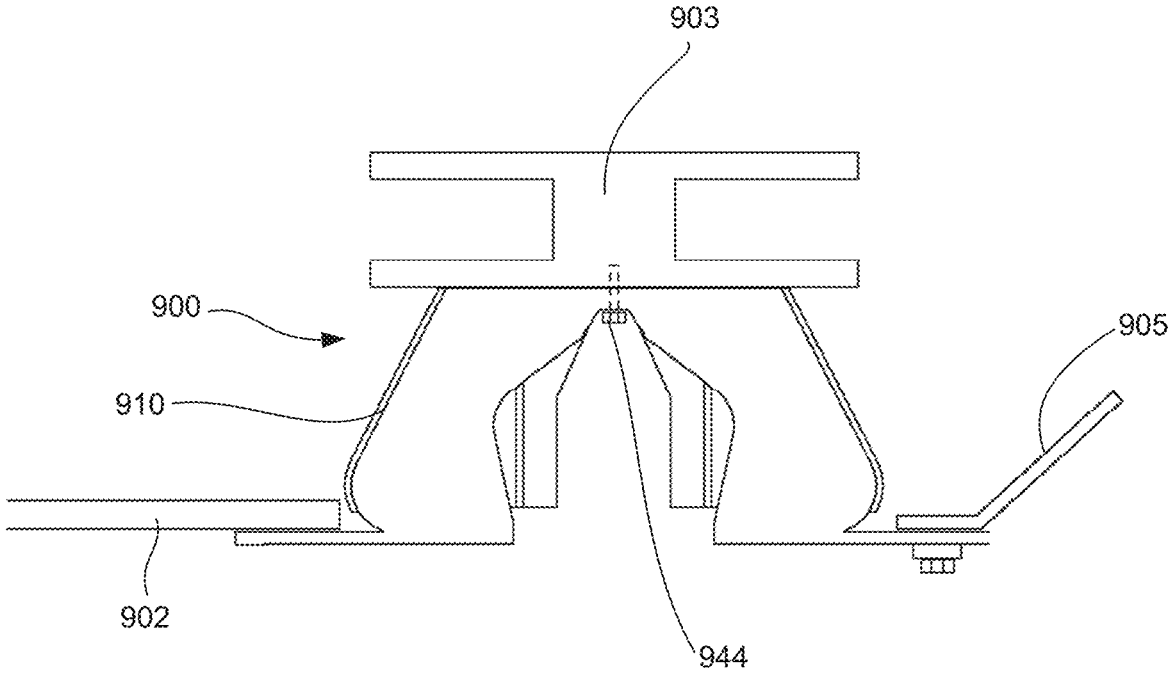
FIG. 34 shows a top view of the simulated traditional climbing device shown in FIGS. 30 and 31 coupled to a support structure.

For example, FIGS. 30-41 show various views of a simulated training device 900, according to an embodiment. The simulated traditional climbing device 900 includes a frame 910 (also referred to as a cage), a first access member 950, a second access member 955, and a series of inserts. Specifically, the series on inserts includes a first major insert 970, a first minor insert 980, and a first intermediate insert 985 that are installed via a first side 913 of the frame 910, and a second major insert 970', a second minor insert 980', and a second intermediate insert 985' that are installed via a second side 914 of the frame 910. The inserts can also be referred to as stones, rocks, or bulk insert material. The simulated traditional climbing device 900, and any of the simulated traditional climbing devices or components therein that are described herein can be used in any suitable application. Such applications include, for example, training on traditional climbing procedures (either in an indoor facility or an outdoor facility), testing of equipment (e.g., testing the support capability of safety equipment), or the like. Specifically, the simulated traditional climbing device 900 can simulate a rock face or crevice within which a protective member can be placed. The simulated traditional climbing device 900 and any of the simulated traditional climbing devices or components therein that are described herein can be coupled or mounted to any suitable support structure. Specifically, as shown in FIG. 34, the device 900 can be mounted to a structure that includes an inner support structure 903 (e.g., an I-beam), and an outer wall 902, and that can include any number of other structural connectors 905 (e.g., rods, hangers, or the like). In this manner, the device 900 can be mounted substantially flush with the surface of the outer wall 902, as described herein. Although FIG. 34 shows the first flange 933 on the outside of the outer wall 902, in other installations, the first flange 933 and/or the second flange 937 can be coupled inside the outer wall 902.

Figure 31:
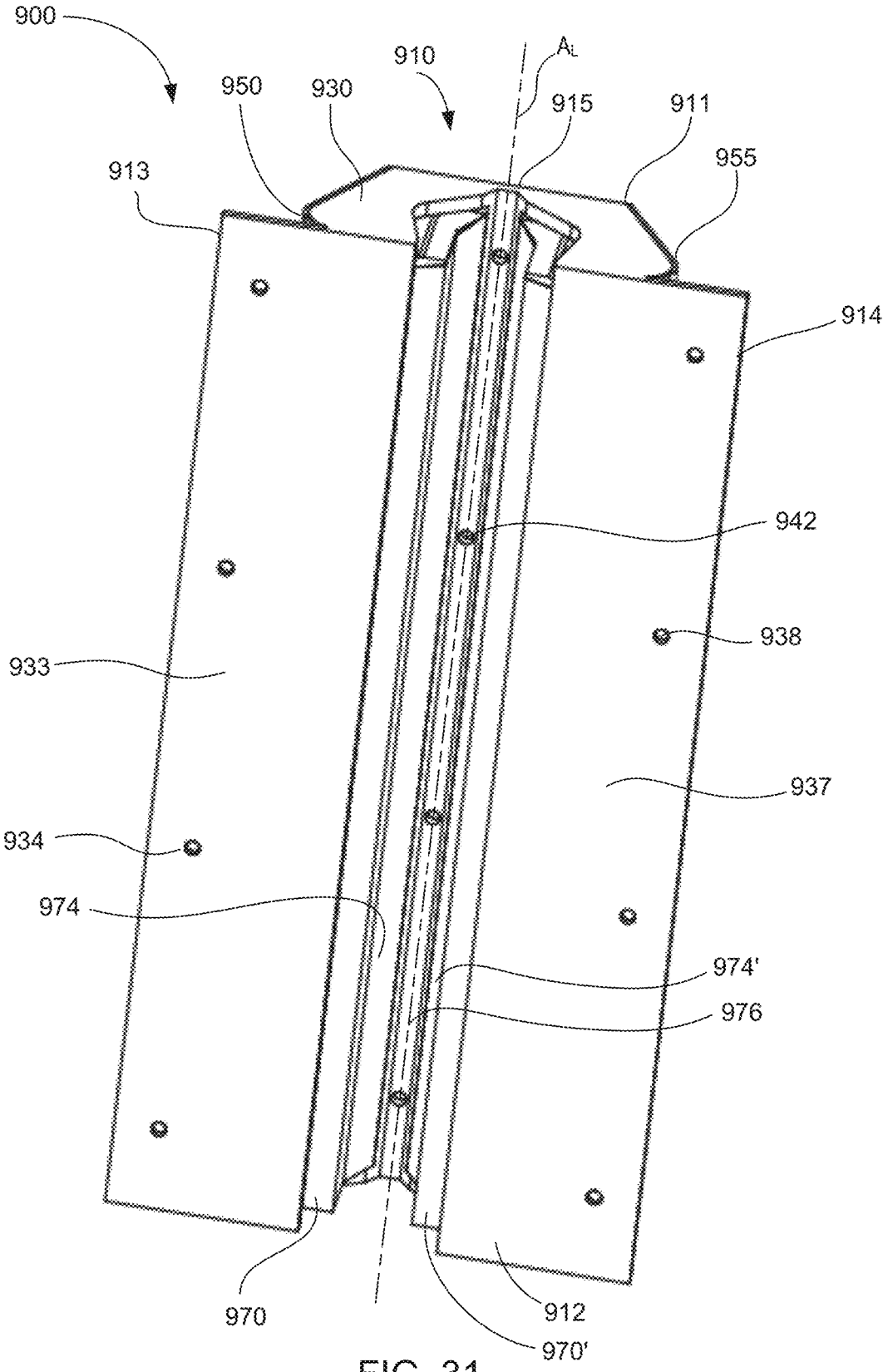
FIG. 31 is a front perspective view of the simulated traditional climbing device shown in FIG. 30.
Figure 32:
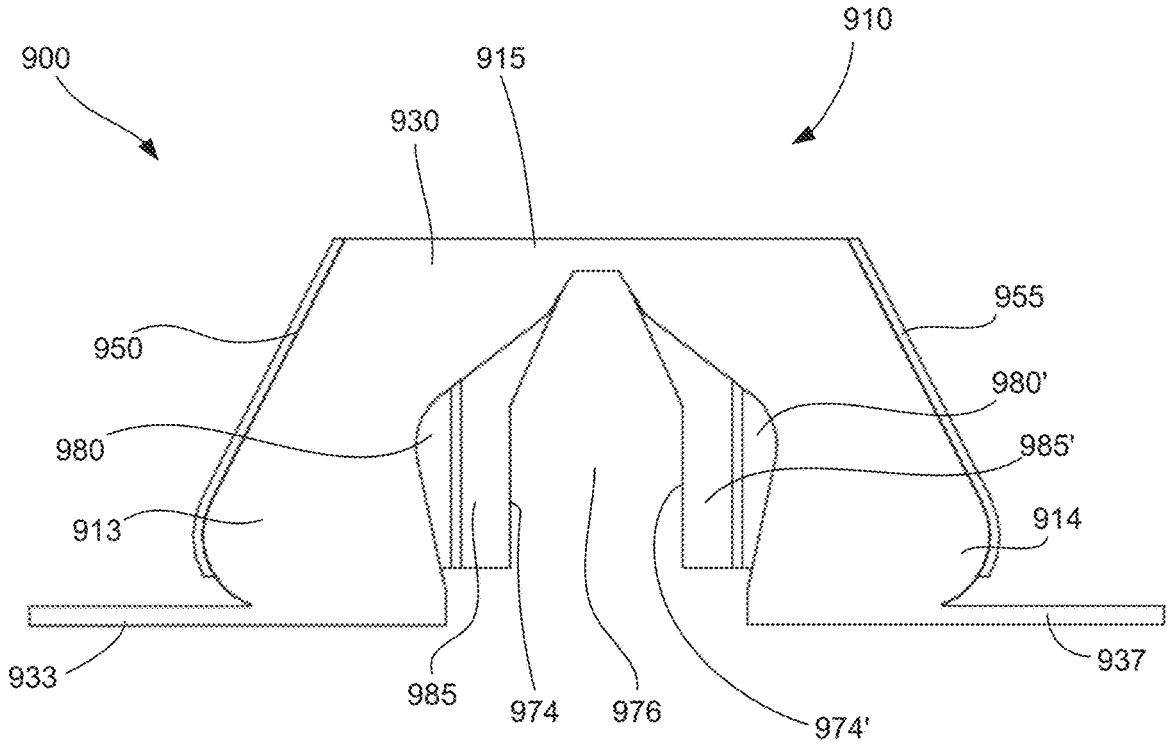
FIGS. 32 and 33 are a top view, and a top cross-sectional view, respectively, of the simulated traditional climbing device shown in FIGS. 30 and 31.
Figure 33:
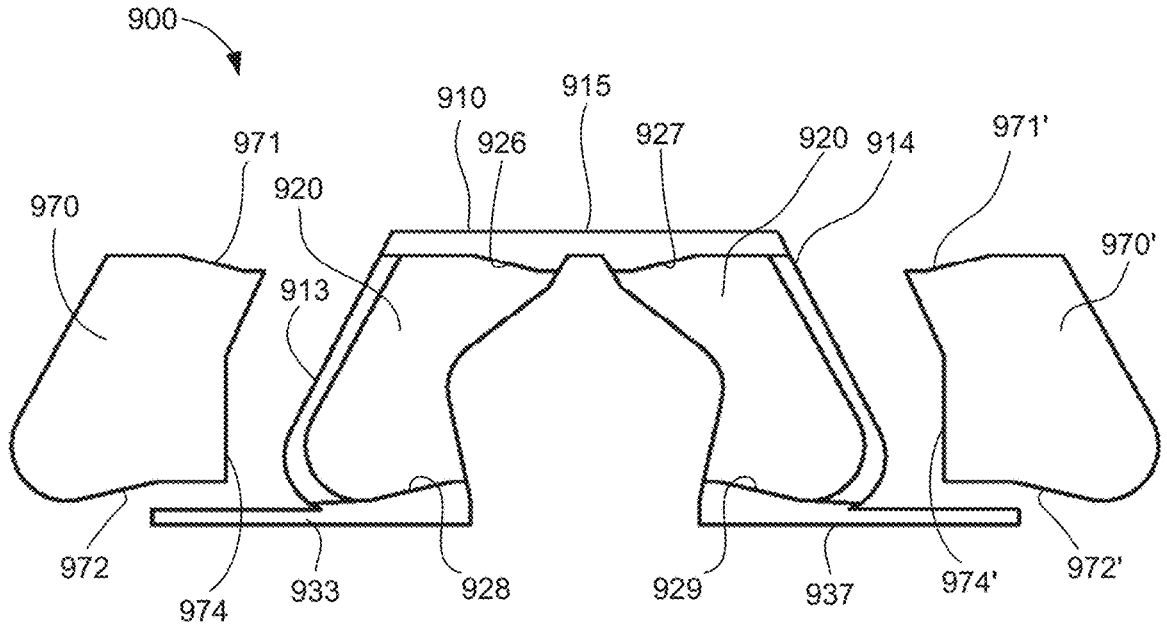
Figure 35:
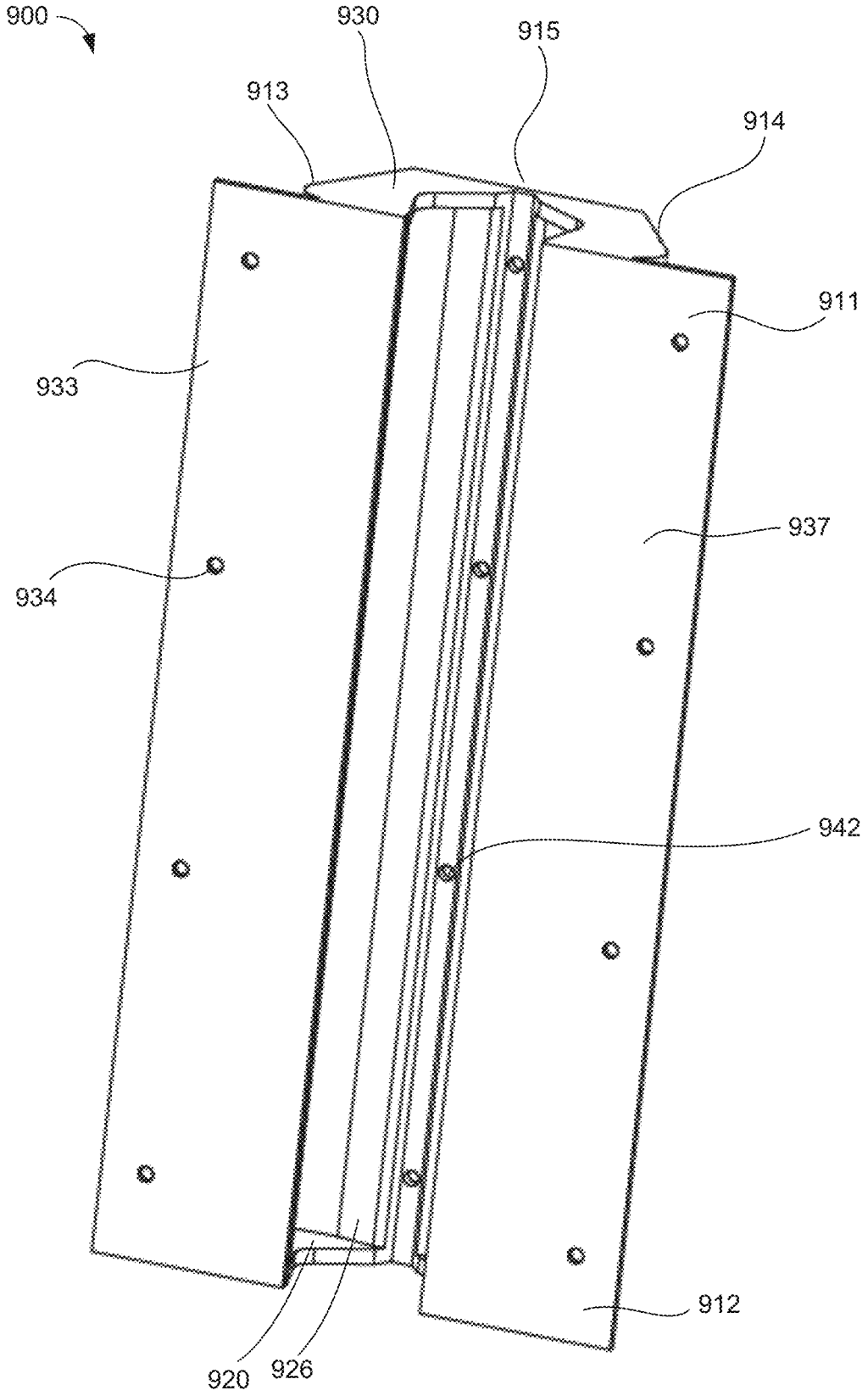
FIGS. 35-36 are a front perspective view and a side perspective view, respectively, of a frame of the simulated traditional climbing device shown in FIGS. 30 and 31.
Figure 36:
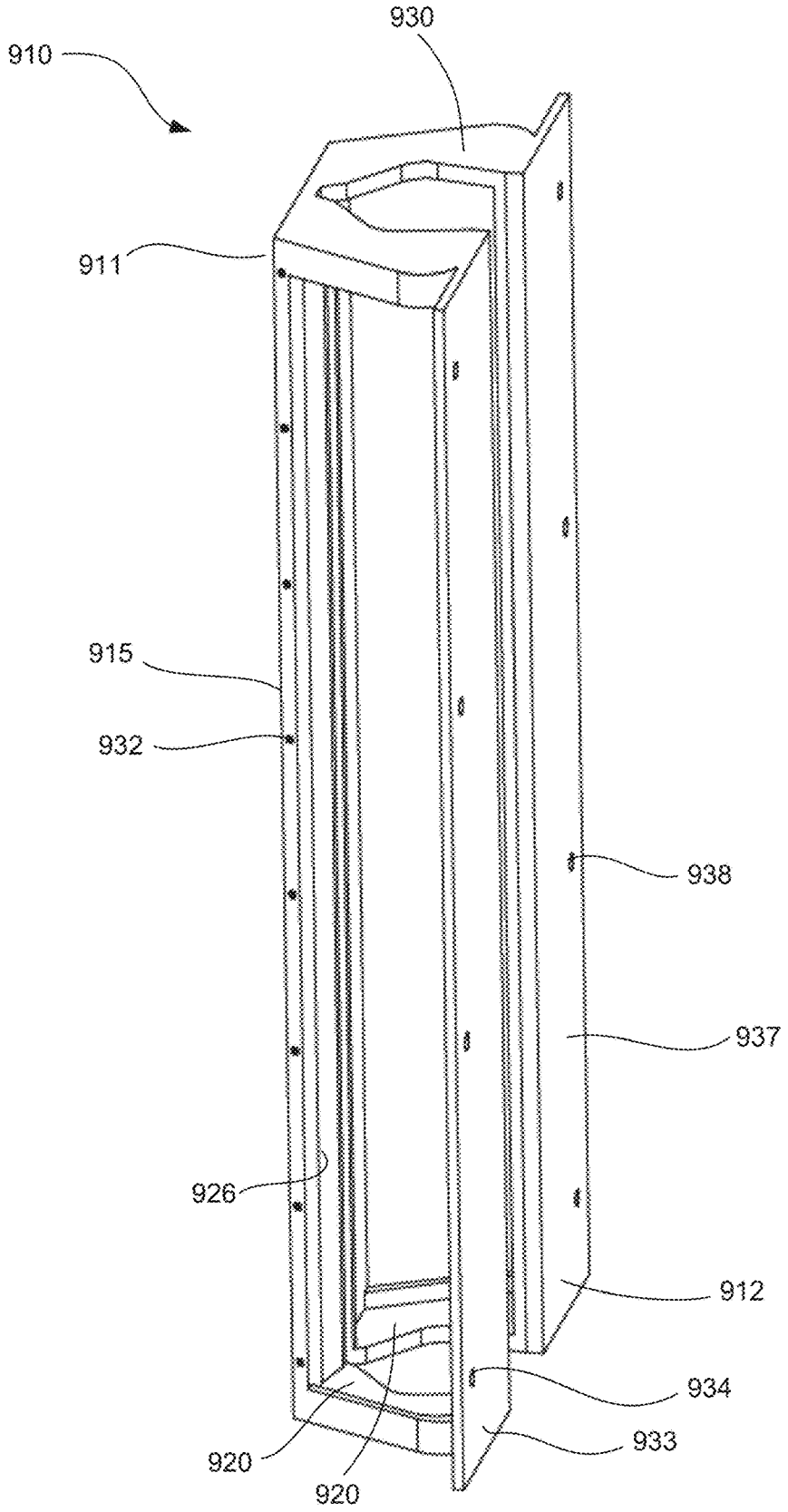
Figure 37:
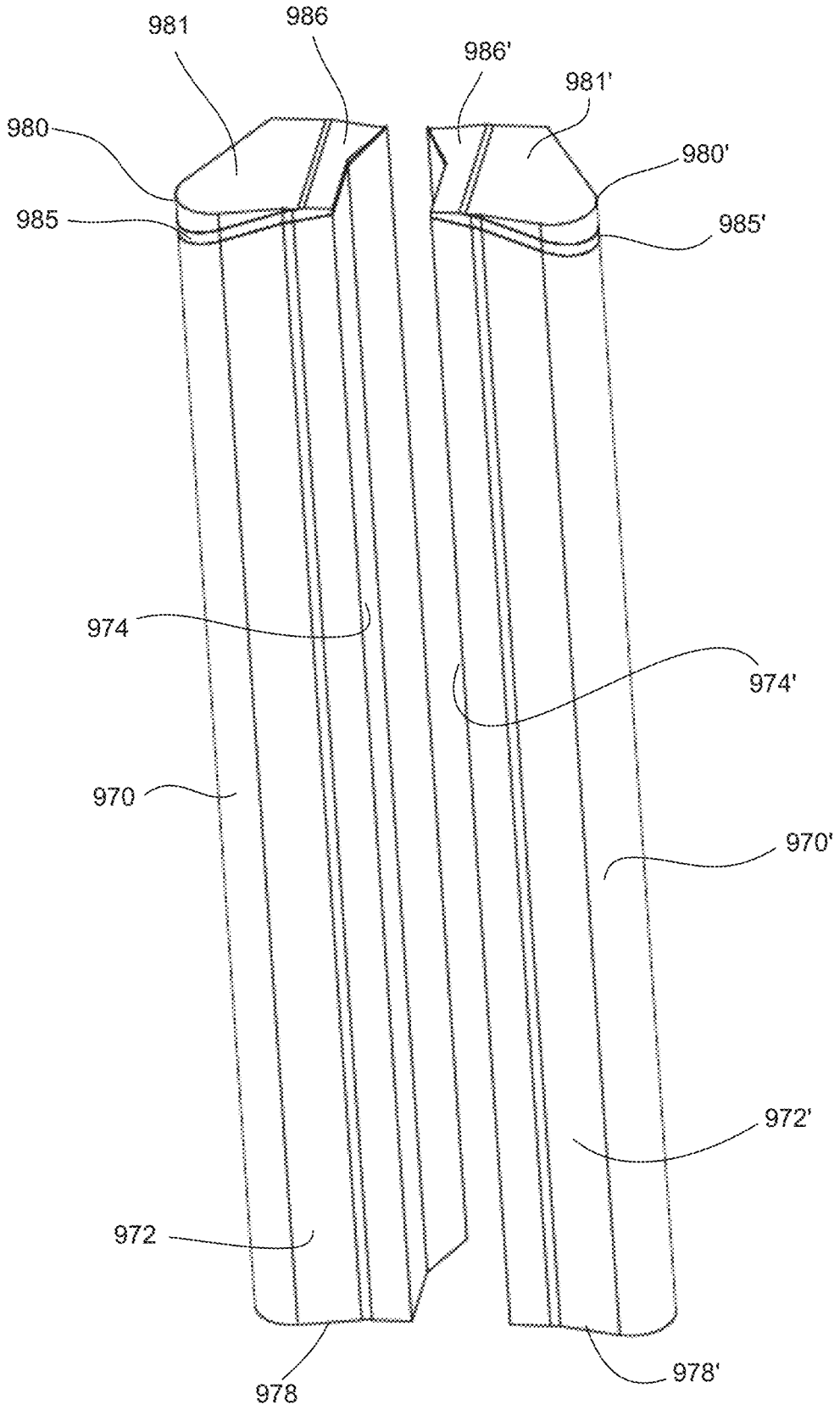
FIG. 37 is a front perspective view of the inserts of the simulated traditional climbing device shown in FIGS. 30 and 31.
Figure 38:
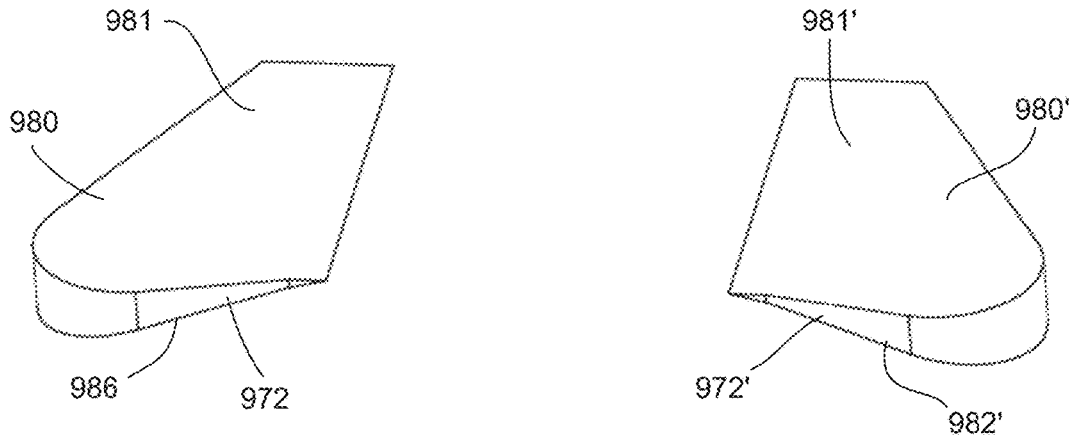
FIG. 38 is a front perspective view of the top inserts of the simulated traditional climbing device shown in FIGS. 30 and 31.
Figure 39:
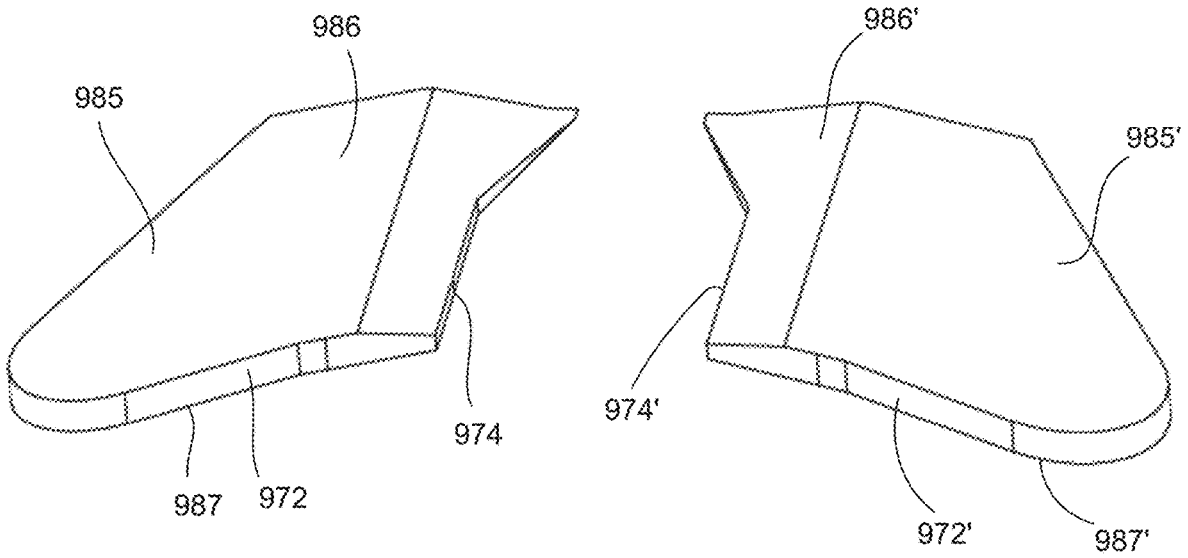
FIG. 39 is a front perspective view of the intermediate inserts of the simulated traditional climbing device shown in FIGS. 30 and 31.

The frame 910 includes a top (or upper) portion 911, a bottom (or lower) portion 912, a first side 913, a second side 914, and a back portion 915. The back portion 915 is the portion of the frame 910 that is recessed within the outer wall 902 and is coupled to the coupled to the support structure 903 by a series of mounting bolts 944. The back portion 915 extends between the first side 913 and the second side 914. Referring to FIG. 35, the frame 910 defines a first volume, a second volume, and a longitudinal axis $A_L$. The longitudinal axis $A_L$ separates the first volume and the second volume, and in some embodiments, can be coincident with an axis of symmetry (or center line) of the frame. The first volume can receive the first series of inserts (the first major insert 970, the first minor insert 980, and the first intermediate insert 985). The second volume can receive the second series of inserts (the second major insert 970', the second minor insert 980', and the second intermediate insert 985'). As shown in FIGS. 31 and 32, the frame 910 is configured such that when the first series of inserts is within the first volume and the second series of inserts is within the second volume, a first engagement surface 974 of the first major insert 970 is facing a second engagement surface 974' of the second major insert 970'. In this manner, the position of the inserts within the frame 910 defines a crevice volume 976 within which a protective member can be placed.

The back portion 915 of the frame includes a first tapered surface 926 and a second tapered surface 927 (see FIG. 33), and defines a channel between the first tapered surface 926 and the second tapered surface 927. The back portion 915 also defines a series of mounting holes 942 within the channel, the holes being located along the longitudinal axis $A_L$. The mounting hole 942 can receive a fastener (e.g., a bolt 944) to secure the frame 910 to the support structure 903. Moreover, the region of the back portion 915 surrounding the mounting hole can be shaped and/or contoured (e.g., via a countersink) to receive a washer, grommet or any other suitable structure to distribute the load from the fastener that is applied to the frame 910.

The first tapered surface 926 is configured to engage a tapered surface 971 of the first major insert 970 (and any similar tapered surfaces on the first minor insert 980, and the first intermediate insert 985) to limit movement of the first insert 970 and/or the first series of inserts along a lateral axis that is nonparallel to the longitudinal axis $A_L$. For example, in some embodiments, the first tapered surface 926 and the corresponding tapered surface 971 of the first major insert 970 can limit horizontal movement (i.e., movement along an axis normal to the longitudinal axis $A_L$) of the first insert 970 within the frame 910. The second tapered surface 927 is configured to engage a tapered surface 971' of the second major insert 970' (and any similar tapered surfaces on the second minor insert 980', and the second intermediate insert 985') to limit movement of the second insert 970' and/or the second series of inserts along a lateral axis that is nonparallel to the longitudinal axis $A_L$. For example, in some embodiments, the second tapered surface 927 and the corresponding tapered surface 971' of the second major insert 970' can limit horizontal movement (i.e., movement along an axis normal to the longitudinal axis $A_L$) of the second insert 970' within the frame 910. In this manner, the distance between a first engagement surface 974 and a second engagement surface 974' can be maintained at a constant value when the device 900 is in use. Similarly stated, by limiting horizontal movement of the engagement surface 974 relative to the second engagement surface 974' the "crevice distance" can be fixed.

The first tapered surface 926 and the second tapered surface 927 can have any suitable taper angle. For example, although the first tapered surface 926 and the second tapered surface 927 are each shown as defining an obtuse angle with respect to the back surface of the frame 910, in other embodiments, the first tapered surface 926 and the second tapered surface 927 can form any suitable angle. Moreover, although the first tapered surface 926 and the second tapered surface 927 are shown as being tapered only in a plane normal to the longitudinal axis $A_L$ (see the top view in FIG. 33), in other embodiments, either (or both) of the first tapered surface 926 and the second tapered surface 927 can be tapered in any number of planes. For example, in some embodiments, the first tapered surface 926 and/or the second tapered surface 927 can taper inwardly. In other words, the protrusion or second tapered surface 927 can be tapered in a plane parallel to the longitudinal axis $A_L$.

The front portion of the frame 910 includes a first front tapered surface and a second front tapered surface 929. The front tapered surface 928 engages the retention surface 972 of the first major insert 970 (and any similar tapered surfaces on the first minor insert 980, and the first intermediate insert 985). In this manner, the front tapered surface 928 can guide the first series of inserts during installation and/or removal from the frame 910, and can also limit movement of the first series of inserts within the frame 910. The second front tapered surface 929 engages the retention surface 972' of the second major insert 970' (and any similar tapered surfaces on the second minor insert 980', and the second intermediate insert 985'). In this manner, the front tapered surface 929 can guide the second series of inserts during installation and/or removal from the frame 910, and can also limit movement of the second series of inserts within the frame 910.

The bottom portion 912 of the frame 910 includes a shelf 920 configured to support and/or engage the first insert 970 and the second insert 970'. The shelf 920 can be any shoulder, ledge, protrusion or similar structure that limits the downward movement of the first insert 970 and/or the second insert 970'. More particularly, the shelf 920 can be any shoulder, ledge, protrusion or similar structure that limits the movement of the first insert 970 and/or the second insert 970' along the longitudinal axis $A_L$ in the downward direction. Moreover, the shelf 920 can be any structure that supports at least a portion of the downward force exerted by the first insert 970 and/or the second insert 970' onto the frame 910. Such downward forces can result from, for example, the weight of the first insert 970 and/or the second insert 970', downward forces applied by the protective gear against the first insert 970 and/or the second insert 970', or the like.

The top portion 911 of the frame includes a top shelf 930 that engages the first minor insert 980 and the second minor insert 980'. In particular, the first minor insert 980 includes a top surface 981 that engages and/or is wedged against the top shelf 930 when the first series of inserts is inserted into the frame. The second minor insert 980' includes a top surface 981' that engages and/or is wedged against the top shelf 930 when the second series of inserts is inserted into the frame. The shelf 920 can be any shoulder, ledge, protrusion or similar structure that limits the upward movement of the first minor insert 980 and the second minor insert 980'. More particularly, the shelf 920 can be any shoulder, ledge, protrusion or similar structure that limits the movement of the first minor insert 980 and the second minor insert 980' along the longitudinal axis $A_L$ in the upward direction.

The first side 913 of the frame 910 includes a first flange 933 and defines an opening 931 through which the first series of inserts can be installed and/or removed. In this manner, the first series of inserts can be replaced when the frame 910 remains coupled to the support structure 903. The first flange 933 can be coupled to the outer wall 902 and defines a series of mounting holes 934. Similarly, the second side 914 of the frame 910 includes a second flange 937 and defines an opening 935 through which the second series of inserts can be installed and/or removed. In this manner, the second series of inserts can be replaced when the frame 910 remains coupled to the support structure 903. The second flange 937 can be coupled to the outer wall 902 and defines a series of mounting holes 938. The first side 913 and the second side 914 each define a series of bolt holes (see, e.g., the holes 932 identified in FIG. 36) that are used to couple the access member 950 and the second access member 955, respectively, to the frame 910.

Figure 40:
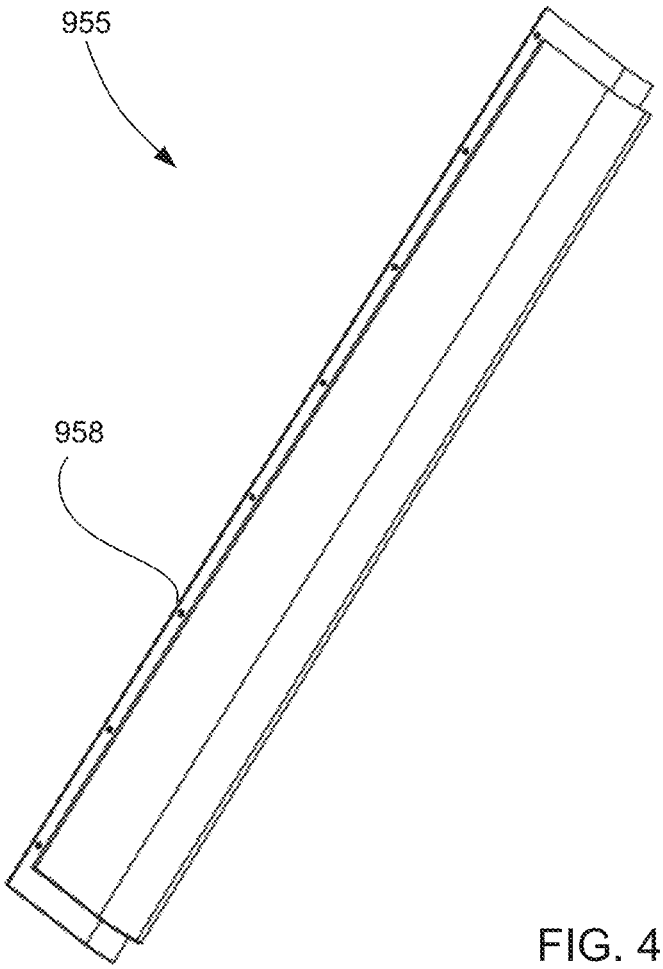
FIGS. 40 and 41 are a front perspective view and a top view, respectively, of an access member of the simulated traditional climbing device shown in FIGS. 30 and 31.
Figure 41:
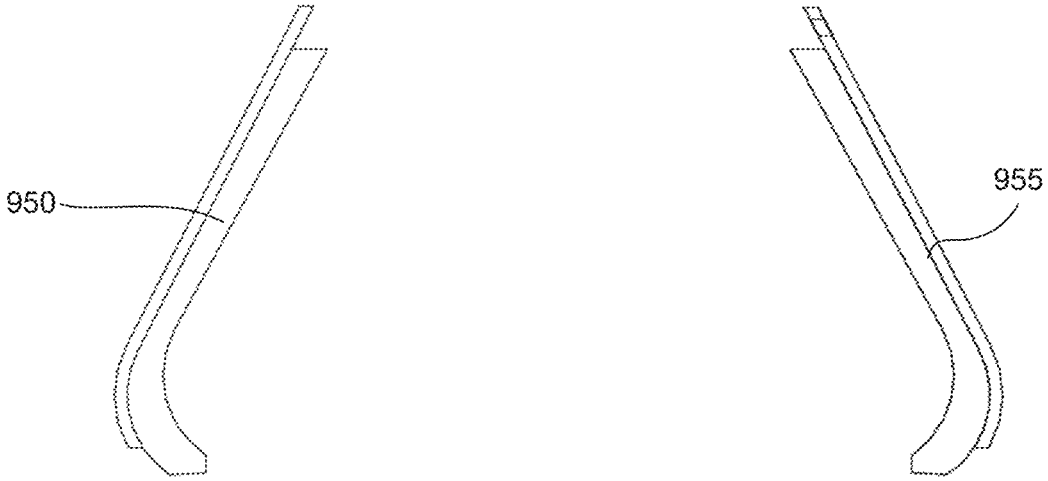

The first access member 950 is removably coupled to the first side 913 of the frame 910 such that the access member 950 covers at least a portion of the side opening 931 and the first volume 916. In this manner, the first access member 950 can limit lateral movement of the first series of inserts within the frame 910. As shown in FIGS. 40 and 41, the first access member 950 includes a mating shoulder shaped to correspond to and/or be matingly engaged with a corresponding surface of the frame 910. The first access member 950 defines a series of fastener holes 958 that can facilitate removably mounting the first access member 950 to the frame 910. In this manner, the first series of inserts can be removed from the first volume of the frame 910. Thus, all or a portion of the first series of inserts can be removed and/or replaced within the frame 910 without disrupting the coupling between the frame 910 and the structural support 903. This modular arrangement allows for different types of inserts to be used in conjunction with the frame 910 to simulate different crevice distances (e.g., wider or narrower crevices), different crevice geometry (degrees of taper, etc.), different types of rock (e.g., different smoothness or surface features), or the like. This modular arrangement also allows for all or a portion of the first series of inserts to be replaced if defective, worn, or otherwise at the end of their service life.

The second access member 955 is removably coupled to the second side 914 of the frame 910 such that the second access member 955 covers at least a portion of the side opening and the second volume. In this manner, the second access member 955 can limit lateral movement of the second series of inserts within the frame 910. As shown in FIGS. 40 and 41, the second access member 955 includes a mating shoulder shaped to correspond to and/or be matingly engaged with a corresponding surface of the frame 910. The second access member 955 defines a series of fastener holes that can facilitate removably mounting the second access member 955 to the frame 910. In this manner, the second series of inserts can be removed from the second volume of the frame 910. Thus, all or a portion of the second series of inserts can be removed and/or replaced within the frame 910 without disrupting the coupling between the frame 910 and the structural support 903. This modular arrangement allows for different types of inserts to be used in conjunction with the frame 910 to simulate different crevice distances (e.g., wider or narrower crevices), different crevice geometry (degrees of taper, etc.), different types of rock (e.g., different smoothness or surface features), or the like. This modular arrangement also allows for all or a portion of the second series of inserts to be replaced if defective, worn, or otherwise at the end of their service life.

Referring to FIGS. 30, 33, 38 and 39, the first major insert 970 includes a top surface 977, a bottom surface 978, a retention surface 972, a rear tapered surface 971, and an engagement surface 974. The top surface 977 is configured to contact and/or engage a surface 987 of the first intermediate insert 985. In this manner, the first major insert 970 can be wedged into the frame 910 to limit upward movement of the first major insert 970, for example, when a piece of protective gear is being pulled upward during removal. The bottom surface 978 engages and/or is supported by the shelf 920. In some embodiments, the bottom surface 978 can be shaped to correspond to the shelf 920. As described above, the retention surface 972 engages the front tapered surface 928. The rear tapered surface 971 engages the first tapered surface 926 of the frame 910 to limit movement of the first insert 970 along a lateral axis that is nonparallel to the longitudinal axis $A_L$, as described above.

The first intermediate insert 985 is a wedge-shaped insert that includes a top surface 986, a bottom surface 987, a retention surface 972, a rear tapered surface, and an engagement surface 974. The bottom surface 987 engages the top surface 977, as described above. The top surface 986 engages a corresponding surface 982 of the first minor insert 980. The first minor insert 980 is a wedge-shaped insert that includes a top surface 981, a bottom surface 982, a retention surface 972, and a rear tapered surface.

The second major insert 970' includes a top surface 977', a bottom surface 978', a retention surface 972', a rear tapered surface 971', and an engagement surface 974'. The top surface 977' is configured to contact and/or engage a surface 987' of the second intermediate insert 985'. In this manner, the second major insert 970' can be wedged into the frame 910' to limit upward movement of the second major insert 970', for example, when a piece of protective gear is being pulled upward during removal. The bottom surface 978' engages and/or is supported by the shelf 920. In some embodiments, the bottom surface 978' can be shaped to correspond to the shelf 920. As described above, the retention surface 972' engages the front tapered surface 929. The rear tapered surface 971' engages the second tapered surface 927 of the frame 910 to limit movement of the second major insert 970' along a lateral axis that is nonparallel to the longitudinal axis $A_L$, as described above.

The second intermediate insert 985' is a wedge-shaped insert that includes a top surface 986', a bottom surface 987', a retention surface 972', a rear tapered surface, and an engagement surface 974'. The bottom surface 987' engages the top surface 977', as described above. The top surface 986' engages a corresponding surface 982' of the second minor insert 980'. The second minor insert 980' is a wedge-shaped insert that includes a top surface 981', a bottom surface 982', a retention surface 972', and a rear tapered surface.

The first engagement surface 974 and/or the second engagement surface 974' can have any shape and/or surface characteristics to simulate an actual rock crevice. For example, although the first engagement surface 974 and the second engagement surface 974' are shown as being linear, in other embodiments, the first engagement surface 974 and/or the second engagement surface 974' can be curved, can have multiple discontinuous surfaces, or any other suitable shape. Moreover, the first engagement surface 974 and/or the second engagement surface 974' can have any surface roughness and/or texture.

In use, the simulated traditional climbing device 900 can be used in conjunction with any suitable type of protective gear to simulate a traditional climbing environment. The protective gear can be wedged and/or secured within the crevice volume 976. Specifically, the protective gear can be placed such it is in contact with the first engagement surface 974 and the second engagement surface 974'. In this manner, downward forces exerted on the protective gear can be transferred via the first insert 970 and the second insert 970' to the frame 910.

Figure 42:
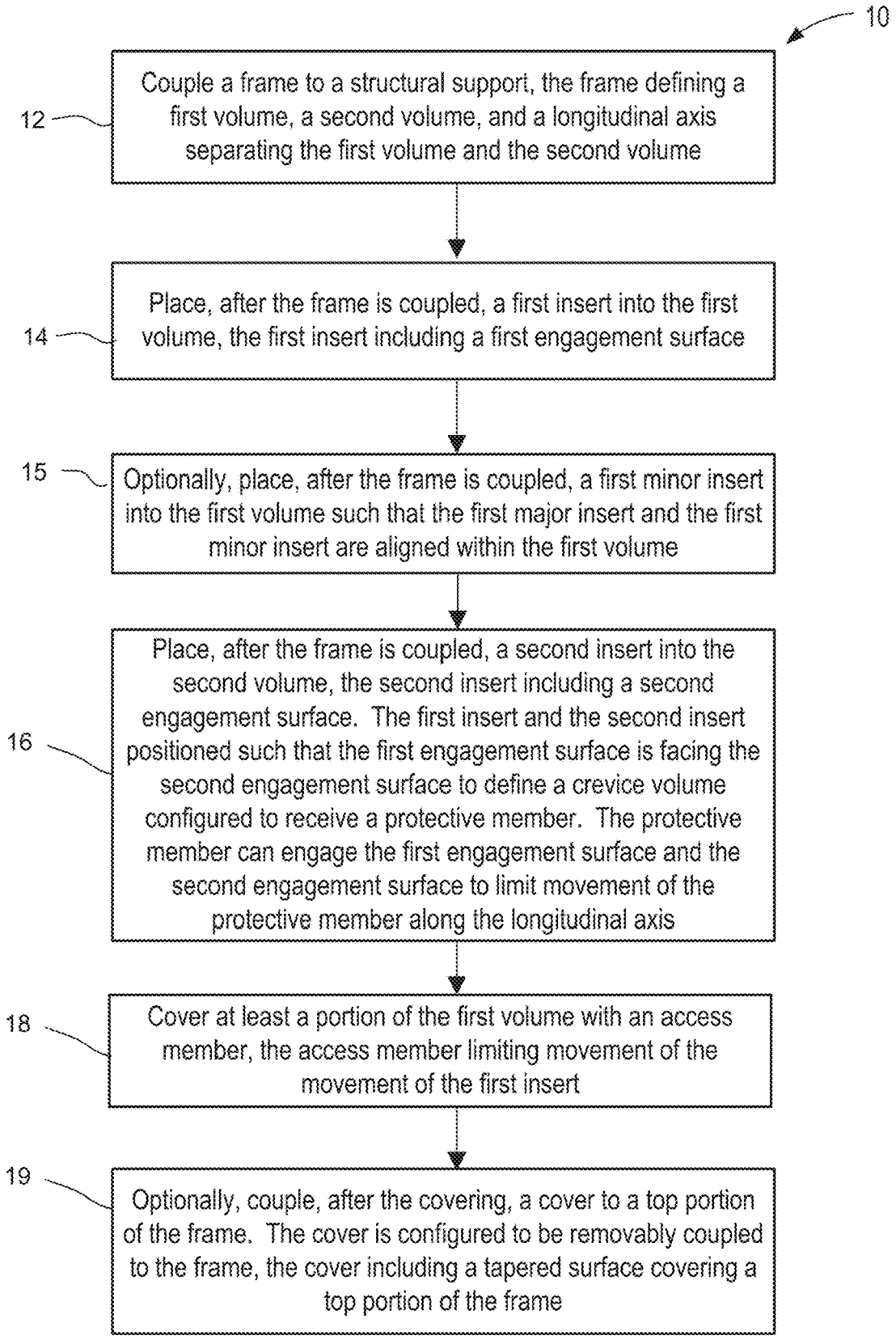
FIG. 42 is a flow chart of a method of installing a simulated traditional climbing device, according to an embodiment.

Any of the simulated traditional climbing devices described herein can be used in any suitable application. FIG. 42 is a flow chart of a method 10 of installing a device, according to an embodiment. The method includes coupling a frame to a structural support, at 12. The frame can be any of the frames shown and described herein, and defines a first volume, a second volume, and a longitudinal axis separating the first volume and the second volume. After the coupling, a first insert is placed into the first volume, the first insert including a first engagement surface, at 14. The first insert can be placed into the first volume via any suitable opening, such as, for example, a top opening (as shown with the frame 200) or a side opening (as shown with the frame 900). In some embodiments, the method optionally includes placing, after the coupling, a first minor insert into the first volume such that the first insert and the first minor insert are aligned within the first volume, at 15. The first minor insert can be, for example, the first minor insert 980 described above.

The method includes placing, after the frame is coupled, a second insert into the second volume, at 16. The second insert can be any of the second inserts shown herein (e.g., the second insert 270', 970' or any others), and includes a second engagement surface. The first insert and the second insert are placed such that the first engagement surface is facing the second engagement surface to define a crevice volume within which a protective member can be placed such that the protective member engages the first engagement surface and the second engagement surface to limit movement of the protective member along the longitudinal axis. At least a portion of the first volume is then covered with an access member to limit movement of the first insert, at 18.

In some embodiments, the method optionally includes coupling, after the covering, a cover to a top portion of the frame, at 19. The cover can be, for example, the cover 360 described above. The cover is configured to be removably coupled to the frame, and can include a tapered surface covering a top portion of the frame. In other embodiments, the cover can be an access member, such as the access member 250 described herein.

In some embodiments, the method optionally includes removing, after the covering, the access member from about the portion of the first volume. The first insert can then be removed from within the first volume. In this manner, as described above, the first insert can be changed, replaced, repaired or the like.

Figure 43:
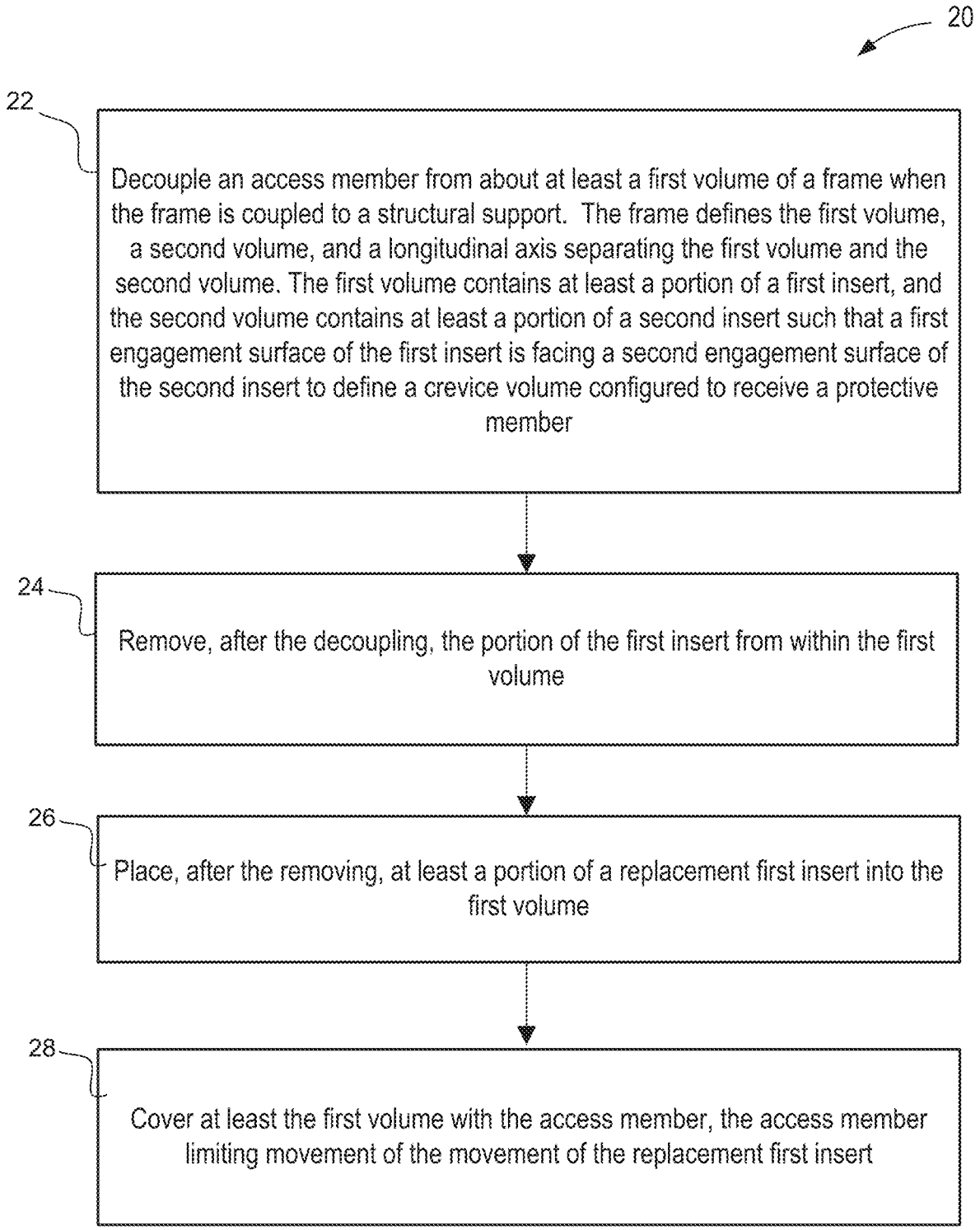
FIG. 43 is a flow chart of a method of replacing an insert of a simulated traditional climbing device, according to an embodiment.

In some embodiments, any of the simulated traditional climbing devices described herein can be repaired, replaced and/or retrofit by removing one or more inserts from the frame when the frame is coupled to a structural support. For example, FIG. 43 is a flow chart of a method 20 of replacing an insert member, according to an embodiment. The method includes decoupling an access member from about at least a first volume of a frame when the frame is coupled to a structural support, at 22. The frame can be any of the frames disclosed herein, and defines the first volume, a second volume, and a longitudinal axis separating the first volume and the second volume. The first volume contains at least a portion of a first insert, and the second volume contains at least a portion of a second insert such that a first engagement surface of the first insert is facing a second engagement surface of the second insert to define a crevice volume within which a protective member can be placed.

After the access member is decoupled, the portion of the first insert is removed from within the first volume, at 24. The portion of the first insert can be removed via any suitable opening, such as for example, a top opening (e.g., defined by the frame 200) or a side opening (defined by the frame 900). After the first insert is removed, at least a portion of a replacement first insert is placed into the first volume, at 26. At least the first volume is then covered with the access member, at 28. The access member limits movement of the replacement first insert.

While various embodiments have been described above, it should be understood that they have been presented by way of example only, and not limitation. Where methods and/or schematics described above indicate certain events and/or flow patterns occurring in certain order, the ordering of certain events and/or operations may be modified. While the embodiments have been particularly shown and described, it will be understood that various changes in form and details may be made.

For example, any of the frames described herein can be constructed in any suitable manner and from any suitable materials. For example, in some embodiments, any of the frames described herein can be monolithically constructed. In other embodiments, any of the frames described herein can be constructed from multiple components (e.g. the shelf, the main body, etc.) that are later joined together (e.g., via welding, mechanical fasteners or the like). In some embodiments, any of the frames described herein can be constructed from a high strength alloy, such as stainless steel, structural steel, titanium alloys, and aluminum alloys (e.g., T6061, Al 2024, 7075-T6 SN), or any other suitable allow that can maintain the desired shape under the loads described herein. In other embodiments, the frame 110 (and any of the frames disclosed herein) can be constructed from a composite material, such as, for example, a carbon fiber-based material. Such composite materials can also include wood, a resin, graphine, meal matrix, fiberglass, fiber reinforced plastics, or the like. In yet other embodiments, the frame 110 (and any of the frames described herein) can be constructed from a polymer (either constructed solely from a polymer, or constructed from a composite material including polymeric constituents). Such polymers include high grade plastics (Ultem 9085) or other thermoplastics.

Any of the inserts described herein can be constructed from any suitable material. For example, in some embodiments, any of the inserts described herein can be constructed from a rock-like material. Such materials can include, for example, resins (polyester, polyethylene, wood, concrete, pre-fab-concrete, reinforced concrete) or stone (including granite, sandstone, quartizite, or the like). The first insert 170, the second insert 170', and/or any of the inserts described herein can be constructed by any suitable process, including molding, CNC machining, laser cutting, stone cutting, 3D printing, or the like. Moreover, in some embodiments, the first engagement surface of any of the inserts described herein can have any suitable surface finish characteristics to simulate actual rocks. In yet other embodiments, any of the engagement surfaces described herein can include a textured portion to increase the friction between the engagement surface and the protective gear. In some embodiments, any of the engagement surfaces described herein can include barbs, contours or other geometric features to increase contact (or friction) between the engagement surface and the protective gear.

Although various embodiments have been described as having particular features and/or combinations of components, other embodiments are possible having a combination of any features and/or components from any of embodiments as discussed above. For example, the device 200 can be configured to remove the inserts via a side opening, similar to that shown in the device 900. Additionally, aspects have been described in the general context of simulated rock climbing devices, and more specifically to traditional climbing simulation devices, but inventive aspects are not necessarily limited to use in traditional climbing or rock climbing.

What is claimed is:

1. An apparatus, comprising:

a frame configured to be mounted to a structural support, the frame defining a first volume, a second volume, and a longitudinal axis separating the first volume and the second volume, the first volume configured to receive at least a portion of a first insert, the second volume configured to receive at least a portion of a second insert, the first insert and the second insert being removably disposable within the first volume and the second volume, respectively, via an opening defined by an end portion of the frame, the frame configured such that when the first insert is within the first volume and the second insert is within the second volume a first engagement surface of the first insert is facing a second engagement surface of the second insert, the frame including a first tapered surface and a second tapered surface, the first tapered surface configured to engage a tapered surface of the first insert to limit movement of the first insert along a lateral axis nonparallel to the longitudinal axis, the second tapered surface configured to engage a tapered surface of the second insert to limit movement of the second insert along the lateral axis; and an access member configured to be coupled to the frame about the opening covering a portion of the first volume, the access member configured to limit movement of the first insert.

2. The apparatus of claim 1, wherein:

the first engagement surface of the first insert and the second engagement surface of the second insert define a crevice volume within which a protective member can be placed such that the protective member engages the first engagement surface and the second engagement surface to limit movement of the protective member along the longitudinal axis.

3. The apparatus of claim 2, wherein the access member defines an opening to allow access to the crevice volume from a region outside of the frame.

4. The apparatus of claim 2, wherein the frame includes an anchor portion to which a safety link can be removably coupled, the crevice volume and the anchor portion each being symmetrical about the longitudinal axis.

5. The apparatus of claim 1, wherein the access member is configured to be removably coupled to the frame such that when the access member is removed from the frame the first insert can be removed from within the first volume when the frame is mounted to the structural support.

6. The apparatus of claim 1, wherein:

the access member is configured to limit movement of the first insert and the second insert along the longitudinal axis in a first direction; and the frame includes a shelf configured to support the first insert and the second insert, the shelf configured to limit movement of the first insert and the second insert along the longitudinal axis in a second direction, the second direction opposite the first direction.

7. The apparatus of claim 1, wherein the frame includes a first retention protrusion configured to engage a retention shoulder of the first insert.

8. The apparatus of claim 1, wherein the frame includes an anchor portion to which a safety link can be removably coupled.

9. The apparatus of claim 1, further comprising:

the first insert; and the second insert, each of the first insert and the second insert being constructed from a rock-like material.

10. An apparatus, comprising:

a frame configured to be mounted to a structural support, the frame defining a first volume, a second volume, and a longitudinal axis separating the first volume and the second volume, the first volume configured to receive at least a portion of a first insert, the second volume configured to receive at least a portion of a second insert, the frame configured such that when the first insert is within the first volume and the second insert is within the second volume a first engagement surface of the first insert is facing a second engagement surface of the second insert to define a crevice volume and such that the first insert and the second insert are maintained in a constant position relative to each other, a protective member can be placed within the crevice volume such that the protective member engages the first engagement surface and the second engagement surface to limit movement of the protective member along the longitudinal axis, the frame includes a shelf configured to support at least the first insert; and an access member configured to be removably coupled to the frame covering at least a portion of the first volume, the access member configured to limit movement of the first insert in a first direction parallel to the longitudinal axis when the access member is coupled to the frame, the shelf configured to limit movement of the first insert in a second direction parallel to the longitudinal axis, the second direction opposite the first direction, the first insert being removable from within the first volume when the access member is removed from the frame and the frame is mounted to the structural support.

11. The apparatus of claim 10, wherein the access member is configured to be coupled the frame covering a portion of the second volume, the access member configured to limit movement of the first insert and the second insert along the longitudinal axis.

12. The apparatus of claim 10, wherein the frame includes a first tapered surface and a second tapered surface, the first tapered surface configured to engage a tapered surface of the first insert to limit movement of the first insert along a lateral axis nonparallel to the longitudinal axis, the second tapered surface configured to engage a tapered surface of the second insert to limit movement of the second insert along the lateral axis.

13. An apparatus, comprising:

a first insert including a first engagement surface, a first tapered surface, and a first curved surface, the first curved surface being on an opposite side of the first insert from the first tapered surface, at least a portion of the first insert configured to be removably disposed within a first volume of a frame configured to be mounted to a structural support, the frame defining the first volume, a second volume, and a longitudinal axis separating the first volume and the second volume, the second volume configured to receive at least a portion of a second insert such that when the first insert is within the first volume and the second insert is within the second volume the first engagement surface of the first insert is facing a second engagement surface of the second insert to define a crevice volume within which a protective member can be placed, the first tapered surface configured to engage a first tapered surface of the frame to limit movement of the first insert along a lateral axis nonparallel to the longitudinal axis, the first curved surface configured to matingly engage a curved surface of the frame when the first insert is disposed within the first volume.

14. The apparatus of claim 13, wherein the first insert is constructed from a rock-like material.

15. The apparatus of claim 13, further comprising:

the second insert, the second insert including the second engagement surface and a second tapered surface, the second tapered surface configured to engage a second tapered surface of the frame to limit movement of the second insert along the lateral axis.

16. An apparatus, comprising:

a frame configured to be mounted to a structural support, the frame defining a first volume, a second volume, and a longitudinal axis separating the first volume and the second volume, the first volume configured to receive at least a portion of a first insert, the second volume configured to receive at least a portion of a second insert, the frame configured such that when the first insert is within the first volume and the second insert is within the second volume a first engagement surface of the first insert is facing a second engagement surface of the second insert, the frame including a first tapered surface and a second tapered surface, the first tapered surface configured to engage a tapered surface of the first insert to limit movement of the first insert along a lateral axis nonparallel to the longitudinal axis, the second tapered surface configured to engage a tapered surface of the second insert to limit movement of the second insert along the lateral axis;

a first access member configured to be removably coupled to the frame covering a portion of the first volume, the first access member configured to limit movement of the first insert when the first access member is coupled to the frame, the first insert being removable from within the first volume when the first access member is removed from the frame and the frame is mounted to the structural support; and a second access member configured to be removably coupled to the frame covering a portion of the second volume, the second access member configured to limit movement of the second insert when the second access member is coupled to the frame, the second insert being removable from within the second volume when the second access member is removed from the frame and the frame is mounted to the structural support.

17. The apparatus of claim 16, wherein:

the frame defines a side opening in fluid communication with the first volume; and the first access member is configured to be removably coupled about the side opening such that the first insert is removable from within the first volume via the side opening when the first access member is removed from the frame and the frame is mounted to the structural support.

18. The apparatus of claim 17, wherein:

the side opening is a first side opening;

the frame defines a second side opening in fluid communication with the second volume; and the second access member is configured to be removably coupled about the second side opening such that the second insert is removable from within the second volume via the second side opening when the second access member is removed from the frame and the frame is mounted to the structural support.

* * * * *